US008563486B2

(12) United States Patent
Tsujimoto et al.

(10) Patent No.: US 8,563,486 B2
(45) Date of Patent: Oct. 22, 2013

(54) LUBRICANT COMPOSITION AND METHOD FOR PRODUCING SAME

(75) Inventors: Teppei Tsujimoto, Tokyo (JP); Shigeki Matsui, Tokyo (JP); Kazuo Tagawa, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 220 days.

(21) Appl. No.: 13/122,828

(22) PCT Filed: Oct. 7, 2009

(86) PCT No.: PCT/JP2009/067509

§ 371 (c)(1),
(2), (4) Date: May 23, 2011

(87) PCT Pub. No.: WO2010/041692

PCT Pub. Date: Apr. 15, 2010

(65) Prior Publication Data

US 2011/0218131 A1 Sep. 8, 2011

(30) Foreign Application Priority Data

Oct. 7, 2008 (JP) ..... P2008-261066
Oct. 7, 2008 (JP) ..... P2008-261078
Oct. 7, 2008 (JP) ..... P2008-261079

(51) Int. Cl.
*C10G 71/00* (2006.01)
*C10M 169/04* (2006.01)
*C10M 145/14* (2006.01)
*F16C 33/20* (2006.01)

(52) U.S. Cl.
USPC ..... 508/110; 208/19; 508/100; 508/469

(58) Field of Classification Search
USPC ..... 508/100, 469, 110; 208/19
See application file for complete search history.

(56) References Cited

U.S. PATENT DOCUMENTS 2,861,941 A * 11/1958 Jancosek et al. ..... 208/25
2,890,161 A 6/1959 Brown et al.
3,078,222 A 2/1963 Henke et al.
3,847,790 A 11/1974 Putz
4,021,357 A 5/1977 Morduchowitz et al.
4,867,894 A 9/1989 Pennewiss et al.
5,282,958 A 2/1994 Santilli et al.
5,362,378 A 11/1994 Borghard et al.
5,652,201 A 7/1997 Papay et al.
5,763,374 A 6/1998 Sakai et al.
5,955,405 A 9/1999 Liesen et al.
6,077,455 A 6/2000 Bloch et al.
6,090,989 A * 7/2000 Trewella et al. ..... 585/13
6,383,366 B1 5/2002 Riley et al.
6,602,402 B1 8/2003 Benazzi et al.
7,285,206 B2 10/2007 Germaine
7,867,957 B2 1/2011 Matsui et al.
2001/0056044 A1 12/2001 Kinker et al.
2002/0119896 A1 8/2002 Yagishita et al.
2003/0036488 A1 2/2003 Yuki et al.
2003/0104955 A1 6/2003 Yuki et al.
2003/0162673 A1* 8/2003 Kurihara et al. ..... 508/364
2003/0226785 A1 12/2003 Murphy et al.
2004/0045868 A1 3/2004 Germaine
2004/0065588 A1 4/2004 Genetti et al.
2004/0077509 A1 4/2004 Yuki et al.
2004/0079675 A1 4/2004 Germaine et al.
2004/0092409 A1 5/2004 Liesen
2004/0099571 A1 5/2004 Germaine et al.
2004/0108249 A1 6/2004 Cody et al.
2004/0112792 A1 6/2004 Murphy et al.
2004/0119046 A1 6/2004 Carey et al.
2004/0129603 A1 7/2004 Fyfe et al.
2004/0154957 A1 8/2004 Keeney et al.
2004/0154958 A1 8/2004 Alexander et al.
2004/0198616 A1 10/2004 Hirao et al.
2004/0224860 A1 11/2004 Baba et al.
2005/0077209 A1 4/2005 Miller et al.
2005/0221998 A1 10/2005 Marumo et al.
2006/0027486 A1 2/2006 Rosenbaum et al.
2006/0052252 A1 3/2006 Wedlock
2006/0172900 A1 8/2006 Yagishita et al.
2006/0205610 A1* 9/2006 Rosenbaum et al. ..... 508/110
2007/0032392 A1 2/2007 Yokoyama et al.
2007/0138032 A1 6/2007 Agarkov (Continued)

FOREIGN PATENT DOCUMENTS

CA 2 682 660 10/2008
CN 1279708 1/2001

(Continued)

OTHER PUBLICATIONS

International Report on Patentability (Japan), mail date is May 26, 2011.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

A lubricating oil composition comprising: a lubricating base oil comprising a first lubricating base oil component having a urea adduct value of not greater than 4% by mass, a kinematic viscosity at 40° C. of 14-25 $mm^2/s$ and a viscosity index of 120 or higher and a second lubricating base oil component having a kinematic viscosity at 40° C. of less than 14 $mm^2/s$, wherein the content of the first lubricating base oil component is 10-99% by mass and the content of the second lubricating base oil component is 1-50% by mass, based on the total amount of the lubricating base oil; and a viscosity index improver, the lubricating oil composition having a kinematic viscosity at 100° C. of 4-12 $mm^2/s$ and a viscosity index of 200-350.

11 Claims, No Drawings

(56) References Cited

U.S. PATENT DOCUMENTS

| | | | |
|---|---|---|---|
| 2007/0138052 | A1 | 6/2007 | Kobayashi et al. |
| 2007/0191239 | A1 | 8/2007 | Matsuoka et al. |
| 2007/0238627 | A1 | 10/2007 | Haire et al. |
| 2007/0287643 | A1 | 12/2007 | Matsui et al. |
| 2008/0015400 | A1 | 1/2008 | Matsui et al. |
| 2008/0029430 | A1 | 2/2008 | Loh et al. |
| 2008/0029431 | A1 | 2/2008 | Alexander et al. |
| 2008/0110799 | A1 | 5/2008 | Matsui et al. |
| 2008/0248981 | A1 | 10/2008 | Matsui et al. |
| 2009/0005278 | A1 | 1/2009 | Takeuchi et al. |
| 2009/0075852 | A1 | 3/2009 | Yagishita et al. |
| 2009/0221461 | A1 | 9/2009 | Visger et al. |
| 2009/0312208 | A1 | 12/2009 | Ishikawa et al. |
| 2010/0016195 | A1 | 1/2010 | Shirahama et al. |
| 2010/0035777 | A1 | 2/2010 | Sano et al. |
| 2010/0041572 | A1 | 2/2010 | Sano et al. |
| 2010/0093578 | A1 | 4/2010 | Tsujimoto et al. |
| 2010/0130395 | A1 | 5/2010 | Tagawa et al. |
| 2010/0144571 | A1 | 6/2010 | Shirahama et al. |
| 2010/0190671 | A1 | 7/2010 | Stoehr et al. |
| 2011/0003725 | A1 | 1/2011 | Matsui et al. |
| 2011/0021394 | A1 | 1/2011 | Nakao et al. |
| 2011/0042267 | A1 | 2/2011 | Hayasaka |
| 2011/0049008 | A1 | 3/2011 | Tagawa et al. |
| 2011/0049009 | A1 | 3/2011 | Tagawa et al. |
| 2011/0053815 | A1 | 3/2011 | Matsui et al. |
| 2011/0065618 | A1 | 3/2011 | Tagawa |
| 2011/0124536 | A1 | 5/2011 | Matsui |
| 2011/0218131 | A1 | 9/2011 | Tsujimoto et al. |
| 2011/0230685 | A1 | 9/2011 | Tagawa |
| 2011/0237477 | A1 | 9/2011 | Tagawa et al. |
| 2011/0306530 | A1 | 12/2011 | Manabe et al. |
| 2012/0071373 | A1 | 3/2012 | Matsui et al. |
| 2012/0071374 | A1 | 3/2012 | Yaguchi et al. |
| 2012/0071375 | A1 | 3/2012 | Yaguchi et al. |
| 2012/0135900 | A1 | 5/2012 | Matsui et al. |
| 2012/0157361 | A1 | 6/2012 | Mutou et al. |

FOREIGN PATENT DOCUMENTS

| | | |
|---|---|---|
| CN | 1751115 | 3/2006 |
| CN | 1317368 C | 5/2007 |
| CN | 101065469 | 10/2007 |
| CN | 101213277 | 7/2008 |
| CN | 101426879 | 5/2009 |
| EP | 1 749 876 | 2/2007 |
| EP | 1 808 476 | 7/2007 |
| EP | 1 845 151 | 10/2007 |
| EP | 2 011 855 | 8/2008 |
| EP | 2 009 074 | 12/2008 |
| EP | 2 009 704 | 12/2008 |
| EP | 2 011 854 | 1/2009 |
| EP | 2 112 217 | 10/2009 |
| EP | 2135928 | 12/2009 |
| EP | 2 241 611 | 10/2010 |
| EP | 2264131 | 12/2010 |
| EP | 2264133 | 12/2010 |
| EP | 2 319 908 | 5/2011 |
| GB | 2407100 | 4/2005 |
| JP | S30-000624 | 2/1955 |
| JP | S31-003928 | 5/1956 |
| JP | S45-019183 | 7/1970 |
| JP | S48-025003 | 4/1973 |
| JP | 63-223094 | 9/1988 |
| JP | S63-309592 | 12/1988 |
| JP | 3-100099 | 4/1991 |
| JP | 4-030391 | 2/1992 |
| JP | 4-36391 | 2/1992 |
| JP | 4-68082 | 3/1992 |
| JP | 4-120193 | 4/1992 |
| JP | H5-508876 | 12/1993 |
| JP | 6-145258 | 5/1994 |
| JP | 6-306384 | 11/1994 |
| JP | 7-48421 | 2/1995 |
| JP | 7-62372 | 3/1995 |
| JP | 8-183988 | 7/1996 |
| JP | 8-302378 | 11/1996 |
| JP | 9-003463 | 1/1997 |
| JP | 2000-063439 | 2/2000 |
| JP | 2000-63877 | 2/2000 |
| JP | 2000-345170 | 12/2000 |
| JP | 2000-345171 | 12/2000 |
| JP | 2001-514301 | 9/2001 |
| JP | 2001-279278 | 10/2001 |
| JP | 2001-279287 | 10/2001 |
| JP | 2002-503754 | 2/2002 |
| JP | 2002-503755 | 2/2002 |
| JP | 2002-129182 | 5/2002 |
| JP | 2002-521499 | 7/2002 |
| JP | 2002-302687 | 10/2002 |
| JP | 2004-10799 | 1/2004 |
| JP | 2004-124080 | 4/2004 |
| JP | 2004-169029 | 6/2004 |
| JP | 2004-526831 | 9/2004 |
| JP | 2004-528426 | 9/2004 |
| JP | 2005-154760 | 6/2005 |
| JP | 2005-171186 | 6/2005 |
| JP | 2005-213447 | 8/2005 |
| JP | 2005-290238 | 10/2005 |
| JP | 2005-530902 | 10/2005 |
| JP | 2006-502297 | 1/2006 |
| JP | 2006-502298 | 1/2006 |
| JP | 2006-045277 | 2/2006 |
| JP | 2006-509899 | 3/2006 |
| JP | 2006-219642 | 8/2006 |
| JP | 2006-518395 | 8/2006 |
| JP | 2006-241436 | 9/2006 |
| JP | 2006-241437 | 9/2006 |
| JP | 2006-521416 | 9/2006 |
| JP | 2006-274209 | 10/2006 |
| JP | 2006-117851 | 11/2006 |
| JP | 2006-117853 | 11/2006 |
| JP | 2007-16172 | 1/2007 |
| JP | 2007-045850 | 2/2007 |
| JP | 2007-217494 | 8/2007 |
| JP | 2007-246659 | 9/2007 |
| JP | 2007-246661 | 9/2007 |
| JP | 2007-246662 | 9/2007 |
| JP | 2007-262239 | 10/2007 |
| JP | 2007-269885 | 10/2007 |
| JP | 2007-270059 | 10/2007 |
| JP | 2007-270062 | 10/2007 |
| JP | 2007-284635 | 11/2007 |
| JP | 2007-297528 | 11/2007 |
| JP | 2007-326963 | 12/2007 |
| JP | 2008-013281 | 1/2008 |
| JP | 2008-13681 | 1/2008 |
| JP | 2008-013684 | 1/2008 |
| JP | 2008-509244 | 3/2008 |
| JP | 2008-120908 | 5/2008 |
| JP | 2008-120909 | 5/2008 |
| JP | 2008-184569 | 8/2008 |
| JP | 2008-231189 | 10/2008 |
| JP | 2008-231190 | 10/2008 |
| JP | 2008-231191 | 10/2008 |
| JP | 2008-274236 | 11/2008 |
| JP | 2008-274237 | 11/2008 |
| JP | 2008-274238 | 11/2008 |
| JP | 2008-303344 | 12/2008 |
| JP | 2009-096925 | 5/2009 |
| JP | 2009-167278 | 7/2009 |
| JP | 2009-074068 | 9/2009 |
| JP | 2010-532805 | 10/2010 |
| WO | 9603359 | 2/1996 |
| WO | 99/41334 | 8/1999 |
| WO | 02/070629 | 9/2002 |
| WO | 2005/037967 | 4/2005 |
| WO | 2005/090528 | 9/2005 |
| WO | 2006/043709 | 4/2006 |
| WO | 2007/001000 | 1/2007 |
| WO | 2007/105769 | 9/2007 |
| WO | 2007/114132 | 10/2007 |
| WO | 2007/114260 | 10/2007 |

(56) References Cited

FOREIGN PATENT DOCUMENTS

| | | |
|---|---|---|
| WO | 2007/116759 | 10/2007 |
| WO | 2007/119299 | 10/2007 |
| WO | 2007/123266 | 11/2007 |
| WO | 2007/133999 | 11/2007 |
| WO | 2008/072526 | 6/2008 |
| WO | 2008/093446 | 8/2008 |
| WO | 2008/123246 | 10/2008 |
| WO | 2008/123249 | 10/2008 |
| WO | 2009/007147 | 1/2009 |
| WO | 2009/072524 | 6/2009 |
| WO | 2009/090921 | 7/2009 |
| WO | 2009/119505 | 10/2009 |
| WO | 2010/041689 | 4/2010 |
| WO | 2010/041692 | 4/2010 |

OTHER PUBLICATIONS

"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to European Patent Application No. 09819126 5, mailed May 23, 2012.
Search report from E.P.O. that issued with respect to European Patent Application No. 09819223 0, mailed May 23, 2012.
Notification of Information Provision issued with respect to Japanese Patent Application No. 2009-135369, mailed May 29, 2012.
Notification of Information Provision issued with respect to Japanese Patent Application No. 2009-135444, mailed Jun. 19, 2012.
Office Action issued with respect to Chinese Patent Application No. 200980149130.9, mailed Dec. 4, 2012.
Office Action issued with respect to Chinese Patent Application No. 201080024425.6, mailed Dec. 12, 2012.
Office Action issued with respect to Chinese Patent Application No. 201080024832.7, mailed Dec. 12, 2012.
Office Action issued with respect to U.S. Appl. No. 12/812,524, mailed Jan. 22, 2013.
E.P.O. Office action that issued with respect to European Patent Application No. 09723908.1, mailed Mar. 2, 2012.
English-language translation of International Preliminary Report on Patentability for PCT/JP2009/0067163, mailed May 26, 2011.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2010/050916, mailed Jan. 26, 2012.
English-language translation of International Preliminary Report on Patentability for PCT/JP2010/050921, mailed Jan. 26, 2012.
English-language translation of International Preliminary Report on Patentability for PCT/JP2010/057957, mailed Jan. 26, 2012.
English-language translation of International Preliminary Report on Patentability for PCT/JP2010/059196, mailed Jan. 26, 2012.
English-language translation of International Preliminary Report on Patentability for PCT/JP2010/064698, mailed Mar. 29, 2012.
International Search Report for PCT/JP2009/0067504, mailed Dec. 28, 2009.
International Search Report for PCT/JP2009/055667, mailed Jun. 16, 2009.
International Search Report for PCT/JP2010/050916, mailed Apr. 13, 2010.
International Search Report for PCT/JP2010/050921, mailed Apr. 6, 2010.
International Search Report for PCT/JP2010/057957, mailed Aug. 17, 2010.
International Search Report for PCT/JP2010/059196, mailed Aug. 31, 2010.
International Search Report for PCT/JP2010/064698 (English and Japanese) , mailed Nov. 2, 2010.
J.P.O. Notification of Information Provision issued with respect to Japanese Patent Application No. 2008-078224, mailed May 15, 2012.
E.P.O. Search Report that issued with respect to European Patent Application No. 09723908.1, mailed Jun. 29, 2011.
Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
J.P.O. Notification of Information Provision issued with respect to Japanese Patent Application No. 2008-261070, mailed Jun. 26, 2012.
E.P.O. Search Report issued with respect to patent family member European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to European Patent Application No. 09701700.8, mailed Jul. 5, 2012.
Search Report issued with respect to patent family member European Patent Application No. 12002743.8, mailed Aug. 16, 2012.
Search Report issued with respect to patent family member European Patent Application No. 12002744.6, mailed Aug. 16, 2012.
Office Action issued with respect to Indonesian Patent Application No. W00201003649, mailed Aug. 23, 2012.
Office Action issued with respect to U.S. Appl. No. 12/812,524, mailed Aug. 28, 2012.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Office Action issued with respect to Japanese Patent Application No. 2008-006024, mailed Dec. 4, 2012.
Search Report issued with respect to European Patent Application No. 10783230.5, mailed Feb. 11, 2013.
Search Report issued with respect to European Patent Application No. 12008549.3, mailed Feb. 11, 2013.
Office Action issued with respect to U.S. Appl. No. 12/934,374, mailed Mar. 25, 2013.
Office Action issued with respect to U.S. Appl. No. 13/122,622, mailed Mar. 22, 2013.
Office Action issued with respect to Chinese Patent Application No. 200980110123.8, mailed Apr. 1, 2013.
Schiessler et al., "Urea and Thiourea Adduction of $C_5$-$C_{42}$ -Hydrocarbons", *Journal of the American Chemical Society*, vol. 74, No. 7, pp. 1720-1723, Apr. 5, 1952.
Notification of Information Provision issued with respect to Japanese Patent App. No. 2008-006024, mailed May 14, 2013.

(56) References Cited

OTHER PUBLICATIONS

Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.

Yozo Oshima et al., "Monomethylparaffins in n—Paraffins Adducted from Petroleum Fractions", Sekiyu Gakkaishi, vol. 18, No. 6, 1975, pp. 497-502, along with a partial English-language translation.

Notification of Information Provision issued with respect to Japanese Patent App. No. 2008-261079, mailed Mar. 12, 2013.

Japanese Office Action issued with respect to Japanese Patent Application No. 2008-261079, dated May 21, 2013.

Japanese Office Action issued with respect to Japanese Patent Application No. 2008-261070, dated Jul. 2, 2013.

Japanese Office Action issued with respect to Japanese Patent Application No. 2009-135369, dated Jul. 16, 2013.

* cited by examiner

LUBRICANT COMPOSITION AND METHOD FOR PRODUCING SAME

TECHNICAL FIELD

The present invention relates to a lubricating oil composition and to a method for producing the same.

BACKGROUND ART

In the field of lubricating oils, additives such as viscosity index improvers and pour point depressants have conventionally been added to lubricating base oils, including highly refined mineral oils, to improve the viscosity-temperature characteristics or low-temperature viscosity characteristics of the lubricating oils (see Patent documents 1-7, for example). Known methods for producing high-viscosity-index base oils include methods in which feed stock oils containing natural or synthetic normal paraffins are subjected to lubricating base oil refining by hydrocracking/hydroisomerization (see Patent documents 7-10, for example).

The viscosity index is commonly evaluated as the viscosity-temperature characteristic of lubricating base oils and lubricating oils, while the properties evaluated for the low-temperature viscosity characteristics are generally the pour point, clouding point and freezing point. Methods are also known for evaluating the low-temperature viscosity characteristics for lubricating base oils according to their normal paraffin or isoparaffin contents.

CITATION LIST

Patent Literature

[Patent document 1] Japanese Unexamined Patent Application Publication HEI No. 4-36391

[Patent document 2] Japanese Unexamined Patent Application Publication HEI No. 4-68082

[Patent document 3] Japanese Unexamined Patent Application Publication HEI No. 4-120193

[Patent document 4] Japanese Unexamined Patent Application Publication HEI No. 7-48421

[Patent document 5] Japanese Unexamined Patent Application Publication HEI No. 7-62372

[Patent document 6] Japanese Unexamined Patent Application Publication HEI No. 6-145258

[Patent document 7] Japanese Unexamined Patent Application Publication HEI No. 3-100099

[Patent document 8] Japanese Unexamined Patent Application Publication No. 2005-154760

[Patent document 9] Japanese Patent Public Inspection No. 2006-502298

[Patent document 10] Japanese Patent Public Inspection No. 2002-503754

SUMMARY OF INVENTION

Technical Problem

In recent years, with the ever increasing demand for fuel efficiency of lubricating oils, the conventional lubricating base oils and viscosity index improvers have not always been adequate in terms of the viscosity-temperature characteristic and low-temperature viscosity characteristics. Particularly with SAE10 class lubricating base oils, or lubricating oil compositions comprising them as major components, it is difficult to achieve high levels of both fuel efficiency and low temperature viscosity (CCS viscosity, MRV viscosity, and the like) while maintaining high-temperature high-shear viscosity.

If only the low temperature viscosity is to be improved, this is possible if combined with the use of lubricating base oils that exhibit excellent low temperature viscosity, such as synthetic oils including poly-α-olefinic base oils or esteric base oils, or low-viscosity mineral base oils, but such synthetic oils are expensive, while low-viscosity mineral base oils generally have low viscosity indexes and high NOACK evaporation. Consequently, adding such lubricating base oils increases the production cost of lubricating oils, or makes it difficult to achieve a high viscosity index and low evaporation properties. Moreover, only limited improvement in fuel efficiency can be achieved even when using these conventional lubricating base oils.

It is therefore a first object of the invention to provide a high-viscosity-index lubricating oil composition that has excellent fuel efficiency and low temperature viscosity, and can exhibit both fuel efficiency and low temperature viscosity at −35° C. and below while maintaining high-temperature high-shear viscosity, even without using a synthetic oil such as a poly-α-olefinic base oil or esteric base oil, or a low-viscosity mineral base oil, and in particular, that can reduce the HTHS viscosity at 100° C. of the lubricating oil while maintaining a constant HTHS viscosity at 150° C. and that can notably improve the CCS viscosity at −35° C. and below.

Recently, demand has been increasing for a greater fuel efficiency effect, by lowering the viscosity during engine start-up at low temperature and reducing viscous resistance. Lubricating base oils used in conventional internal combustion engine lubricating oils, although referred to as "high performance base oils", are not always adequate in terms of their viscosity-temperature characteristics/low-temperature viscosity characteristics. Including additives in lubricating base oils can result in some improvement in the viscosity-temperature characteristic/low-temperature viscosity characteristic as well, but this approach has had its own restrictions. Pour point depressants, in particular, do not exhibit effects proportional to the amounts in which they are added, and even reduce shear stability when added in large amounts.

The properties conventionally evaluated for the low-temperature viscosity characteristic of lubricating base oils and lubricating oils are generally the pour point, clouding point and freezing point. Recently, methods have also been known for evaluating the low-temperature viscosity characteristic based on the lubricating base oils, according to their normal paraffin or isoparaffin contents. Based on investigation by the present inventors, however, in order to realize a lubricating base oil and lubricating oil that can meet the demands mentioned above, it was judged that the indexes of pour point or freezing point are not necessarily suitable as evaluation indexes for the low-temperature viscosity characteristic (fuel efficiency) of a lubricating base oil.

It is therefore a second object of the invention to provide a lubricating base oil and lubricating oil composition that have an excellent viscosity-temperature characteristic and low-temperature viscosity characteristic and allow sufficient long drain properties and fuel efficiency to be achieved.

Demand for greater fuel efficiency has continued to increase in recent years in the field of automobiles as well, but it cannot be said that sufficient fuel efficiency for practical use has been achieved, even with combinations of conventional lubricating base oils and viscosity index improvers.

Incidentally, it has been argued that lubricating base oils with higher viscosity indexes allow improvement in high-temperature fuel efficiency if their viscosity is reduced. In actuality, however, viscosity reduction lowers the antiwear property, which is the basic function of the lubricating oil, and tends to lower the long-term reliability.

It is therefore a third object of the invention to provide a lubricating oil composition for an internal combustion engine wherein the viscosity-temperature characteristic, low-temperature viscosity characteristic and antiwear property are all improved to a high-level balance, allowing fuel efficiency to be effectively achieved.

Solution to Problem

In order to solve the problems described above, the invention provides a lubricating oil composition comprising: a lubricating base oil comprising a first lubricating base oil component having a urea adduct value of not greater than 4% by mass, a kinematic viscosity at 40° C. of 14-25 $mm^2/s$ and a viscosity index of 120 or higher, and a second lubricating base oil component having a kinematic viscosity at 40° C. of less than 14 $mm^2/s$, wherein the content of the first lubricating base oil component is 10-99% by mass and the content of the second lubricating base oil component is 1-50% by mass, based on the total amount of the lubricating base oil; and a viscosity index improver, the composition having a kinematic viscosity at 100° C. of 4-12 $mm^2/s$ and a viscosity index of 200-350 (hereinafter referred to as "first lubricating oil composition" for convenience).

Regarding the distillation properties of the lubricating base oil in the first lubricating oil composition, preferably an initial boiling point is not higher than 370° C., a 90% distillation temperature is 430° C. or higher, and a difference between the 90% distillation temperature and a 10% distillation temperature is at least 50° C.

In the first lubricating oil composition, the viscosity index improver is preferably a poly(meth)acrylate-based viscosity index improver.

The term "poly(meth)acrylate", according to the invention, is a general term for polyacrylate and polymethacrylate.

Preferably, the PSSI of the poly(meth)acrylate-based viscosity index improver in the first lubricating oil composition is not greater than 40, and a ratio of a weight-average molecular weight and the PSSI of the poly(meth)acrylate-based viscosity index improver is at least $1\times10^4$.

Also, the ratio of the HTHS viscosity at 100° C. with respect to the HTHS viscosity at 150° C. in the first lubricating oil composition preferably satisfies the condition represented by the following inequality (A):

$$HTHS(100°\ C.)/HTHS(150°\ C.)\leq 2.04 \quad (A),$$

wherein HTHS (100° C.) represents the HTHS viscosity at 100° C. and HTHS (150° C.) represents the HTHS viscosity at 150° C.

The invention further provides a method for producing a lubricating oil composition comprising: blending a first lubricating base oil component having a urea adduct value of not greater than 4% by mass, a kinematic viscosity at 40° C. of 14-25 $mm^2/s$ and a viscosity index of 120 or higher, a second lubricating base oil component having a kinematic viscosity at 40° C. of less than 14 $mm^2/s$, and a viscosity index improver, to obtain a lubricating base oil wherein the content of the first lubricating base oil component is 10-99% by mass and the content of the second lubricating base oil component is 1-50% by mass, based on the total amount of the lubricating base oil; and adding a viscosity index improver to the lubricating base oil, to obtain a lubricating oil composition having a kinematic viscosity at 100° C. of 4-12 $mm^2/s$ and a viscosity index of 200-350 (hereinafter referred to as "first production method" for convenience).

The invention further provides a lubricating oil composition for an internal combustion engine comprising: a lubricating base oil having a viscosity index of 100 or higher, an initial boiling point of not higher than 400° C., a 90% distillation temperature of 470° C. or higher and a difference of the 90% distillation temperature and a 10% distillation temperature of at least a 70° C.; an ashless antioxidant containing no sulfur as a constituent element; and at least one selected from among ashless antioxidants containing sulfur as a constituent element and organic molybdenum compounds, wherein the lubricating base oil comprises a first lubricating base oil component having a urea adduct value of not greater than 4% by mass, a viscosity index of 100 or higher and a kinematic viscosity at 100° C. of at least 3.5 $mm^2/s$ and less than 4.5 $mm^2/s$, and a second lubricating base oil component having a urea adduct value of not greater than 4% by mass, a viscosity index of 120 or higher and a kinematic viscosity at 100° C. of 4.5-20 $mm^2/s$ (hereinafter referred to as "second lubricating oil composition" for convenience).

The lubricating base oil in the second lubricating oil composition has excellent heat and oxidation stability itself, because it comprises the first and second lubricating base oil components. When the lubricating base oil includes additives, it can exhibit a higher level of function for the additives while maintaining stable dissolution of the additives. Moreover, by adding both an ashless antioxidant containing no sulfur as a constituent element (hereinafter also referred to as "component (A)") and at least one compound selected from among ashless antioxidants containing sulfur as a constituent element and organic molybdenum compounds (hereinafter also referred to as "component (B)") to the lubricating base oil having such excellent properties, it is possible to maximize the effect of improved heat and oxidation stability by synergistic action of components (A) and (B). A lubricating oil composition for an internal combustion engine comprising a lubricating base oil of the invention with the aforementioned additives allows a sufficient long drain property to be achieved.

In the second lubricating oil composition, since the lubricating base oil comprises the first and second lubricating oil components described above and the viscosity index of the lubricating base oil itself is 100 or higher, the lubricating base oil itself exhibits an excellent viscosity-temperature characteristic and frictional properties. Furthermore, the lubricating base oil can reduce viscous resistance or stirring resistance in a practical temperature range due to its excellent viscosity-temperature characteristic, and its effect can be notably exhibited by drastically reducing the viscous resistance or stirring resistance under low temperature conditions of 0° C. and below, thus reducing energy loss in devices and allowing energy savings to be achieved. Moreover, the lubricating base oil is excellent in terms of the solubility and efficacy of its additives, as mentioned above, and therefore a high level of friction reducing effect can be obtained when a friction modifier is added. Consequently, the second lubricating oil composition containing such an excellent lubricating base oil results in reduced energy loss due to friction resistance or stirring resistance at sliding sections, and can therefore provide adequate energy savings.

It has been difficult to achieve improvement in the low-temperature viscosity characteristic while also ensuring low volatility when using conventional lubricating base oils, but the lubricating base oil of the invention, having such a structure, can achieve a satisfactory balance with high levels of both low-temperature viscosity characteristic and low volatility. The second lubricating oil composition is therefore useful for improving the cold-start property, in addition to the long drain property and energy savings for internal combustion engines.

In the second lubricating oil composition, the lubricating base oil is preferably one obtained by a step of hydrocracking/hydroisomerization of a feed stock oil containing normal paraffins so as to obtain a treated product having a urea adduct value of not greater than 4% by mass and a viscosity index of 100 or higher. This can more reliably yield a lubricating oil composition having heat/oxidation stability and high levels of both viscosity-temperature characteristic and low-temperature viscosity characteristic.

The first lubricating base oil component is preferably a lubricating base oil component obtained by a step of hydrocracking/hydroisomerization of a feed stock oil containing normal paraffins so as to obtain a treated product having a urea adduct value of not greater than 4% by mass, a viscosity index of 100 or higher and a kinematic viscosity at 100° C. of at least 3.5 $mm^2/s$ and less than 4.5 $mm^2/s$, and the second lubricating base oil component is preferably a lubricating base oil component obtained by a step of hydrocracking/hydroisomerization of a feed stock oil containing normal paraffins so as to obtain a treated product having a urea adduct value of not greater than 4% by mass, a viscosity index of 120 or higher and a kinematic viscosity at 100° C. of 4.5-20 $mm^2/s$.

The second lubricating oil composition is preferably one having a low-temperature viscosity grade of SAE0W or 5W and a high-temperature viscosity grade of SAE30 or greater (SAE40, SAE50, SAE60). SAE viscosity grade is the viscosity grade specified according to SAE-J300, and for example, 0W viscosity grade is a CCS viscosity at −30° C. of up to 3250 mPa·s or a CCS viscosity at −35° C. of up to 6200 mPa·s, a MRV viscosity at −40° C. of up to 60,000 mPa·s and a kinematic viscosity at 100° C. of 3.8 $mm^2/s$ or greater. 5W viscosity grade is a CCS viscosity at −25° C. of up to 3500 mPa·s or a CCS viscosity at −30° C. of up to 6600 mPa·s, a MRV viscosity at −35° C. of up to 60,000 mPa·s, and a kinematic viscosity at 100° C. of 3.8 $mm^2/s$ or greater. SAE30 grade is a kinematic viscosity at 100° C. of at least 9.3 $mm^2/s$ and less than 12.5 $mm^2/s$ and a HTHS viscosity at 150° C. of 2.9 mPa·s or greater. That is, SAE0W-30 grade satisfies both the 0W low-temperature viscosity grade and SAE30 high-temperature viscosity grade.

The CCS viscosity at −35° C. of the second lubricating oil composition is preferably not greater than 6,000 mPa·s.

The MRV viscosity at −40° C. of the second lubricating oil composition is preferably not greater than 20,000 mPa·s.

In the second lubricating oil composition, a difference between a 90% distillation temperature and a 10% distillation temperature of the first lubricating base oil component is preferably 40-100° C. On the other hand, a difference between a 90% distillation temperature and a 10% distillation temperature of the second lubricating base oil component is preferably 35-110° C.

The invention still further provides a method for producing a lubricating base oil comprising: blending a first lubricating base oil component having a urea adduct value of not greater than 4% by mass, a viscosity index of 100 or higher and a kinematic viscosity at 100° C. of at least 3.5 $mm^2/s$ and less than 4.5 $mm^2/s$, and a second lubricating base oil component having a urea adduct value of not greater than 4% by mass, a viscosity index of 120 or greater and a kinematic viscosity at 100° C. of 4.5-20 $mm^2/s$, to obtain a lubricating base oil having a viscosity index of 100 or higher, an initial boiling point of not higher than 400° C., a 90% distillation temperature of 470° C. or higher and a difference between the 90% distillation temperature and a 10% distillation temperature of at least a 70° C., as well as a method for producing a lubricating oil composition for an internal combustion engine comprising: adding an ashless antioxidant containing no sulfur as a constituent element, and at least one selected from among ashless antioxidants containing sulfur as a constituent element and organic molybdenum compounds to the lubricating base oil (hereinafter referred to as "second production method" for convenience).

The invention still further provides a lubricating oil composition for an internal combustion engine (hereinafter referred to as "third lubricating oil composition" for convenience) comprising a lubricating base oil having a urea adduct value of not greater than 4% by mass and a viscosity index of 100 or higher (hereinafter also referred to as "lubricating base oil of the invention"), and a poly(meth)acrylate with a weight-average molecular weight of 200,000-400,000 (hereinafter also referred to as "poly(meth)acrylate of the invention").

The lubricating base oil in the third lubricating oil composition, having a urea adduct value and viscosity index that satisfy the conditions specified above, exhibits an excellent viscosity-temperature characteristic and low-temperature viscosity characteristic, while also having lower viscous resistance or stirring resistance and improved heat and oxidation stability, frictional properties and antiwear property. When the lubricating base oil of the invention includes additives, it can exhibit a high level of function for the additives. Thus, the third lubricating oil composition exhibits both the aforementioned excellent properties of the lubricating base oil of the invention and the effect of addition of a poly(meth) acrylate according to the invention, and can improve the viscosity-temperature characteristic, low-temperature viscosity characteristic and antiwear property to high levels in a satisfactory balance, while allowing fuel efficiency to be effectively achieved.

In the third lubricating oil composition, the lubricating base oil is preferably a lubricating base oil obtained by a step of hydrocracking/hydroisomerization of a feed stock oil containing normal paraffins so as to obtain a treated product having a urea adduct value of not greater than 4% by mass and a viscosity index of 100 or higher.

In addition, the feed stock oil preferably contains at least 50% by mass slack wax obtained by solvent dewaxing of the lubricating base oil.

The urea adduct value according to the invention is measured by the following method. A 100 g weighed portion of sample oil (lubricating base oil) is placed in a round bottom flask, 200 g of urea, 360 ml of toluene and 40 ml of methanol are added and the mixture is stirred at room temperature for 6 hours. This produces white particulate crystals in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (mass percentage) of hydrocarbon component (urea adduct) obtained in this manner with respect to the sample oil is defined as the urea adduct value.

While efforts are being made to improve the isomerization rate from normal paraffins to isoparaffins in conventional refining processes for lubricating base oils by hydrocracking and hydroisomerization, as mentioned above, the present inventors have found that it is difficult to satisfactorily improve the low-temperature viscosity characteristic simply by reducing the residual amount of normal paraffins. That is, although the isoparaffins produced by hydrocracking and hydroisomerization also contain components that adversely affect the low-temperature viscosity characteristic, this fact has not been fully appreciated in the conventional methods of evaluation. Methods such as gas chromatography (GC) and NMR are also applied for analysis of normal paraffins and isoparaffins, but the use of these analysis methods for separation and identification of the components in isoparaffins that adversely affect the low-temperature viscosity characteristic involves complicated procedures and is time-consuming, making them ineffective for practical use.

With measurement of the urea adduct value according to the invention, on the other hand, it is possible to accomplish precise and reliable collection of the components in isoparaffins that can adversely affect the low-temperature viscosity characteristic, as well as normal paraffins when normal paraffins are residually present in the lubricating base oil, as urea adduct, and it is therefore an excellent indicator for evaluation of the low-temperature viscosity characteristic of lubricating base oils. The present inventors have confirmed that when analysis is conducted using GC and NMR, the main urea adducts are urea adducts of normal paraffins and of isoparaffins having carbon atoms from a terminal carbon atom of a main chain to a point of branching of 6 or greater.

The viscosity index according to the invention, and the kinematic viscosity at 40° C. or 100° C., are the viscosity index and the kinematic viscosity at 40° C. or 100° C. as measured according to JIS K 2283-1993.

The terms "initial boiling point" and "90% distillation temperature", and the 10% distillation temperature, 50% distillation temperature and final boiling point explained hereunder, as used herein, are the initial boiling point (IBP), 90% distillation temperature (T90), 10% distillation temperature (T10), 50% distillation temperature (T50) and final boiling point (FBP) as measured according to ASTM D 2887-97. The difference between the 90% distillation temperature and 10% distillation temperature, for example, will hereunder be represented as "T90-T10".

The term "poly(meth)acrylate", according to the invention, is a general term for polyacrylate and polymethacrylate.

The abbreviation "PSSI" as used herein stands for the "Permanent Shear Stability Index" of the polymer, which is calculated according to ASTM D 6022-01 (Standard Practice for Calculation of Permanent Shear Stability Index) based on data measured according to ASTM D 6278-02 (Test Method for Shear Stability of Polymer Containing Fluids Using a European Diesel Injector Apparatus).

Advantageous Effects of Invention

The first lubricating oil composition of the invention is superior in terms of fuel efficiency, low evaporation properties and low-temperature viscosity characteristic, and can exhibit fuel efficiency and both NOACK evaporation and low-temperature viscosity at −35° C. and below while maintaining HTHS viscosity at 150° C., even without using a synthetic oil such as a poly-α-olefinic base oil or esteric base oil, or a low-viscosity mineral base oil, and in particular it can reduce the kinematic viscosity at 40° C. and 100° C. and the HTHS viscosity at 100° C., while also notably improving the CCS viscosity at −35° C. (MRV viscosity at −40° C.), of the lubricating oil.

The first lubricating oil composition is also useful for gasoline engines, diesel engines and gas engines for two-wheel vehicles, four-wheel vehicles, electric power generation and cogeneration, while it can be suitably used not only for such engines that run on fuel with a sulfur content of not greater than 50 ppm by mass, but also for marine engines, outboard motor engines and the like. Because of its excellent viscosity-temperature characteristic, the first lubricating oil composition is particularly effective for increasing fuel efficiency of engines having roller tappet-type valvetrain.

According to the first production method of the invention, it is possible to easily and reliably obtain a first lubricating oil composition having the excellent properties described above.

In addition, the second lubricating oil composition of the invention can realize a lubricating oil composition for an internal combustion engine that has an excellent viscosity-temperature characteristic/low-temperature viscosity characteristic, frictional properties, heat and oxidation stability, and low volatility. Moreover, when the second lubricating oil composition is applied to an internal combustion engine, it allows a long drain property and energy savings to be achieved, while also improving the cold-start property.

According to the second production method of the invention, it is possible to easily and reliably obtain a second lubricating oil composition having the excellent properties described above.

Furthermore, the third lubricating oil composition of the invention has an effect that allows the viscosity-temperature characteristic, low-temperature viscosity characteristic and antiwear property to all be improved to a high-level balance, allowing fuel efficiency to be effectively achieved.

DESCRIPTION OF EMBODIMENTS

Preferred embodiments of the invention will now be described in detail.

[First Embodiment: First Lubricating Oil Composition and First Production Method]

(Lubricating Base Oil)

The first lubricating oil composition comprises a lubricating base oil, which comprises a first lubricating base oil component having a urea adduct value of not greater than 4% by mass, a kinematic viscosity at 40° C. of 14-25 $mm^2/s$ and a viscosity index of 120 or higher, and a second lubricating base oil component having a kinematic viscosity at 40° C. of less than 14 $mm^2/s$, wherein the content of the first lubricating base oil component is 10-99% by mass and the content of the second lubricating base oil component is 1%-50% by mass, based on the total amount of the lubricating base oil.

So long as the first lubricating base oil component has a urea adduct value, kinematic viscosity at 40° C. and viscosity index satisfying the aforementioned conditions, it may be a mineral base oil, a synthetic base oil, or even a mixture thereof.

The first lubricating base oil component is preferably a mineral base oil or synthetic base oil, or a mixture thereof, obtained by hydrocracking/hydroisomerization of a feed stock oil containing normal paraffins so that a urea adduct value is not greater than 4% by mass, a kinematic viscosity at 40° C. is 14-25 $mm^2/s$ and a viscosity index is 120 or higher, since this will allow all of the requirements for the viscosity-temperature characteristic, low-temperature viscosity characteristic and thermal conductivity to be achieved at a high levels.

From the viewpoint of improving the low-temperature viscosity characteristic without impairing the viscosity-temperature characteristic, and obtaining high thermal conductivity, the urea adduct value of the first lubricating base oil component must be not greater than 4% by mass as mentioned above, but it is preferably not greater than 3.5% by mass, more preferably not greater than 3% by mass, even more preferably not greater than 2.5% by mass, yet more preferably not greater than 2.0% by mass and most preferably not greater than 1.5% by mass. Also, the urea adduct value of the lubricating base oil component may even be 0% by mass, but from the viewpoint of obtaining a lubricating base oil with a sufficient low-temperature viscosity characteristic and high viscosity index, and also of relaxing the dewaxing conditions and improving economy, it is preferably 0.1% by mass or greater, more preferably 0.5% by mass or greater and most preferably 0.8% by mass or greater.

The kinematic viscosity at 40° C. of the first lubricating base oil component must be 14-25 $mm^2/s$, but it is preferably 14.5-20 $mm^2/s$, more preferably 15-19 $mm^2/s$, even more preferably not greater than 15-18 $mm^2/s$, yet more preferably 15-17 $mm^2/s$ and most preferably 15-16.5 $mm^2/s$. The kinematic viscosity at 40° C. is the kinematic viscosity at 40° C. measured according to ASTM D-445. If the kinematic viscosity at 40° C. of the first lubricating base oil component exceeds 25 $mm^2/s$, the low-temperature viscosity characteristic may be impaired and sufficient fuel efficiency may not be obtained, while if the kinematic viscosity at 40° C. of the first lubricating base oil component is less than 14 $mm^2/s$, oil film formation at the lubricated sections will be inadequate, resulting in inferior lubricity and potentially large evaporation loss of the lubricating oil composition.

The viscosity index of the first lubricating base oil component must be a value of 120 or higher in order to obtain an excellent viscosity characteristic from low temperature to high temperature, and for resistance to evaporation even with low viscosity, but it is preferably 125 or higher, more preferably 130 or higher, even more preferably 135 or higher and most preferably 140 or higher. There are no particular restrictions on the upper limit for the viscosity index, and it may be about 125-180 such as for normal paraffins, slack waxes or GTL waxes, or their isomerized isoparaffinic mineral oils, or about 150-250 such as for complex esteric base oils or HVI-PAO base oils. However, for normal paraffins, slack waxes or GTL waxes, or their isomerized isoparaffinic mineral oils, it is preferably not higher than 180, more preferably not higher than 170, even more preferably not higher than 160 and especially not higher than 155, for an improved low-temperature viscosity characteristic.

A feed stock oil containing normal paraffins may be used for production of the first lubricating base oil component. The feed stock oil may be a mineral oil or a synthetic oil, or a mixture of two or more thereof. The normal paraffin content of the feed stock oil is preferably 50% by mass or greater, more preferably 70% by mass or greater, even more preferably 80% by mass or greater, yet more preferably 90% by mass, even yet more preferably 95% by mass or greater and most preferably 97% by mass or greater, based on the total amount of the feed stock oil.

Examples of wax-containing starting materials include oils derived from solvent refining methods, such as raffinates, partial solvent dewaxed oils, deasphalted oils, distillates, vacuum gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing feed stock oils are also available. Specifically, there may be mentioned Paraflint 80 (hydrogenated Fischer-Tropsch wax) and Shell MDS Waxy Raffinate (hydrogenated and partially isomerized heart cut distilled synthetic wax raffinate).

Feed stock oil from solvent extraction is obtained by feeding a high boiling point petroleum fraction from atmospheric distillation to a vacuum distillation apparatus and subjecting the distillation fraction to solvent extraction. The residue from vacuum distillation may also be depitched. In solvent extraction methods, the aromatic components are dissolved in the extract phase while leaving more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrocracking apparatus, using a fuel oil hydrocracking apparatus with higher hydrocracking performance.

The first lubricating base oil component may be obtained through a step of hydrocracking/hydroisomerization of the feed stock oil so as to obtain a treated product having a urea adduct value, a kinematic viscosity at 40° C., a viscosity index and a T90-T10 satisfying the conditions specified above. The hydrocracking/hydroisomerization step is not particularly restricted so long as it satisfies the aforementioned conditions for the urea adduct value and viscosity index of the treated product. A preferred hydrocracking/hydroisomerization step according to the invention comprises:

a first step in which a normal paraffin-containing feed stock oil is subjected to hydrotreatment using a hydrocracking catalyst, a second step in which the treated product from the first step is subjected to hydrodewaxing using a hydrodewaxing catalyst, and a third step in which the treated product from the second step is subjected to hydrorefining using a hydrorefining catalyst. The treated product obtained after the third step may also be subjected to distillation or the like as necessary for separating removal of certain components.

The first lubricating base oil component obtained by the production method described above is not particularly restricted in terms of its other properties so long as the urea adduct value, 40° C. viscosity and viscosity index satisfy their respective conditions, but the first lubricating base oil component preferably also satisfies the conditions specified below.

The kinematic viscosity at 100° C. of the first lubricating base oil component is preferably not greater than 5.0 $mm^2/s$, more preferably not greater than 4.5 $mm^2/s$, even more preferably not greater than 4.3 $mm^2/s$, yet more preferably not greater than 4.2 $mm^2/s$, even yet more preferably not greater than 4.0 $mm^2/s$ and most preferably not greater than 3.9 $mm^2/s$. On the other hand, the kinematic viscosity at 100° C. is also preferably 2.0 $mm^2/s$ or greater, more preferably 3.0 $mm^2/s$ or greater, even more preferably 3.5 $mm^2/s$ or greater and most preferably 3.7 $mm^2/s$ or greater. The kinematic viscosity at 100° C. is the kinematic viscosity at 100° C. measured according to ASTM D-445. If the kinematic viscosity at 100° C. of the lubricating base oil component exceeds 5.0 $mm^2/s$, the low-temperature viscosity characteristic may be impaired and sufficient fuel efficiency may not be obtained, while if it is 2.0 $mm^2/s$ or lower, oil film formation at the lubricated sections will be inadequate, resulting in inferior lubricity and potentially large evaporation loss of the lubricating oil composition.

The pour point of the first lubricating base oil component will depend on the viscosity grade of the lubricating base oil, but it is preferably not higher than −10° C., more preferably not higher than −12.5° C., even more preferably not higher than −15° C., most preferably not higher than −17.5° C., and especially preferably not higher than −20° C. If the pour point exceeds the upper limit specified above, the low-temperature flow properties of the lubricating oil employing the lubricating base oil component may be reduced. The pour point of the first lubricating base oil component is also preferably −50° C. or higher, more preferably −40° C. or higher, even more preferably −30° C. or higher and most preferably −25° C. or higher. If the pour point is below this lower limit, the viscosity index of the entire lubricating oil employing the lubricating base oil component will be reduced, potentially impairing the fuel efficiency. The pour point for the purpose of the invention is the pour point measured according to JIS K 2269-1987.

The iodine value of the first lubricating base oil component is preferably not greater than 1, more preferably not greater than 0.5, even more preferably not greater than 0.3, yet more preferably not greater than 0.15 and most preferably not greater than 0.1. Although the value may be less than 0.01, in consideration of the fact that this does not produce any further significant corresponding effect and is uneconomical, the value is preferably 0.001 or greater, more preferably 0.01 or greater, even more preferably 0.03 or greater and most preferably 0.05 or greater. Limiting the iodine value of the lubricating base oil component to not greater than 0.5 can drastically improve the heat and oxidation stability. The "iodine value" for the purpose of the invention is the iodine value measured by the indicator titration method according to JIS K 0070, "Acid numbers, Saponification Values, Iodine Values, Hydroxyl Values And Unsaponification Values Of Chemical Products".

The sulfur content of the first lubricating base oil component is not particularly restricted but is preferably not greater than 50 ppm by mass, more preferably not greater than 10 ppm by mass, even more preferably not greater than 5 ppm by mass and most preferably not greater than 1 ppm by mass. A sulfur content of not greater than 50 ppm by mass will allow excellent heat and oxidation stability to be achieved.

The evaporation loss of the first lubricating base oil component is preferably not greater than 25% by mass, more preferably not greater than 21% by mass and even more preferably not greater than 18% by mass, as the NOACK evaporation. If the NOACK evaporation of the lubricating base oil component exceeds 25% by mass, the evaporation loss of the lubricating oil will increase, resulting in increased viscosity and the like, and this is therefore undesirable. The NOACK evaporation referred to here is the evaporation of the lubricating oil measured according to ASTM D 5800.

As regards the distillation properties of the first lubricating base oil component, the initial boiling point (IBP) is preferably 320-390° C., more preferably 330-380° C. and even more preferably 340-370° C. The 10% distillation temperature (T10) is preferably 370-430° C., more preferably 380-420° C. and even more preferably 390-410° C. The 50% running point (T50) is preferably 400-470° C., more preferably 410-460° C. and even more preferably 420-450° C. The 90% running point (T90) is preferably 430-500° C., more preferably 440-490° C. and even more preferably 450-480° C. The final boiling point (FBP) is preferably 450-520° C., more preferably 460-510° C. and even more preferably 470-500° C.

As regards the distillation properties of the first lubricating base oil component, T90-T10 is preferably 30-90° C., more preferably 40-80° C. and even more preferably 50-70° C. FBP-IBP is preferably 90-150° C., more preferably 100-140° C. and even more preferably 110-130° C. T10-IBP is preferably 10-60° C., more preferably 20-50° C. and even more preferably 30-40° C. FBP-T90 is preferably 5-60° C., more preferably 10-45° C. and even more preferably 15-35° C.

By setting IBP, T10, T50, T90, FBP, T90-T10, FBP-IBP, T10-IBP and FBP-T90 of the first lubricating base oil to within the preferred ranges specified above, it is possible to further improve the low-temperature viscosity and further reduce the evaporation loss. If the distillation ranges for T90-T10, FBP-IBP, T10-IBP and FBP-T90 are too narrow, the lubricating base oil yield will be poor resulting in low economy.

The % $C_p$ value of the first lubricating base oil is preferably 80 or greater, more preferably 82-99, even more preferably 85-98 and most preferably 90-97. If the % $C_p$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than 99, on the other hand, the additive solubility will tend to be lower.

The % $C_N$ value of the first lubricating base oil is preferably not greater than 20, more preferably not greater than 15, even more preferably 1-12 and most preferably 3-10. If the % $C_N$ value of the lubricating base oil exceeds 20, the viscosity-temperature characteristic, heat and oxidation stability and frictional properties will tend to be reduced. If the % $C_N$ is less than 1, however, the additive solubility will tend to be lower.

The % $C_A$ value of the first lubricating base oil is preferably not greater than 0.7, more preferably not greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the first lubricating base oil is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

For the first embodiment, the first lubricating base oil component may be a single lubricating base oil having a urea adduct value of not greater than 4% by mass, a kinematic viscosity at 40° C. of 14-25 $mm^2/s$ and a viscosity index or 120 or higher, or it may be a combination of two or more different ones.

The content ratio of the first lubricating base oil component is 10-99% by mass, preferably 30-95% by mass, more preferably 50-90% by mass, even more preferably 60-85% by mass and most preferably 65-80% by mass, based on the total amount of the lubricating base oil. If the content ratio is less than 10% by mass, it may not be possible to obtain the necessary low-temperature viscosity and fuel efficiency performance.

The first lubricating oil composition also comprises, as a constituent component of the lubricating base oil, a second lubricating base oil component having a kinematic viscosity at 40° C. of less than 14 $mm^2/s$.

The second lubricating base oil component is not particularly restricted so long as it has a kinematic viscosity at 40° C. of less than 14 $mm^2/s$, and the mineral base oil may be, for example, a solvent refined mineral oil, hydrocracked mineral oil, hydrorefined mineral oil or solvent dewaxed base oil having a kinematic viscosity at 40° C. of less than 14 $mm^2/s$.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, which have kinematic viscosities at 40° C. of less than 14 $mm^2/s$, among which poly-α-olefins are preferred. Typical poly-α-olefins include C2-32 and preferably C6-16 α-olefin oligomers or co-oligomers (1-octene oligomer, decene oligomer, ethylene-propylene co-oligomers and the like), and their hydrides.

The second lubricating base oil component used for the first embodiment is most preferably a lubricating base oil satisfying the following conditions.

The kinematic viscosity at 40° C. of the second lubricating base oil component must be not greater than 14 $mm^2/s$, and it is preferably not greater than 13 $mm^2/s$, more preferably not greater than 12 $mm^2/s$, even more preferably not greater than 11 $mm^2/s$ and most preferably not greater than 10 $mm^2/s$. On the other hand, the kinematic viscosity at 40° C. is also preferably 5 $mm^2/s$ or greater, more preferably 7 $mm^2/s$ or greater, even more preferably 8 $mm^2/s$ or greater and most preferably 9 $mm^2/s$ or greater. If the kinematic viscosity at 40° C. is less than 5 $mm^2/s$, problems in terms of oil film retention and evaporation may occur at lubricated sections, which is undesirable. If the kinematic viscosity at 40° C. is greater than 14 $mm^2/s$, a combined effect with the first lubricating base oil will not be obtained.

From the viewpoint of the viscosity-temperature characteristic, the viscosity index of the second lubricating base oil component is preferably 80 or higher, more preferably 100 or higher, even more preferably 110 or higher, yet more preferably 120 or higher and most preferably 128 or higher, and also preferably not higher than 150, more preferably not higher than 140 and even more preferably not higher than 135. If the viscosity index is less than 80 it may not be possible to obtain effective energy efficiency, and this is undesirable. A viscosity index of not higher than 150 will allow a composition with an excellent low-temperature characteristic to be obtained.

The kinematic viscosity at 100° C. of the second lubricating base oil component is also preferably not greater than 3.5 $mm^2/s$, more preferably not greater than 3.3 $mm^2/s$, even more preferably not greater than 3.1 $mm^2/s$, yet more preferably not greater than 3.0 $mm^2/s$, even yet more preferably not greater than 2.9 $mm^2/s$ and most preferably not greater than 2.8 $mm^2/s$. The kinematic viscosity at 40° C., on the other hand, is preferably 2 $mm^2/s$ or greater, more preferably 2.3 $mm^2/s$ or greater, even more preferably 2.4 $mm^2/s$ or greater and most preferably 2.5 $mm^2/s$ or greater. A kinematic viscosity at 100° C. of lower than 2 $mm^2/s$ for the lubricating base oil is not preferred from the standpoint of evaporation loss. If the kinematic viscosity at 100° C. is greater than 3.5 $mm^2/s$, the improving effect on the low-temperature viscosity characteristic will be minimal.

From the viewpoint of improving the low-temperature viscosity characteristic without impairing the viscosity-temperature characteristic, the urea adduct value of the second lubricating base oil component is preferably not greater than 4% by mass, more preferably not greater than 3.5% by mass, even more preferably not greater than 3% by mass and most preferably not greater than 2.5% by mass. The urea adduct value of the second lubricating base oil component may even be 0% by mass, but from the viewpoint of obtaining a lubricating base oil with a sufficient low-temperature viscosity characteristic, high viscosity index and high flash point, and also of relaxing the isomerization conditions and improving economy, it is preferably 0.1% by mass or greater, more preferably 0.5% by mass or greater and most preferably 1.0% by mass or greater.

The % $C_p$ value of the second lubricating base oil component is preferably 70 or greater, more preferably 82-99.9, even more preferably 85-98 and most preferably 90-97. If the % $C_p$ value of the second lubricating base oil component is less than 70, the viscosity-temperature characteristic, heat and oxidation stability and frictional properties will tend to be reduced, while the efficacy of additives when added to the lubricating base oil will also tend to be reduced. If the % $C_p$ value of the second lubricating base oil component is greater than 99, on the other hand, the additive solubility will tend to be lower.

The % $C_N$ value of the second lubricating base oil component is preferably not greater than 30, more preferably 1-15 and even more preferably 3-10. If the % $C_N$ value of the second lubricating base oil component exceeds 30, the viscosity-temperature characteristic, heat and oxidation stability and frictional properties will tend to be reduced. If the % $C_N$ is less than 1, however, the additive solubility will tend to be lower.

The % $C_A$ value of the second lubricating base oil component is preferably not greater than 0.7, more preferably not greater than 0.6 and even more preferably 0.1-0.5. If the % $C_A$ value of the second lubricating base oil component exceeds 0.7, the viscosity-temperature characteristic, heat and oxidation stability and frictional properties will tend to be reduced. The % $C_A$ value of the second lubricating base oil component may be zero, but the solubility of additives can be further increased with a % $C_A$ value of 0.1 or greater.

The ratio of the % $C_P$ and % $C_N$ values for the second lubricating base oil component is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The iodine value of the second lubricating base oil component is not particularly restricted, but is preferably not greater than 6, more preferably not greater than 1, even more preferably not greater than 0.5, yet more preferably not greater than 0.3 and most preferably not greater than 0.15, and although it may be less than 0.01, it is preferably 0.001 or greater and more preferably 0.05 or greater in consideration of achieving a commensurate effect, and in terms of economy. Limiting the iodine value of the lubricating base oil component to not greater than 6 and especially not greater than 1 can drastically improve the heat and oxidation stability.

From the viewpoint of further improving the heat and oxidation stability and reducing sulfur, the sulfur content in the second lubricating base oil component is preferably not greater than 10 ppm by mass, more preferably not greater than 5 ppm by mass and even more preferably not greater than 3 ppm by mass.

From the viewpoint of cost reduction it is preferred to use slack wax or the like as the starting material, in which case the sulfur content of the obtained second lubricating base oil component is preferably not greater than 50 ppm by mass and more preferably not greater than 10 ppm by mass.

The nitrogen content in the second lubricating base oil component is not particularly restricted, but is preferably not greater than 5 ppm by mass, more preferably not greater than 3 ppm by mass and even more preferably not greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The pour point of the second lubricating base oil component is preferably not higher than −25° C., more preferably not higher than −27.5° C. and even more preferably not higher than −30° C. If the pour point exceeds the upper limit specified above, the low-temperature flow property of the lubricating oil composition as a whole will tend to be reduced.

The distillation property of the second lubricating base oil component is preferably as follows in gas chromatography distillation.

The initial boiling point (IBP) of the second lubricating base oil component is preferably 285-325° C., more preferably 290-320° C. and even more preferably 295-315° C. The 10% distillation temperature (T10) is preferably 320-380° C., more preferably 330-370° C. and even more preferably 340-360° C. The 50% running point (T50) is preferably 375-415° C., more preferably 380-410° C. and even more preferably 385-405° C. The 90% running point (T90) is preferably 370-440° C., more preferably 380-430° C. and even more preferably 390-420° C. The final boiling point (FBP) is preferably 390-450° C., more preferably 400-440° C. and even more preferably 410-430° C. T90-T10 is preferably 25-85° C., more preferably 35-75° C. and even more preferably 45-65° C. FBP-IBP is preferably 70-150° C., more preferably 90-130° C. and even more preferably 90-120° C. T10-IBP is preferably 10-70° C., more preferably 20-60° C. and even more preferably 30-50° C. FBP-T90 is preferably 5-50° C., more preferably 10-45° C. and even more preferably 15-40° C.

By setting IBP, T10, T50, T90, FBP, T90-T10, FBP-IBP, T10-IBP and FBP-T90 of the second lubricating base oil component to within the preferred ranges specified above, it is possible to further improve the low-temperature viscosity and further reduce the evaporation loss. If the distillation ranges for T90-T10, FBP-IBP, T10-IBP and FBP-T90 are too narrow, the lubricating base oil yield will be poor resulting in low economy.

The content of the second lubricating base oil component in the first lubricating oil composition is 1% by mass-50% by mass, preferably 10-48% by mass, more preferably 12-45% by mass, even more preferably 15-40% by mass and most preferably 18-36% by mass, based on the total amount of the lubricating base oil. If the content ratio is less than 1% by mass it may not be possible to obtain the necessary low-temperature viscosity and fuel efficiency performance, while if it exceeds 50% by mass the evaporation loss of the lubricating oil will increase resulting in increased viscosity and the like, and this is therefore undesirable.

The lubricating base oil in the first lubricating oil composition may consist entirely of the first lubricating base oil component and second lubricating base oil component, but it may also comprise lubricating base oil components other than the first lubricating base oil component and second lubricating base oil component, and so long as the contents of the first lubricating base oil component and second lubricating base oil component are within the ranges specified above.

As regards the distillation properties of the lubricating base oil comprising the first lubricating base oil component and second lubricating base oil component, the initial boiling point is preferably not higher than 370° C., more preferably not higher than 350° C., even more preferably not higher than 340° C. and most preferably not higher than 330° C., and preferably 260° C. or higher, more preferably 280° C. or higher and even more preferably 300° C. or higher. The 10% distillation temperature of the lubricating base oil is preferably not higher than 400° C., more preferably not higher than 390° C. and even more preferably not higher than 380° C., and preferably 320° C. or higher, more preferably 340° C. or higher and even more preferably 360° C. or higher. The 90% distillation temperature of the lubricating base oil is preferably 430° C. or higher, more preferably 435° C. or higher and even more preferably 440° C. or higher, and preferably not higher than 480° C., more preferably not higher than 470° C. and even more preferably not higher than 460° C. The final boiling point (FBP) of the lubricating base oil is preferably 440-520° C., more preferably 460-500° C. and even more preferably 470-490° C. Also, the difference between the 90% distillation temperature and 10% distillation temperature of the lubricating base oil is 50° C. or higher, more preferably 60° C. or higher, even more preferably 70° C. or higher and most preferably 75° C. or higher, and preferably not higher than 100° C., more preferably not higher than 90° C. and even more preferably not higher than 85° C. FBP-IBP for the lubricating base oil is preferably 135-200° C., more preferably 140-180° C. and even more preferably 150-170° C. T10-IBP is preferably 20-100° C., more preferably 40-90° C. and even more preferably 50-80° C. FBP-T90 is preferably 5-50° C., more preferably 10-40° C. and even more preferably 15-35° C. By setting IBP, T10, T50, T90, FBP, T90-T10, FBP-IBP, T10-IBP and FBP-T90 of the lubricating base oil to within the preferred ranges specified above, it is possible to further improve the low-temperature viscosity and further reduce the evaporation loss.

The kinematic viscosity at 40° C. of the lubricating base oil is preferably not greater than 20 $mm^2/s$, more preferably not greater than 16 $mm^2/s$, even more preferably not greater than 15 $mm^2/s$, even more preferably not greater than 14 $mm^2/s$, and preferably 8 $mm^2/s$ or greater, more preferably 10 $mm^2/s$ or greater, even more preferably 12 $mm^2/s$ or greater. Also, the kinematic viscosity at 100° C. of the lubricating base oil is preferably not greater than 4.5 $mm^2/s$, more preferably not greater than 3.8 $mm^2/s$, even more preferably not greater than 3.7 $mm^2/s$ and even more preferably not greater than 3.6 $mm^2/s$, and preferably 2.3 $mm^2/s$ or greater, more preferably 2.8 $mm^2/s$ or greater and even more preferably 3.3 $mm^2/s$ or greater. If the kinematic viscosity of the lubricating base oil is within the ranges specified above, it will be possible to obtain a base oil with a more excellent balance between evaporation loss and low-temperature viscosity characteristic.

The viscosity index of the lubricating base oil is preferably 100 or higher, more preferably 120 or higher, even more preferably 130 or higher and most preferably 135 or higher, and preferably not higher than 170, more preferably not higher than 150 and even more preferably not higher than 140. If the viscosity index is within this range it will be possible to obtain a base oil with an excellent viscosity-temperature characteristic, while a lubricating oil composition with a particularly high viscosity index and a notably superior low-temperature viscosity characteristic can be obtained.

In order to obtain a lubricating oil composition with an excellent balance between the low-temperature viscosity characteristic and evaporation loss, the NOACK evaporation of the lubricating base oil is preferably 10% by mass or greater, more preferably 16% by mass or greater, even more preferably 18% by mass or greater, even more preferably 20% by mass or greater and most preferably 21% by mass or greater, and preferably not greater than 30% by mass, more preferably not greater than 25% by mass and most preferably not greater than 23% by mass. In particular, by limiting the NOACK evaporation of the lubricating base oil to 21-23% by mass and adding the viscosity index improver and other lubricating oil additives at 10% by mass or greater, it is possible to obtain a lubricating oil composition with an excellent balance between low-temperature viscosity characteristic and evaporation loss, a high viscosity index, a lower HTHS viscosity at 100° C., and excellent fuel efficiency.

The lubricating base oil has a ratio of the kinematic viscosity at 100° C. (kv100) to T10 (kv100/T10, units: $mm^2s^{-1}/°$ C.) of preferably 0.007-0.015 and more preferably 0.008-0.0095. Also, the lubricating base oil has a ratio of the kinematic viscosity at 100° C. (kv100) to T50 (kv100/T50, units: $mm^2s^{-1}/°$ C.) of preferably 0.006-0.009 and more preferably 0.007-0.0085. If kv100/T10 or kv100/T50 is below the aforementioned lower limits the lubricating base oil yield will tend to be reduced, while it is also undesirable in terms of economy, and if it exceeds the aforementioned upper limits the evaporation properties of the lubricating oil composition will tend to increase relative to the obtained viscosity index.

The urea adduct value, the % $C_P$, % $C_A$, % $C_N$ and % $C_P$/% $C_N$ values and the sulfur and nitrogen contents of the lubricating base oil are determined by their values in the first lubricating base oil component and second lubricating base oil component or other addable lubricating base oil components, as well as on their content ratios, but they are preferably within the preferred ranges for the first lubricating base oil component and second lubricating base oil component.

The first lubricating oil composition further comprises a viscosity index improver. The viscosity index improver in the first lubricating oil composition is not particularly restricted, and a known viscosity index improver may be used such as a poly(meth)acrylate-based viscosity index improver, an olefin copolymer-based viscosity index improver or a styrene-diene copolymer-based viscosity index improver, which may be non-dispersed or dispersed types, with non-dispersed types being preferred. Poly(meth)acrylate-based viscosity index improvers are preferred and non-dispersed poly(meth)acrylate-based viscosity index improvers are more preferred among these, to more easily obtain a lubricating oil composition having a high viscosity index-improving effect, and an excellent viscosity-temperature characteristic and low-temperature viscosity characteristic.

The PSSI (Permanent Shear Stability Index) of the poly(meth)acrylate-based viscosity index improver in the first lubricating oil composition is preferably not greater than 40, more preferably 5-40, even more preferably 10-35, yet more preferably 15-30 and most preferably 20-25. If the PSSI exceeds 40, the shear stability may be impaired. If the PSSI is less than 5, not only will the viscosity index-improving effect will be low and the fuel efficiency and low-temperature viscosity characteristic inferior, but cost may also increase.

The weight-average molecular weight ($M_W$) of the poly(meth)acrylate-based viscosity index improver is preferably 5,000 or greater, more preferably 50,000 or greater, even more preferably 100,000 or greater, yet more preferably 200,000 or greater and most preferably 300,000 or greater. It is also preferably not greater than 1,000,000, more preferably not greater than 700,000, even more preferably not greater than 600,000 and most preferably not greater than 500,000. If the weight-average molecular weight is less than 5,000, the effect of improving the viscosity index will be minimal, not only resulting in inferior fuel efficiency and low-temperature viscosity characteristics but also potentially increasing cost, while if the weight-average molecular weight is greater than 1,000,000 the shear stability, solubility in the base oil and storage stability may be impaired.

The ratio of the weight-average molecular weight and number-average molecular weight of the poly(meth)acrylate-based viscosity index improver ($M_W/M_n$) is preferably 0.5-5.0, more preferably 1.0-3.5, even more preferably 1.5-3 and most preferably 1.7-2.5. If the ratio of the weight-average molecular weight and number-average molecular weight is less than 0.5 or greater than 5.0, not only will the solubility in the base oil and the storage stability be impaired, but potentially the viscosity-temperature characteristic will be reduced and the fuel efficiency lowered.

The weight-average molecular weight and number-average molecular weight referred to here are the weight-average molecular weight and number-average molecular weight based on polystyrene, as measured using a 150-CALC/GPC by Japan Waters Co., equipped with two GMHHR-M (7.8 mmID×30 cm) columns by Tosoh Corp. in series, with tetrahydrofuran as the solvent, a temperature of 23° C., a flow rate of 1 mL/min, a sample concentration of 1% by mass, a sample injection rate of 75 μL and a differential refractometer (RI) as the detector.

The ratio of the weight-average molecular weight and the PSSI of the poly(meth)acrylate-based viscosity index improver ($M_W$/PSSI) is not particularly restricted, but it is preferably $1\times10^4$ or greater, more preferably $1.2\times10^4$ or greater, even more preferably $1.4\times10^4$ or greater, yet more preferably $1.5\times10^4$ or greater, even yet more preferably $1.7\times10^4$ or greater and most preferably $1.9\times10^4$ or greater, and preferably not greater than $4\times10^4$. By using a viscosity index improver with an $M_W$/PSSI ratio of $1\times10^4$ or greater, it is possible to obtain a composition with an excellent low-temperature viscosity characteristic, and a further reduced HTHS viscosity at 100° C., and therefore especially superior fuel efficiency.

The structure of the poly(meth)acrylate-based viscosity index improver is not particularly restricted so long as it is one as described above, and a poly(meth)acrylate-based viscosity index improver obtained by polymerization of one or more monomers selected from among those represented by formulas (1)-(4) below may be used.

Of these, the poly(meth)acrylate-based viscosity index improver is more preferably one comprising 0.5-70% by mole of one or more (meth)acrylate structural units represented by the following formula (1).

[Chemical Formula 1]

(1)

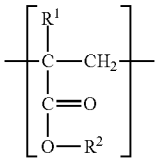

[In formula (1), $R^1$ represents hydrogen or a methyl group and $R^2$ represents a C16 or greater straight-chain or branched hydrocarbon group.]

$R^2$ in the structural unit represented by formula (1) is a C16 or greater straight-chain or branched hydrocarbon group, as mentioned above, and is preferably a C18 or greater straight-chain or branched hydrocarbon, more preferably a C20 or greater straight-chain or branched hydrocarbon and even more preferably a C20 or greater branched hydrocarbon group. There is no particular upper limit on the hydrocarbon group represented by $R^2$, but it is preferably not greater than a C500 straight-chain or branched hydrocarbon group. It is more preferably a C50 or lower straight-chain or branched hydrocarbon, even more preferably a C30 or lower straight-chain or branched hydrocarbon, yet more preferably a C30 or lower branched hydrocarbon and most preferably a C25 or lower branched hydrocarbon.

The proportion of (meth)acrylate structural units represented by formula (1) in the polymer for the poly(meth)acrylate-based viscosity index improver of the first embodiment is 0.5-70% by mole as mentioned above, but it is preferably not greater than 60% by mole, more preferably not greater than 50% by mole, even more preferably not greater than 40% by mole and most preferably not greater than 30% by mole. It is also preferably 1% by mole or greater, more preferably 3% by mole or greater, even more preferably 5% by mole or greater and most preferably 10% by mole or greater. At greater than 70% by mole the viscosity-temperature characteristic-improving effect and the low-temperature viscosity characteristic may be impaired, and at below 0.5% by mole the viscosity-temperature characteristic-improving effect may be impaired.

The poly(meth)acrylate-based viscosity index improver of the first embodiment may be obtained by copolymerization of any (meth)acrylate structural unit, or any olefin or the like, in addition to a (meth)acrylate structural unit represented by formula (1).

Any monomer may be combined with the (meth)acrylate structural unit represented by formula (1), but such a monomer is preferably one represented by the following formula (2) (hereunder, "monomer (M-1)"). The copolymer with monomer (M-1) is a non-dispersed poly(meth)acrylate-based viscosity index improver.

[Chemical Formula 2]

(2)

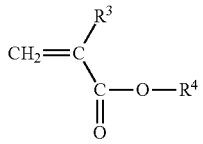

[In formula (2), $R^3$ represents hydrogen or methyl and $R^4$ represents a C1-15 straight-chain or branched hydrocarbon group.]

As other monomers to be combined with the (meth)acrylate structural unit represented by formula (1) there are preferred one or more selected from among monomers represented by the following formula (3) (hereunder, "monomer (M-2)") and monomers represented by the following formula (4) (hereunder, "monomer (M-3)"). The copolymer with monomer (M-3) and/or (M-4) is a dispersed poly(meth)acrylate-based viscosity index improver. The dispersed poly(meth)acrylate-based viscosity index improver may further comprise monomer (M-1) as a constituent monomer.

[Chemical Formula 3]

(3)

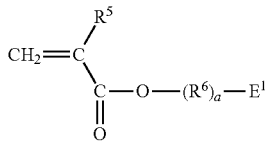

[In general formula (3), $R^5$ represents hydrogen or methyl, $R^6$ represents a C1-18 alkylene group, $E^1$ represents an amine residue or heterocyclic residue containing 1-2 nitrogen atoms and 0-2 oxygen atoms, and a is 0 or 1.]

Specific examples of C1-18 alkylene groups represented by $R^6$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene (which alkylene groups may be straight-chain or branched).

Specific examples of groups represented by $E^1$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

[Chemical Formula 4]

(4)

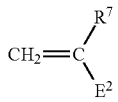

[In general formula (4), $R^7$ represents hydrogen or methyl and $E^2$ represents an amine residue or heterocyclic residue containing 1-2 nitrogen atoms and 0-2 oxygen atoms.]

Specific examples of groups represented by $E^2$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

Specific preferred examples for monomers (M-2) and (M-3) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures of the foregoing.

The copolymerization molar ratio of the copolymer of the (meth)acrylate structural unit represented by formula (1) and monomer (M-1)-(M-3) is not particularly restricted, but it is preferably such that the (meth)acrylate structural unit represented by formula (1):monomer (M-1)-(M-3)=0.5:99.5-70:30, more preferably 5:90-50:50 and even more preferably 20:80-40:60.

Any production process may be employed for the poly (meth)acrylate-based viscosity index improver, and for example, it can be easily obtained by radical solution polymerization of a (meth)acrylate structural unit represented by formula (1) and monomers (M-1)-(M-3) in the presence of a polymerization initiator such as benzoyl peroxide.

The viscosity index improver content of the first lubricating oil composition is preferably 0.1-50% by mass, more preferably 0.5-40% by mass, even more preferably 1-30% by mass and most preferably 5-20% by mass, based on the total amount of the composition. If the viscosity index improver content is less than 0.1% by mass, the viscosity index improving effect or product viscosity reducing effect will be minimal, potentially preventing improvement in fuel efficiency. A content of greater than 50% by mass will drastically increase production cost while requiring reduced base oil viscosity, and can thus risk lowering the lubricating performance under harsh lubrication conditions (high-temperature, high-shear conditions), as well as causing problems such as wear, seizing and fatigue fracture.

The first lubricating oil composition is obtained by mixing the first lubricating base oil component, second lubricating base oil component and viscosity index improver so that the first lubricating base oil component content is 10-99% by mass and the second lubricating base oil component content is 1-50% by mass, based on the total amount of the lubricating base oil, and so that the lubricating oil composition has a kinematic viscosity at 100° C. of 4-12 $mm^2/s$ and a viscosity index of 200-350. The viscosity index improver may be mixed first with either the first lubricating base oil component or second lubricating base oil component and then mixed with the other, or a mixed base oil comprising the first lubricating base oil component and second lubricating base oil component may be mixed with the viscosity index improver.

The first lubricating oil composition may further contain, in addition to the viscosity index improver, also common non-dispersed or dispersed poly(meth)acrylates, non-dispersed or dispersed ethylene-α-olefin copolymers or their hydrides, polyisobutylene or its hydride, styrene-diene hydrogenated copolymers, styrene-maleic anhydride ester copolymers and polyalkylstyrenes.

The first lubricating oil composition may further contain any additives commonly used in lubricating oils, for the purpose of enhancing performance. Examples of such additives include additives such as friction modifiers, metal-based detergents, ashless dispersants, antioxidants, anti-wear agents (or extreme-pressure agents), corrosion inhibitors, rust-preventive agents, pour point depressants, demulsifiers, metal deactivating agents and antifoaming agents.

For example, the first lubricating oil composition may also contain at least one friction modifier selected from among organic molybdenum compounds and ashless friction modifiers, in order to increase the fuel efficiency performance.

Organic molybdenum compounds include sulfur-containing organic molybdenum compounds such as molybdenum dithiophosphates and molybdenum dithiocarbamates.

As examples of preferred molybdenum dithiocarbamates there may be mentioned, specifically, molybdenum sulfide-diethyl dithiocarbamate, molybdenum sulfide-dipropyl dithiocarbamate, molybdenum sulfide-dibutyl dithiocarbamate, molybdenum sulfide-dipentyl dithiocarbamate, molybdenum sulfide-dihexyl dithiocarbamate, molybdenum sulfide-dioctyl dithiocarbamate, molybdenum sulfide-didecyl dithiocarbamate, molybdenum sulfide-didodecyl dithiocarbamate, molybdenum sulfide-di(butylphenyl)dithiocarbamate, molybdenum sulfide-di(nonylphenyl)dithiocarbamate, oxymolybdenum sulfide-diethyl dithiocarbamate, oxymolybdenum sulfide-dipropyl dithiocarbamate, oxymolybdenum sulfide-dibutyl dithiocarbamate, oxymolybdenum sulfide-dipentyl dithiocarbamate, oxymolybdenum sulfide-dihexyl dithiocarbamate, oxymolybdenum sulfide-dioctyl dithiocarbamate, oxymolybdenum sulfide-didecyl dithiocarbamate, oxymolybdenum sulfide-didodecyl dithiocarbamate, oxymolybdenum sulfide-di(butylphenyl)dithiocarbamate, oxymolybdenum sulfide-di(nonylphenyl)dithiocarbamate (where the alkyl groups may be linear or branched, and the alkyl groups may be bonded at any position of the alkylphenyl groups), as well as mixtures of the foregoing. Also preferred as molybdenum dithiocarbamates are compounds with different numbers of carbon atoms and/or structural hydrocarbon groups in the molecule.

As other sulfur-containing organic molybdenum compounds there may be mentioned complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, halogenated molybdenums such as molybdenum chloride, and the like), with sulfur-containing organic compounds (for example, alkyl (thio)xanthates, thiadiazoles, mercaptothiadiazoles, thiocarbonates, tetrahydrocarby lthiuram disulfide, bis(di(thio)hydrocarbyldithio phosphonate) disulfide, organic (poly)sulfides, sulfurized esters and the like), or other organic compounds, or complexes of sulfur-containing molybdenum compounds such as molybdenum sulfide and molybdic sulfide with alkenylsucciniimides.

The organic molybdenum compound used may be an organic molybdenum compound containing no sulfur as a constituent element.

As organic molybdenum compounds containing no sulfur as a constituent element there may be mentioned, specifically, molybdenum-amine complexes, molybdenum-succiniimide complexes, organic acid molybdenum salts, alcohol molybdenum salts and the like, among which molybdenum-amine complexes, organic acid molybdenum salts and alcohol molybdenum salts are preferred.

When an organic molybdenum compound is used in the first lubricating oil composition, its content is not particularly restricted but is preferably 0.001% by mass or greater, more preferably 0.005% by mass or greater and even more preferably 0.01% by mass or greater, and preferably not greater than 0.2% by mass, more preferably not greater than 0.15% by mass, even more preferably not greater than 0.10% by mass and most preferably not greater than 0.08% by mass, in terms of molybdenum element, based on the total amount of the composition. If the content is less than 0.001% by mass the heat and oxidation stability of the lubricating oil composition will be insufficient, and in particular it may not be possible to maintain superior cleanability for prolonged periods. On the other hand, if the content is greater than 0.2% by mass the effect will not be commensurate with the increased amount, and the storage stability of the lubricating oil composition will tend to be reduced.

The ashless friction modifier used in the first lubricating oil composition may be any compound ordinarily used as a friction modifier for lubricating oils, and examples include ashless friction modifiers that are amine compounds, ester compounds, amide compounds, imide compounds, ether compounds, urea compounds, hydrazide compounds, fatty acid esters, fatty acid amides, fatty acids, aliphatic alcohols, aliphatic ethers and the like having one or more C6-30 alkyl or alkenyl and especially C6-30 straight-chain alkyl or straight-chain alkenyl groups in the molecule.

There may also be mentioned one or more compounds selected from the group consisting of nitrogen-containing compounds represented by the following formulas (5) and (6) and their acid-modified derivatives, and the ashless friction modifiers mentioned in International Patent Publication No. WO2005/037967.

[Chemical Formula 5]

(5)

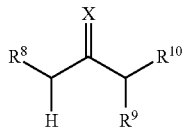

In formula (5), $R^8$ is a C1-30 hydrocarbon or functional C1-30 hydrocarbon group, preferably a C10-30 hydrocarbon or a functional C10-30 hydrocarbon, more preferably a C12-20 alkyl, alkenyl or functional hydrocarbon group and most preferably a C12-20 alkenyl group, $R^9$ and $R^{10}$ are each a C1-30 hydrocarbon or functional C1-30 hydrocarbon group or hydrogen, preferably a C1-10 hydrocarbon or functional C1-10 hydrocarbon group or hydrogen, more preferably a C1-4 hydrocarbon group or hydrogen and even more preferably hydrogen, and X is oxygen or sulfur and preferably oxygen.

[Chemical Formula 6]

(6)

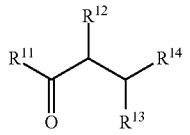

In formula (6), $R^{11}$ is a C1-30 hydrocarbon or functional C1-30 hydrocarbon group, preferably a C 10-30 hydrocarbon or a functional C10-30 hydrocarbon, more preferably a C12-20 alkyl, alkenyl or functional hydrocarbon group and most preferably a C12-20 alkenyl group, $R^{12}$, $R^{13}$ and $R^{14}$ are independently each a C1-30 hydrocarbon or functional C1-30 hydrocarbon group or hydrogen, preferably a C1-10 hydrocarbon or functional C1-10 hydrocarbon group or hydrogen, more preferably a C1-4 hydrocarbon group or hydrogen, and even more preferably hydrogen.

Nitrogen-containing compounds represented by general formula (6) include, specifically, hydrazides with C1-30 hydrocarbon or functional C1-30 hydrocarbon groups, and their derivatives. When $R^{11}$ is a C1-30 hydrocarbon or functional C1-30 hydrocarbon group and $R^{12}$-$R^{14}$ are hydrogen, they are hydrazides containing a C1-30 hydrocarbon group or functional C1-30 hydrocarbon group, and when any of $R^{11}$ and $R^{12}$-$R^{14}$ is a C1-30 hydrocarbon group or functional C1-30 hydrocarbon group and the remaining $R^{12}$-$R^{14}$ groups are hydrogen, they are N-hydrocarbyl hydrazides containing a C1-30 hydrocarbon group or functional C1-30 hydrocarbon group (hydrocarbyl being a hydrocarbon group or the like).

When an ashless friction modifier is used in the first lubricating oil composition, the ashless friction modifier content is preferably 0.01% by mass or greater, more preferably 0.05% by mass or greater and even more preferably 0.1% by mass or greater, and preferably not greater than 3% by mass, more preferably not greater than 2% by mass and even more preferably not greater than 1% by mass, based on the total amount of the composition. If the ashless friction modifier content is less than 0.01% by mass the friction reducing effect by the addition will tend to be insufficient, while if it is greater than 3% by mass, the effects of the antiwear property additives may be inhibited, or the solubility of the additives may be reduced.

Either an organic molybdenum compound or an ashless friction modifier alone may be used in the first lubricating oil composition, or both may be used together, but it is more preferred to use an ashless friction modifier, and it is most preferred to use a fatty acid ester-based ashless friction modifier such as glycerin oleate and/or a urea-based friction modifier such as oleylurea.

As metal-based detergents there may be mentioned normal salts, basic normal salts and overbased salts such as alkali metal sulfonates or alkaline earth metal sulfonates, alkali metal phenates or alkaline earth metal phenates, and alkali metal salicylates or alkaline earth metal salicylates. According to the invention, it is preferred to use one or more alkali metal or alkaline earth metal-based detergents selected from the group consisting of those mentioned above, and especially an alkaline earth metal-based detergent. Particularly preferred are magnesium salts and/or calcium salts, with calcium salts being more preferred. Metal-based detergents are generally marketed or otherwise available in forms diluted with light lubricating base oils, and for most purposes the metal content will be 1.0-20% by mass and preferably 2.0-16% by mass. The alkaline earth metallic cleaning agent used for the invention may have any total base number, but for most purposes the total base number is not greater than 500 mgKOH/g and preferably 150-450 mgKOH/g. The total base number referred to here is the total base number determined by the perchloric acid method, as measured according to JIS K2501 (1992): "Petroleum Product And Lubricating Oils—Neutralization Value Test Method", Section 7.

As ashless dispersants there may be used any ashless dispersants used in lubricating oils, examples of which include mono- or bis-succiniimides with at least one C40-400 straight-chain or branched alkyl group or alkenyl group in the molecule, benzylamines with at least one C40-400 alkyl group or alkenyl group in the molecule, polyamines with at least one C40-400 alkyl group or alkenyl group in the molecule, and modified forms of the foregoing with boron compounds, carboxylic acids, phosphoric acids and the like. One or more selected from among any of the above may be added for use.

As antioxidants there may be mentioned phenol-based and amine-based ashless antioxidants, and copper-based or molybdenum-based metal antioxidants. Specific examples include phenol-based ashless antioxidants such as 4,4'-methylenebis(2,6-di-tert-butylphenol) and 4,4'-bis(2,6-di-tert-butylphenol), and amine-based ashless antioxidants such as phenyl-α-naphthylamine, alkyl-phenyl-α-naphthylamine and dialkyldiphenylamine.

As anti-wear agents (or extreme-pressure agents) there may be used any anti-wear agents and extreme-pressure agents that are utilized in lubricating oils. For example, sulfur-based, phosphorus-based and sulfur/phosphorus-based extreme-pressure agents may be used, specific examples of which include phosphorous acid esters, thiophosphorous acid esters, dithiophosphorous acid esters, trithiophosphorous acid esters, phosphoric acid esters, thiophosphoric acid esters, dithiophosphoric acid esters and trithiophosphoric acid esters, as well as their amine salts, metal salts and derivatives, dithiocarbamates, zinc dithiocarbamate, molybdenum dithiocarbamate, disulfides, polysulfides, olefin sulfides, sulfurized fats and oils, and the like. Sulfur-based extreme-pressure agents, and especially sulfurized fats and oils, are preferably added.

Examples of corrosion inhibitors include benzotriazole-based, tolyltriazole-based, thiadiazole-based and imidazole-based compounds.

Examples of rust-preventive agents include petroleum sulfonates, alkylbenzene sulfonates, dinonylnaphthalene sulfonates, alkenylsuccinic acid esters and polyhydric alcohol esters.

Examples of pour point depressants that may be used include polymethacrylate-based polymers suitable for the lubricating base oil used.

As examples of demulsifiers there may be mentioned polyalkylene glycol-based nonionic surfactants such as polyoxyethylenealkyl ethers, polyoxyethylenealkylphenyl ethers and polyoxyethylenealkylnaphthyl ethers.

Examples of metal deactivating agents include imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

As examples of antifoaming agents there may be mentioned silicone oils, alkenylsuccinic acid derivatives, polyhydroxyaliphatic alcohol and long-chain fatty acid esters, methyl salicylate and o-hydroxybenzyl alcohols, which have 25° C. kinematic viscosities of 0.1-100 $mm^2/s$.

When such additives are added to the first lubricating oil composition, their contents are 0.01-10% by mass based on the total amount of the composition.

The kinematic viscosity at 100° C. of the first lubricating oil composition must be 4-12 $mm^2/s$, and it is preferably 4.5 $mm^2/s$ or greater, more preferably 5 $mm^2/s$ or greater, even more preferably 6 $mm^2/s$ or greater and most preferably 7 $mm^2/s$ or greater. It is also preferably not greater than 11 $mm^2/s$, more preferably not greater than 10 $mm^2/s$, even more preferably not greater than 9 $mm^2/s$ and most preferably not greater than 8 $mm^2/s$. If the kinematic viscosity at 100° C. is less than 4 $mm^2/s$, insufficient lubricity may result, and if it is greater than 12 $mm^2/s$ it may not be possible to obtain the necessary low-temperature viscosity and sufficient fuel efficiency performance.

The viscosity index of the first lubricating oil composition must be in the range of 200-300, and it is preferably 210-300, more preferably 220-300, even more preferably 240-300, yet more preferably 250-300 and most preferably 260-300. If the viscosity index of the first lubricating oil composition is less than 200 it may be difficult to maintain the HTHS viscosity while improving fuel efficiency, and it may also be difficult to lower the −35° C. low-temperature viscosity. In addition, if the viscosity index of the first lubricating oil composition is greater than 300, the low-temperature flow property may be poor and problems may occur due to solubility of the additives or lack of compatibility with the sealant material.

The first lubricating oil composition preferably satisfies the following conditions, in addition to satisfying the aforementioned conditions for the kinematic viscosity at 100° C. and viscosity index.

The kinematic viscosity at 40° C. of the first lubricating oil composition is preferably 4-50 $mm^2/s$, and it is preferably not greater than 45 $mm^2/s$, more preferably not greater than 40 $mm^2/s$, even more preferably not greater than 35 $mm^2/s$, yet more preferably not greater than 30 $mm^2/s$ and most preferably not greater than 27 $mm^2/s$. On the other hand, the kinematic viscosity at 40° C. is preferably 5 $mm^2/s$ or greater, more preferably 10 $mm^2/s$ or greater, even more preferably 15 $mm^2/s$ or greater and most preferably 20 $mm^2/s$ or greater. If the kinematic viscosity at 40° C. is less than 4 $mm^2/s$, insufficient lubricity may result, and if it is greater than 50 $mm^2/s$ it may not be possible to obtain the necessary low-temperature viscosity and sufficient fuel efficiency performance.

The HTHS viscosity at 100° C. of the first lubricating oil composition is preferably not greater than 6.0 mPa·s, more preferably not greater than 5.5 mPa·s, even more preferably not greater than 5.3 mPa·s, yet more preferably not greater than 5.0 mPa·s and most preferably not greater than 4.5 mPa·s. It is also preferably 3.0 mPa·s or greater, preferably 3.5 mPa·s or greater, more preferably 3.8 mPa·s or greater, even more preferably 4.0 mPa·s or greater and most preferably 4.2 mPa·s or greater. The HTHS viscosity at 100° C. is the high-temperature high-shear viscosity at 100° C. according to ASTM D4683. If the HTHS viscosity at 100° C. is less than 3.0 mPa·s, the evaporation property may be high and insufficient lubricity may result, and if it is greater than 6.0 mPa·s it may not be possible to obtain the necessary low-temperature viscosity and sufficient fuel efficiency performance.

The HTHS viscosity at 150° C. of the first lubricating oil composition is preferably not greater than 3.5 mPa·s, more preferably not greater than 3.0 mPa·s, even more preferably not greater than 2.8 mPa·s and most preferably not greater than 2.7 mPa·s. It is also preferably 2.0 mPa·s or greater, preferably 2.3 mPa·s or greater, more preferably 2.4 mPa·s or greater, even more preferably 2.5 mPa·s or greater and most preferably 2.6 mPa·s or greater. The HTHS viscosity at 150° C. referred to here is the high-temperature high-shear viscosity at 150° C., specified by ASTM ASTM D4683. If the HTHS viscosity at 150° C. is less than 2.0 mPa·s, the evaporation property may be high and insufficient lubricity may result, and if it is greater than 3.5 mPa·s it may not be possible to obtain the necessary low-temperature viscosity and sufficient fuel efficiency performance.

Also, the ratio of the HTHS viscosity at 100° C. with respect to the HTHS viscosity at 150° C. in the first lubricating oil composition preferably satisfies the condition represented by the following inequality (A).

$$HTHS(100°\ C.)/HTHS(150°\ C.) \leq 2.04 \quad (A)$$

[In the inequality, HTHS (100° C.) represents the HTHS viscosity at 100° C. and HTHS (150° C.) represents the HTHS viscosity at 150° C.]

The HTHS (100° C.)/HTHS (150° C.) ratio is preferably not greater than 2.04 as mentioned above, and it is more preferably not greater than 2.00, even more preferably not greater than 1.98, yet more preferably not greater than 1.80 and most preferably not greater than 1.70. If HTHS (100° C.)/HTHS (150° C.) is greater than 2.04, it may not be possible to obtain sufficient fuel efficiency performance or low-temperature characteristics. Also, HTHS (100° C.)/HTHS (150° C.) is preferably 0.50 or greater, more preferably 0.70 or greater, even more preferably 1.00 or greater and most preferably 1.30 or greater. If HTHS (100° C.)/HTHS (150° C.) is less than 0.50, the cost of the base stock may be drastically increased and solubility of the additives may not be achieved.

The first lubricating oil composition, having such a construction, is superior in terms of fuel efficiency, low evaporation property and low-temperature viscosity characteristic, and can exhibit fuel efficiency and both NOACK evaporation and low-temperature viscosity at −35° C. and below while maintaining HTHS viscosity at 150° C., even without using a synthetic oil such as a poly-α-olefinic base oil or esteric base oil, or a low-viscosity mineral base oil, and in particular it can reduce the kinematic viscosity at 40° C. and 100° C. and the HTHS viscosity at 100° C., while also notably improving the CCS viscosity at −35° C. (MRV viscosity at −40° C.), of the lubricating oil. For example, with the first lubricating oil composition it is possible to obtain a CCS viscosity at −35° C. of not greater than 2500 mPa·s, and especially not greater than 2300 mPa·s. Also, with the first lubricating oil composition it is possible to obtain a MRV viscosity at −40° C. of not greater than 8000 mPa·s, and especially not greater than 6000 mPa·s.

There are no particular restrictions on the use of the first lubricating oil composition, and it may be suitably used as a fuel efficient engine oil, fuel efficient gasoline engine oil or fuel efficient diesel engine oil.

[Second Embodiment: Second Lubricating Oil Composition and Second Production Method]

The second lubricating oil composition comprises a lubricating base oil having a viscosity index of 100 or higher, an initial boiling point of not higher than 400° C., a 90% distillation temperature of 470° C. or higher and a difference between the 90% distillation temperature and a 10% distillation temperature of at least a 70° C., (A) an ashless antioxidant containing no sulfur as a constituent element, and (B) at least one compound selected from among ashless antioxidants containing sulfur as a constituent element and organic molybdenum compounds. Also, the lubricating base oil comprises a first lubricating base oil component having a urea adduct value of not greater than 4% by mass, a viscosity index of 100 or higher and a kinematic viscosity at 100° C. of at least 3.5 $mm^2/s$ and less than 4.5 $mm^2/s$, and a second lubricating base oil component having a urea adduct value of not greater than 4% by mass, a viscosity index of 120 or higher, and a kinematic viscosity at 100° C. of 4.5-20 $mm^2/s$.

Also, from the viewpoint of improving the low-temperature viscosity characteristic without impairing the viscosity-temperature characteristic, the urea adduct values of the first and second lubricating base oil components must each be not greater than 4% by mass, but they are preferably not greater than 3.5% by mass, more preferably not greater than 3% by mass and even more preferably not greater than 2.5% by mass. The urea adduct values of the first and second lubricating base oil components may even be 0% by mass. However, they are preferably 0.1% by mass or greater, more preferably 0.5% by mass or greater and most preferably 0.8% by mass or greater, from the viewpoint of obtaining a lubricating base oil with a sufficient low-temperature viscosity characteristic and a higher viscosity index, and also of relaxing the dewaxing conditions for increased economy. There are no particular restrictions on the urea adduct values of the lubricating base oil comprising the first and second lubricating base oil components (hereinafter referred to as "lubricating base oil of the second embodiment"), but the urea adduct value of the lubricating base oil also preferably satisfies the conditions specified above.

From the viewpoint of improving the viscosity-temperature characteristic, the viscosity indexes of the first and second lubricating base oil components and of the lubricating base oil of the lubricating base oil of the second embodiment must be 100 or higher as mentioned above, but they are preferably 110 or greater, more preferably 120 or greater, even more preferably 130 or greater and most preferably 140 or greater, and preferably not greater than 170 and more preferably not greater than 160.

From the viewpoint of improving the viscosity-temperature characteristic, the viscosity indexes of the first and second lubricating base oil components and of the lubricating base oil of the second embodiment must be 100 or higher as mentioned above, but they are preferably 110 or greater, more preferably 120 or greater, even more preferably 130 or greater and most preferably 140 or greater, and preferably not greater than 170 and more preferably not greater than 160.

The kinematic viscosity at 100° C. of the first lubricating base oil component is at least 3.5 $mm^2/s$ and less than 4.5 $mm^2/s$, and is more preferably 3.7-4.1 $mm^2/s$. Also, the kinematic viscosity at 100° C. of the second lubricating base oil component is 4.5-20 $mm^2/s$, more preferably 4.8-11 $mm^2/s$ and most preferably 5.5-8.0 $mm^2/s$.

There are no particular restrictions on the kinematic viscosity at 100° C. of the lubricating base oil of the second embodiment, but it is preferably 3.5-20 $mm^2/s$, more preferably 4.0-11 $mm^2/s$ and even more preferably 4.4-6 $mm^2/s$. A kinematic viscosity at 100° C. of lower than 3.5 $mm^2/s$ for the lubricating base oil is not preferred from the standpoint of evaporation loss. If it is attempted to obtain a lubricating base oil having a kinematic viscosity at 100° C. of greater than 20 $mm^2/s$, the yield will be reduced and it will be difficult to increase the cracking severity even when using a heavy wax as the starting material.

The kinematic viscosity at 40° C. of the first lubricating base oil component is preferably 12 $mm^2/s$ or greater and less than 28 $mm^2/s$, more preferably 13-19 $mm^2/s$ and even more preferably 14-17 $mm^2/s$. On the other hand, the kinematic viscosity at 40° C. of the second lubricating base oil component is preferably 28-230 $mm^2/s$, more preferably 29-50 $mm^2/s$, even more preferably 29.5-40 $mm^2/s$ and most preferably 30-33 $mm^2/s$. Also, the kinematic viscosity at 40° C. of the lubricating base oil of the second embodiment is preferably 6.0-80 $mm^2/s$, more preferably 8.0-50 $mm^2/s$, even more preferably 10-30 $mm^2/s$ and most preferably 15-20 $mm^2/s$.

The pour point of the first lubricating base oil component is preferably not higher than −10° C., more preferably not higher than −15° C. and even more preferably not higher than −17.5° C. The pour point of the second lubricating base oil component is preferably not higher than −10° C., more preferably not higher than −12.5° C. and even more preferably not higher than −15° C. The pour point of the lubricating base oil is preferably not higher than −10° C. and more preferably not higher than −12.5° C. If the pour point exceeds the upper limit specified above, the low-temperature flow property of the lubricating oil composition will tend to be reduced.

Also, the CCS viscosity at −35° C. of the first lubricating base oil component is preferably not greater than 3000 mPa·s, more preferably not greater than 2400 mPa·s, even more preferably not greater than 2000 mPa·s, yet more preferably not greater than 1800 mPa·s and most preferably not greater than 1600 mPa·s. The CCS viscosity at −35° C. of the second lubricating base oil component is preferably not greater than 15,000 mPa·s, more preferably not greater than 10,000 mPa·s and even more preferably not greater than 8000 mPa·s, and preferably 3000 mPa·s or greater and more preferably 3100 mPa·s or greater. The CCS viscosity at −35° C. of the lubricating base oil of the second embodiment is preferably 10,000 mPa·s and more preferably 8,000 mPa·s. If the CCS viscosity at −35° C. exceeds the upper limit specified above, the low-temperature flow property of the lubricating oil composition will tend to be lower. The CCS viscosity at −35° C. for the purpose of the invention is the viscosity measured according to JIS K 2010-1993.

The aniline points (AP (° C.)) of the first and second lubricating base oil components and of the lubricating base oil of the second embodiment are preferably greater than or equal to the value of A, i.e. AP≥A, as represented by formula (i).

$$A=4.3\times kv100+100 \quad \text{(i)}$$

[In this equation, kv100 represents the kinematic viscosity at 100° C. ($mm^2/s$) of the lubricating base oil.]

If AP<A, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

For example, the AP of the first lubricating base oil fraction is preferably 113° C. or higher and more preferably 118° C. or higher, and preferably not higher than 135° C. and more preferably not higher than 125° C. For example, the AP of the second lubricating base oil is preferably 125° C. or higher and more preferably 128° C. or higher, and preferably not higher than 140° C. and more preferably not higher than 135° C. The aniline point for the purpose of the invention is the aniline point measured according to JIS K 2256-1985.

As regards the distillation properties of the lubricating base oil of the second embodiment, the initial boiling point (IBP) is not higher than 400° C., preferably 355-395° C. and more preferably 365-385° C. Also, the 90% distillation temperature (T90) is 470° C. or higher, preferably 475-515° C. and more preferably 480-505° C. The value of T90-T5, as the difference between the 90% distillation temperature and the 5% distillation temperature, is at least 70° C., preferably 80-120° C. and more preferably 90-110° C.

As regards the distillation properties of the first lubricating base oil component, the initial boiling point (IBP) is preferably 310-400° C., more preferably 320-390° C. and even more preferably 330-380° C. The 10% distillation temperature (T10) is preferably 350-430° C., more preferably 360-420° C. and even more preferably 370-410° C. The 50% running point (T50) is preferably 390-470° C., more preferably 400-460° C. and even more preferably 410-450° C. The 90% running point (T90) is preferably 420-490° C., more preferably 430-480° C. and even more preferably 440-470° C. The final boiling point (FBP) is preferably 450-530° C., more preferably 460-520° C. and even more preferably 470-510° C. T90-T10 is preferably 40-100° C., more preferably 45-90° C. and even more preferably 50-80° C. FBP-IBP is preferably 110-170° C., more preferably 120-160° C. and even more preferably 125-150° C. T10-IBP is preferably 5-60° C., more preferably 10-55° C. and even more preferably 15-50° C. FBP-T90 is preferably 5-60° C., more preferably 10-55° C. and even more preferably 15-50° C.

As regards the distillation properties of the second lubricating base oil component, the initial boiling point (IBP) is preferably 390-460° C., more preferably 400-450° C. and even more preferably 410-440° C. The 10% distillation temperature (T10) is preferably 430-510° C., more preferably 440-500° C. and even more preferably 450-480° C. The 50% running point (T50) is preferably 460-540° C., more preferably 470-530° C. and even more preferably 480-520° C. The 90% running point (T90) is preferably 470-560° C., more preferably 480-550° C. and even more preferably 490-540° C. The final boiling point (FBP) is preferably 505-585° C., more preferably 515-565° C. and even more preferably 525-565° C. T90-T10 is preferably 35-110° C., more preferably 45-90° C. and even more preferably 55-80° C. FBP-IBP is preferably 80-150° C., more preferably 90-140° C. and even more preferably 100-130° C. T10-IBP is preferably 5-80° C., more preferably 10-70° C. and even more preferably 10-60° C. FBP-T90 is preferably 5-60° C., more preferably 10-50° C. and even more preferably 15-40° C.

By setting IBP, T10, T50, T90, FBP, T90-T10, FBP-IBP, T10-IBP and FBP-T90 of the lubricating base oil of the second embodiment and the first and second lubricating base oil components to within the preferred ranges specified above, it is possible to further improve the low-temperature viscosity and further reduce the evaporation loss. If the distillation ranges for T90-T10, FBP-IBP, T10-IBP and FBP-T90 are too narrow, the lubricating base oil yield will be poor resulting in low economy.

The saturated component contents of the first and second lubricating base oil components are preferably 90% by mass or greater, more preferably 93% by mass or greater and even more preferably 95% by mass or greater based on the total amount of each lubricating base oil component. The proportion of cyclic saturated components among the saturated components is preferably 0.1-50% by mass, more preferably 0.5-40% by mass, even more preferably 1-30% by mass and most preferably 5-20% by mass. If the saturated component content and proportion of cyclic saturated components among the saturated components both satisfy these respective conditions, it will be possible to achieve a satisfactory viscosity-temperature characteristic and heat and oxidation stability, while additives added to the lubricating base oil component will be kept in a sufficiently stable dissolved state in the lubricating base oil component, and it will be possible for the functions of the additives to be exhibited at a higher level. In addition, a saturated component content and proportion of cyclic saturated components among the saturated components satisfying the aforementioned conditions can improve the frictional properties of the lubricating base oil itself, resulting in a greater friction reducing effect and thus increased energy savings.

If the saturated component content is less than 90% by mass, the viscosity-temperature characteristic, heat and oxidation stability and frictional properties will tend to be inadequate. If the proportion of cyclic saturated components among the saturated components is less than 0.1% by mass, the solubility of additives, when they are added to the lubricating base oil component, will be insufficient and the effective amount of additives kept dissolved in the lubricating base oil component will be reduced, tending to prevent the function of the additives from being effectively obtained. If the proportion of cyclic saturated components among the saturated components is greater than 50% by mass, the efficacy of additives included in the lubricating base oil component will tend to be reduced.

For the second lubricating oil composition, a proportion of 0.1-50% by mass cyclic saturated components among the saturated components is equivalent to 99.9-50% by mass acyclic saturated components among the saturated components. Both normal paraffins and isoparaffins are included by the term "acyclic saturated components". The proportions of normal paraffins and isoparaffins in the lubricating base oil of the invention are not particularly restricted so long as the urea adduct value satisfies the condition specified above, but the proportion of isoparaffins is preferably 50-99.9% by mass, more preferably 60-99.9% by mass, even more preferably 70-99.9% by mass and most preferably 80-99.9% by mass based on the total amount of the lubricating base oil. If the proportion of isoparaffins in the lubricating base oil satisfies the aforementioned conditions it will be possible to further improve the viscosity-temperature characteristic and heat and oxidation stability, while additives added to the lubricating base oil will be kept in a sufficiently stable dissolved state in the lubricating base oil and it will be possible for the functions of the additives to be exhibited at an even higher level.

The saturated component content for the purpose of the invention is the value measured according to ASTM D 2007-93 (units: % by mass).

The proportions of the cyclic saturated components and acyclic saturated components among the saturated components for the purpose of the invention are the naphthene portion (measured: monocyclic-hexacyclic naphthenes, units: % by mass) and alkane portion (units: % by mass), respectively, both measured according to ASTM D 2786-91.

The proportion of normal paraffins in the lubricating base oil component, for the purpose of the invention, is the value obtained by analyzing saturated components separated and fractionated by the method of ASTM D 2007-93 by gas chromatography under the following conditions, and calculating the value obtained by identifying and quantifying the proportion of normal paraffins among those saturated components, based on the total amount of the lubricating base oil component. For identification and quantitation, a C5-50 straight-chain normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 m, inner diameter: 0.3 mmϕ, liquid phase film thickness: 0.1 μm), temperature elevating conditions: 50° C.-400° C. (temperature-elevating rate: 10° C./min).

Support gas: helium (linear speed: 40 cm/min)

Split ratio: 90/1

Sample injection rate: 0.5 μL (injection rate of sample diluted 20-fold with carbon disulfide).

The proportion of isoparaffins in the lubricating base oil component is the value of the difference between the acyclic saturated components among the saturated components and the normal paraffins among the saturated components, based on the total amount of the lubricating base oil.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

When the bottom fraction obtained from a fuel oil hydrocracker is used as the starting material for the first and second lubricating base oil components, the obtained base oil will have a saturated component content of 90% by mass or greater, a proportion of cyclic saturated components in the saturated components of 30-50% by mass, a proportion of acyclic saturated components in the saturated components of 50-70% by mass, a proportion of isoparaffins in the lubricating base oil component of 40-70% by mass and a viscosity index of 100-135 and preferably 120-130, but if the urea adduct value satisfies the conditions specified above it will be possible to obtain a lubricating oil composition with the effect of the invention, i.e. an excellent low-temperature viscosity characteristic wherein the MRV viscosity at −40° C. is not greater than 20,000 mPa·s and especially not greater than 10,000 mPa·s. When a slack wax or Fischer-Tropsch wax having a high wax content (for example, a normal paraffin content of 50% by mass or greater) is used as the starting material for the first and second lubricating base oil components, the obtained base oil will have a saturated component content of 90% by mass or greater, a proportion of cyclic saturated components in the saturated components of 0.1-40% by mass, a proportion of acyclic saturated components in the saturated components of 60-99.9% by mass, a proportion of isoparaffins in the lubricating base oil component of 60-99.9% by mass and a viscosity index of 100-170 and preferably 135-160, but if the urea adduct value satisfies the conditions specified above it will be possible to obtain a lubricating oil composition with very excellent properties in terms of the effect of the invention, and especially the high viscosity index and low-temperature viscosity characteristic, wherein the MRV viscosity at −40° C. is not greater than 12,000 mPa·s and especially not greater than 7000 mPa·s.

The aromatic contents of the first and second lubricating base oil components are preferably not greater than 5% by mass, more preferably 0.05-3% by mass, even more preferably 0.1-1% by mass and most preferably 0.1-0.5% by mass, based on the total amount of the lubricating base oil components. If the aromatic content exceeds the aforementioned upper limit, the viscosity-temperature characteristic, heat and oxidation stability, frictional properties, low volatility and low-temperature viscosity characteristic will tend to be reduced, while the efficacy of additives when added to the lubricating base oil component will also tend to be reduced. The lubricating base oil components of the invention may be free of aromatic components, but the solubility of additives can be further increased with an aromatic content of 0.05% by mass or greater.

The aromatic content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The preferred ranges for the % $C_p$, % $C_N$, % $C_A$ values and the % $C_P$/% $C_N$ ratio of the first and second lubricating base oil components are the same preferred ranges for the % $C_p$, % $C_N$, % $C_A$ values and the % $C_P$/% $C_N$ ratios of the first lubricating base oil in the first lubricating oil composition, and they will not be restated here.

The iodine values of the first and second lubricating base oil components are preferably not greater than 0.5, more preferably not greater than 0.3 and even more preferably not greater than 0.15, and although it may be less than 0.01, it is preferably 0.001 or greater and more preferably 0.05 or greater in consideration of achieving a commensurate effect, and in terms of economy. Limiting the iodine value of the lubricating base oil component to not greater than 0.5 can drastically improve the heat and oxidation stability.

The sulfur contents in the first and second lubricating base oil components will depend on the sulfur contents of the starting materials. For example, when using a substantially sulfur-free starting material as for synthetic wax components obtained by Fischer-Tropsch reaction, it is possible to obtain a substantially sulfur-free lubricating base oil component. When using a sulfur-containing starting material, such as slack wax obtained by a lubricating base oil component refining process or microwax obtained by a wax refining process, the sulfur content of the obtained lubricating base oil component can potentially be 100 ppm by mass or greater. From the viewpoint of further improving the heat and oxidation stability and reducing sulfur, the sulfur contents in the first and second lubricating base oil components are preferably not greater than 10 ppm by mass, more preferably not greater than 5 ppm by mass and even more preferably not greater than 3 ppm by mass.

From the viewpoint of cost reduction it is preferred to use slack wax or the like as the starting material, in which case the sulfur contents of the obtained lubricating base oil components are preferably not greater than 50 ppm by mass and more preferably not greater than 10 ppm by mass. The sulfur content for the purpose of the invention is the sulfur content measured according to JIS K 2541-1996.

The preferred ranges for the nitrogen contents of the first and second lubricating base oil components are the same preferred ranges for the nitrogen content of the second lubricating base oil in the first lubricating oil composition, and they will not be restated here.

The feed stock oils used for production of the first and second lubricating base oil components may include normal paraffins or normal paraffin-containing wax. The feed stock oils may be mineral oils or synthetic oils, or mixtures of two or more thereof.

The feed stock oil used for the second embodiment is preferably a wax-containing starting material that boils in the range of lubricating oils according to ASTM D86 or ASTM D2887. The wax content of the feed stock oil is preferably between 50% by mass and 100% by mass based on the total amount of the feed stock oil. The wax content of the starting material can be measured by a method of analysis such as nuclear magnetic resonance spectroscopy (ASTM D5292), correlative ring analysis (n-d-M) (ASTM D3238) or the solvent method (ASTM D3235).

The specific examples and preferred examples of the wax-containing starting material are the same as for the wax-containing starting material for the first embodiment, and will not be restated here.

The feed stock oil may be subjected to hydrocracking/hydroisomerization so that the obtained treated product has a urea adduct value of not greater than 4% by mass, a viscosity index of 100 or higher and a kinematic viscosity at 100° C. of at least 3.5 $mm^2/s$ and less than 4.5 $mm^2/s$, to obtain the first lubricating base oil component. Also, the feed stock oil may be subjected to hydrocracking/hydroisomerization so that the obtained treated product has a urea adduct value of not greater than 4% by mass, a viscosity index of 120 or higher and a kinematic viscosity at 100° C. of 4.5-20 $mm^2/s$, to obtain the second lubricating base oil component. The hydrocracking/hydroisomerization step is not particularly restricted so long as it satisfies the aforementioned conditions for the urea adduct value, viscosity index and kinematic viscosity at 100° C. of the obtained treated product. A preferred hydrocracking/hydroisomerization step according to the invention comprises:

a first step in which a normal paraffin-containing feed stock oil is subjected to hydrotreatment using a hydrocracking catalyst, a second step in which the treated product from the first step is subjected to hydrodewaxing using a hydrodewaxing catalyst, and a third step in which the treated product from the second step is subjected to hydrorefining using a hydrorefining catalyst.

This hydrocracking/hydroisomerization step is the same as the hydrocracking/hydroisomerization step for the first embodiment, except for differences in the conditions to be satisfied by the desired lubricating base oil component, and its explanation will not be repeated here.

The contents of the first and second lubricating base oil components in the lubricating base oil for the second lubricating oil composition are not particularly restricted so long as the viscosity index of the lubricating base oil is 100 or higher, the initial boiling point is not higher than 400° C., the 90% distillation temperature is 470° C. or higher and the difference between the 90% distillation temperature and the 10% distillation temperature is at least 70° C., but the content of the first lubricating base oil component is preferably 50-90% by mass, more preferably 55-85% by mass and even more preferably 65-75% by mass and the content of the second lubricating base oil component is preferably 10-50% by mass, more preferably 15-45% by mass and even more preferably 25-35% by mass, based on the total amount of the lubricating base oil.

The lubricating base oil of the second embodiment may consist entirely of the first and second lubricating base oil components, or it may further comprise a lubricating base oil component other than the first and second lubricating base oil components. When the lubricating base oil of the second embodiment comprises a lubricating base oil component other than the first and second lubricating base oil components, the total content of the first and second lubricating base oil components in the lubricating base oil of the second embodiment is preferably 50% by mass or greater, more preferably 60% by mass or greater and even more preferably 70% by mass or greater.

There are no particular restrictions on the base oil used together with the first and second lubricating base oil components, and examples of mineral base oils include solvent refined mineral oils, hydrocracked mineral oils, hydrorefined mineral oils and solvent dewaxed base oils whose urea adduct values, viscosity indexes and/or 100° C. kinematic viscosities do not satisfy the conditions for the first and second lubricating base oil components.

As synthetic base oils there may be used the same synthetic base oils as for the first embodiment.

The lubricating base oil of the second embodiment, comprising the first and second lubricating base oil components, exhibits an excellent viscosity-temperature characteristic and low-temperature viscosity characteristic, while also having low viscous resistance and stirring resistance and improved heat and oxidation stability and frictional properties, making it possible to achieve an increased friction reducing effect and thus improved energy savings. When additives are included in the lubricating base oil of the invention, the functions of the additives (improving heat and oxidation stability by antioxidants, etc.) can be exhibited at a higher level.

The second lubricating oil composition according to the invention comprises, as component (A), an ashless antioxidant containing essentially no sulfur as a constituent element. Component (A) is preferably a phenol-based or amine-based ashless antioxidant containing no sulfur as a constituent element.

Specific examples of phenol-based ashless antioxidants containing no sulfur as a constituent element include 4,4'-methylenebis(2,6-di-tert-butylphenol), 4,4'-bis(2,6-di-tert-butyl-phenol), 4,4'-bis(2-methyl-6-tert-butyl-phenol), 2,2'-methylenebis(4-ethyl-6-tert-butylphenol), 2,2'-methylenebis (4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4 (N,N'-dimethylaminomethylphenol), octyl-3-(3,5-di-tert-butyl-4-hydroxyphenyl) propionate, tridecyl-3-(3,5-di-tert-butyl-4-hydroxyphenyl) propionate, pentaerythrityl-tetrakis[3-(3,5-di-tert-butyl-4-hydroxyphenyl)propionate], octadecyl-3-(3,5-di-tert-butyl-4-hydroxyphenyl)propionate, octyl-3-(3,5-di-tert-butyl-4-hydroxyphenyl)propionate and octyl-3-(3-methyl-5-tert-butyl-4-hydroxyphenyl)propionate. Among these are preferred hydroxyphenyl group-substituted esteric antioxidants that are esters of hydroxyphenyl group-substituted fatty acids and C4-12 alcohols ((octyl-3-(3,5-di-tert-butyl-4-hydroxyphenyl)propionate, octyl-3-(3-methyl-5-tert-butyl-4-hydroxyphenyl)propionate and the like) and bisphenol-based antioxidants, with hydroxyphenyl group-substituted esteric antioxidants being more preferred. Phenol-based compounds with a molecular weight of 240 or greater are preferred for their high decomposition temperatures which allow them to exhibit their effects even under higher-temperature conditions.

As specific amine-based ashless antioxidants containing no sulfur as a constituent element there may be mentioned phenyl-α-naphthylamine, alkyl-phenyl-α-naphthylamines, alkyldiphenylamines, dialkyldiphenylamines, N,N'-diphenyl-p-phenylenediamine, and mixtures of the foregoing. The alkyl groups in these amine-based ashless antioxidants are preferably C1-20 straight-chain or branched alkyl groups, and more preferably C4-12 straight-chain or branched alkyl groups.

There are no particular restrictions on the content of component (A), but it is preferably 0.01% by mass or greater, more preferably 0.1% by mass or greater, even more preferably 0.5% by mass or greater and most preferably 1.0% by mass or greater, and preferably not greater than 5% by mass, more preferably not greater than 3% by mass and most preferably not greater than 2% by mass, based on the total amount of the composition. If the content of component (A) is less than 0.01% by mass the heat and oxidation stability of the lubricating oil composition will be insufficient, and in particular it may not be possible to maintain superior cleanability for prolonged periods. On the other hand, a content of component (A) exceeding 5% by mass will tend to reduce the storage stability of the lubricating oil composition.

In the second lubricating oil composition, a combination of 0.4-2% by mass of a phenol-based ashless antioxidant and 0.4-2% by mass of an amine-based ashless antioxidant, based on the total amount of the composition, may be used in combination as component (A), or most preferably, an amine-based ashless antioxidant may be used alone at 0.5-2% by mass and more preferably 0.6-1.5% by mass, which will allow excellent cleanability to be maintained for long periods.

The second lubricating oil composition comprises, as component (B): (B-1) an ashless antioxidant containing sulfur as a constituent element and (B-2) an organic molybdenum compound.

As (B-1) the ashless antioxidant containing sulfur as a constituent element, there may be suitably used sulfurized fats and oils, dihydrocarbyl polysulfide, dithiocarbamates, thiadiazoles and phenol-based ashless antioxidants containing sulfur as a constituent element.

As examples of sulfurized fats and oils there may be mentioned oils such as sulfurized lard, sulfurized rapeseed oil, sulfurized castor oil, sulfurized soybean oil and sulfurized rice bran oil; fatty acid disulfides such as oleic sulfide; and sulfurized esters such as sulfurized methyl oleate.

Olefin sulfides include those obtained by reacting C2-15 olefins or their 2-4mers with sulfidizing agents such as sulfur or sulfur chloride. Examples of olefins that are preferred for use include propylene, isobutene and diisobutene.

Specific preferred examples of dihydrocarbyl polysulfides include dibenzyl polysulfide, di-tert-nonyl polysulfide, didodecyl polysulfide, di-tert-butyl polysulfide, dioctyl polysulfide, diphenyl polysulfide and dicyclohexyl polysulfide.

Specific preferred examples of dithiocarbamates include compounds represented by the following formula (7) or (8).

[Chemical Formula 7]

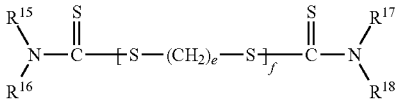

(7)

[Chemical Formula 8]

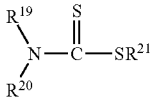

(8)

In formulas (7) and (8), $R^{15}$, $R^{16}$, $R^{17}$, $R^{18}$, $R^{19}$ and $R^{20}$ each separately represent a C1-30 and preferably 1-20 hydrocarbon group, $R^{21}$ represents hydrogen or a C1-30 hydrocarbon group and preferably hydrogen or a C1-20 hydrocarbon group, e represents an integer of 0-4, and f represents an integer of 0-6.

Examples of C1-30 hydrocarbon groups include alkyl, cycloalkyl, alkylcycloalkyl, alkenyl, aryl, alkylaryl and arylalkyl groups.

Examples of thiadiazoles include 1,3,4-thiadiazole compounds, 1,2,4-thiadiazole compounds and 1,4,5-thiadiazole compounds.

As phenol-based ashless antioxidants containing sulfur as a constituent element there may be mentioned 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis [3-(3,5-di-tert-butyl-4-hydroxyphenyl)propionate] and the like.

Dihydrocarbyl polysulfides, dithiocarbamates and thiadiazoles are preferably used and dithiocarbamates are more preferably used as component (B-1), from the viewpoint of achieving more excellent heat and oxidation stability.

When (B-1) an ashless antioxidant containing sulfur as a constituent element is used as component (B), there are no particular restrictions on the content, but it is preferably 0.001% by mass or greater, more preferably 0.005% by mass or greater and even more preferably 0.01% by mass or greater, and preferably not greater than 0.2% by mass, more preferably not greater than 0.1% by mass and most preferably not greater than 0.04% by mass, in terms of sulfur element based on the total amount of the composition. If the content is less than the aforementioned lower limit, the heat and oxidation stability of the lubricating oil composition will be insufficient, and it may not be possible to maintain superior cleanability for prolonged periods. On the other hand, if it exceeds the aforementioned upper limit the adverse effects on exhaust gas purification apparatuses by the high sulfur content of the lubricating oil composition will tend to be increased.

The (B-2) organic molybdenum compounds that may be used as component (B) include (B-2-1) organic molybdenum compounds containing sulfur as a constituent element and (B-2-2) organic molybdenum compounds containing no sulfur as a constituent element.

Examples of (B-2-1) organic molybdenum compounds containing sulfur as a constituent element include organic molybdenum complexes such as molybdenum dithiophosphates and molybdenum dithiocarbamates.

Preferred examples of molybdenum dithiophosphates include, specifically, molybdenum sulfide diethyl dithiophosphate, molybdenum sulfide dipropyl dithiophosphate, molybdenum sulfide dibutyl dithiophosphate, molybdenum sulfide dipentyl dithiophosphate, molybdenum sulfide dihexyl dithiophosphate, molybdenum sulfide dioctyl dithiophosphate, molybdenum sulfide didecyl dithiophosphate, molybdenum sulfide didodecyl dithiophosphate, molybdenum sulfide di(butylphenyl)dithiophosphate, molybdenum sulfide di(nonylphenyl)dithiophosphate, oxymolybdenum sulfide diethyl dithiophosphate, oxymolybdenum sulfide dipropyl dithiophosphate, oxymolybdenum sulfide dibutyl dithiophosphate, oxymolybdenum sulfide dipentyl dithiophosphate, oxymolybdenum sulfide dihexyl dithiophosphate, oxymolybdenum sulfide dioctyl dithiophosphate, oxymolybdenum sulfide didecyl dithiophosphate, oxymolybdenum sulfide didodecyl dithiophosphate, oxymolybdenum sulfide di(butylphenyl)dithiophosphate, oxymolybdenum sulfide di(nonylphenyl)dithiophosphate (where the alkyl groups may be straight-chain or branched, and the alkylphenyl groups may be bonded at any position of the alkyl groups), as well as mixtures of the foregoing. Also preferred as molybdenum dithiophosphates are compounds with different numbers of carbon atoms and/or structural hydrocarbon groups in the molecule.

As examples of preferred molybdenum dithiocarbamates there may be mentioned, specifically, molybdenum sulfide diethyl dithiocarbamate, molybdenum sulfide dipropyl dithiocarbamate, molybdenum sulfide dibutyl dithiocarbamate, molybdenum sulfide dipentyl dithiocarbamate, molybdenum sulfide dihexyl dithiocarbamate, molybdenum sulfide dioctyl dithiocarbamate, molybdenum sulfide didecyl dithiocarbamate, molybdenum sulfide didodecyl dithiocarbamate, molybdenum sulfide di(butylphenyl)dithiocarbamate, molybdenum sulfide di(nonylphenyl)dithiocarbamate, oxymolybdenum sulfide diethyl dithiocarbamate, oxymolybdenum sulfide dipropyl dithiocarbamate, oxymolybdenum sulfide dibutyl dithiocarbamate, oxymolybdenum sulfide dipentyl dithiocarbamate, oxymolybdenum sulfide dihexyl dithiocarbamate, oxymolybdenum sulfide dioctyl dithiocarbamate, oxymolybdenum sulfide didecyl dithiocarbamate, oxymolybdenum sulfide didodecyl dithiocarbamate, oxymolybdenum sulfide di(butylphenyl)dithiocarbamate and oxymolybdenum sulfide di(nonylphenyl)dithiocarbamate (where the alkyl groups may be linear or branched, and the alkyl groups may be bonded at any position of the alkylphenyl groups), as well as mixtures of the foregoing. Also preferred as molybdenum dithiocarbamates are compounds with different numbers of carbon atoms and/or structural hydrocarbon groups in the molecule.

As other sulfur-containing organic molybdenum complexes there may be mentioned complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, halogenated molybdenums such as molybdenum chloride, and the like), with sulfur-containing organic compounds (for example, alkyl (thio)xanthates, thiadiazoles, mercaptothiadiazoles, thiocarbonates, tetrahydrocarbylthiuram disulfide, bis(di(thio)hydrocarbyldithio phosphonate) disulfide, organic (poly)sulfides, sulfurized esters and the like), or other organic compounds, or complexes of sulfur-containing molybdenum compounds such as molybdenum sulfide and molybdic sulfide with alkenylsucciniimides.

Component (B) is preferably (B-2-1) an organic molybdenum compound containing sulfur as a constituent element in order to obtain a friction reducing effect in addition to improving the heat and oxidation stability, with molybdenum dithiocarbamates being particularly preferred.

As the (B-2-2) organic molybdenum compounds containing no sulfur as a constituent element there may be mentioned, specifically, molybdenum-amine complexes, molybdenum-succiniimide complexes, organic acid molybdenum salts, alcohol molybdenum salts and the like, among which molybdenum-amine complexes, organic acid molybdenum salts and alcohol molybdenum salts are preferred.

As molybdenum compounds in the aforementioned molybdenum-amine complexes there may be mentioned sulfur-free molybdenum compounds such as molybdenum trioxide or its hydrate ($MoO_3.nH_2O$), molybdic acid ($H_2MoO_4$), alkali metal salts of molybdic acid ($M_2MoO_4$; where M represents an alkali metal), ammonium molybdate ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, $Mo_2O_3Cl_6$ or the like. Of these molybdenum compounds, hexavalent molybdenum compounds are preferred from the viewpoint of yield of the molybdenum-amine complex. From the viewpoint of availability, the preferred hexavalent molybdenum compounds are molybdenum trioxide or its hydrate, molybdic acid, molybdic acid alkali metal salts and ammonium molybdate.

There are no particular restrictions on nitrogen compounds for the molybdenum-amine complexes, but as specific nitrogen compounds there may be mentioned ammonia, monoamines, diamines, polyamines, and the like having C4-30 hydrocarbon groups. Primary amines, secondary amines and alkanolamines are preferred among those mentioned above.

Molybdenum-succiniimide complexes include complexes of the sulfur-free molybdenum compounds mentioned above for the molybdenum-amine complexes, and succiniimides with C4-400 alkyl or alkenyl groups.

Molybdenum salts of organic acids include salts of organic acids such as phosphorus-containing acids with C1-30 hydrocarbon groups or carboxylic acids, with molybdenum bases such as molybdenum oxides or molybdenum hydroxides, molybdenum carbonates or molybdenum chlorides, mentioned above as examples for the molybdenum-amine complexes.

Molybdenum salts of alcohols include salts of C1-24 alcohols with the sulfur-free molybdenum compounds mentioned above for the molybdenum-amine complexes, and the alcohols may be monohydric alcohols, polyhydric alcohols, polyhydric alcohol partial esters or partial ester compounds or hydroxyl group-containing nitrogen compounds (alkanolamines and the like).

When a (B-2-2) organic molybdenum compound containing no sulfur as a constituent element is used as component (B) it is possible to increase the high-temperature cleanability and base number retention of the lubricating oil composition, and this is preferred for maintaining the initial friction reducing effect for longer periods, while molybdenum-amine complexes are especially preferred among such compounds.

The (B-2-1) organic molybdenum compound containing sulfur as a constituent element and (B-2-2) organic molybdenum compound containing no sulfur as a constituent element may also be used in combination in the second lubricating oil composition.

When a (B-2) organic molybdenum compound is used as component (B), there are no particular restrictions on the content, but it is preferably 0.001% by mass or greater, more preferably 0.005% by mass or greater and even more preferably 0.01% by mass or greater, and preferably not greater than 0.2% by mass, more preferably not greater than 0.1% by mass and most preferably not greater than 0.04% by mass, in terms of molybdenum element based on the total amount of the composition. If the content is less than 0.001% by mass the heat and oxidation stability of the lubricating oil composition will be insufficient, and in particular it may not be possible to maintain superior cleanability for prolonged periods. On the other hand, if the content of component (B-2) is greater than 0.2% by mass the effect will not be commensurate with the increased amount, and the storage stability of the lubricating oil composition will tend to be reduced.

The second lubricating oil composition may consist entirely of the lubricating base oil and components (A) and (B) described above, but it may further contain the additives described below as necessary for further enhancement of function.

The second lubricating oil composition preferably also further contains an anti-wear agent (or extreme-pressure agents) from the viewpoint of greater enhancement of the antiwear property. As extreme-pressure agents there are preferably used phosphorus-based extreme-pressure agents and phosphorus/sulfur-based extreme-pressure agents.

Phosphorus-based extreme-pressure agents include phosphoric acid, phosphorous acid, phosphoric acid esters (including phosphoric acid monoesters, phosphoric acid diesters and phosphoric acid triesters), phosphorous acid esters (including phosphorous acid monoesters, phosphorous acid diesters and phosphorous acid triesters), and salts of the foregoing (such as amine salts or metal salts). As phosphoric acid esters and phosphorous acid esters there may generally be used those with C2-30 and preferably C3-20 hydrocarbon groups.

As phosphorus/sulfur-based extreme-pressure agents there may be mentioned thiophosphoric acid, thiophosphorous acid, thiophosphoric acid esters (including thiophosphoric acid monoesters, thiophosphoric acid diesters and thiophosphoric acid triesters), thiophosphorous acid esters (including thiophosphorous acid monoesters, thiophosphorous acid diesters and thiophosphorous acid triesters), salts of the foregoing, and zinc dithiophosphate. As thiophosphoric acid esters and thiophosphorous acid esters there may generally be used those with C2-30 and preferably C3-20 hydrocarbon groups.

There are no particular restrictions on the extreme-pressure agent content, but it is preferably 0.01-5% by mass and more preferably 0.1-3% by mass based on the total amount of the composition.

Particularly preferred among these extreme-pressure agents are one or more compounds selected from among phosphorus compound metal salts such as zinc dithiophosphates, zinc monothiophosphates and zinc phosphates having C3-24 hydrocarbon groups.

Specific preferred examples of zinc dithiophosphates having C3-24 hydrocarbon groups include zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate, zinc di-n-dodecyldithiophosphate, zinc diisotridecyldithiophosphate, and any desired combinations of the foregoing.

Specific preferred examples of zinc monothiophosphates having C3-24 hydrocarbon groups include zinc diisopropylmonothiophosphate, zinc diisobutylmonothiophosphate, zinc di-sec-butylmonothiophosphate, zinc di-sec-pentylmonothiophosphate, zinc di-n-hexylmonothiophosphate, zinc di-sec-hexylmonothiophosphate, zinc di-octylmonothiophosphate, zinc di-2-ethylhexylmonothiophosphate, zinc di-n-decylmonothiophosphate, zinc di-n-dodecylmonothiophosphate, zinc diisotridecylmonothiophosphate, and any desired combinations of the foregoing.

Specific preferred examples of phosphoric acid metal salts, such as zinc phosphates having C3-24 hydrocarbon groups, include zinc diisopropylphosphate, zinc diisobutylphosphate, zinc di-sec-butylphosphate, zinc di-sec-pentylphosphate, zinc di-n-hexylphosphate, zinc di-sec-hexylphosphate, zinc di-octylphosphate, zinc di-2-ethylhexylphosphate, zinc di-n-decylphosphate, zinc di-n-dodecylphosphate, zinc diisotridecylphosphate, and any desired combinations of the foregoing.

The content of such phosphorus compound metal salts is not particularly restricted, but from the viewpoint of inhibiting catalyst poisoning of the exhaust gas purification device, it is preferably not greater than 0.2% by mass, more preferably not greater than 0.1% by mass, even more preferably not greater than 0.08% by mass and most preferably not greater than 0.06% by mass as phosphorus element based on the total amount of the composition. From the viewpoint of forming a metal salt of phosphoric acid that will exhibit a function and effect as an anti-wear additive, the content of the phosphorus compound metal salt is preferably 0.01% by mass or greater, more preferably 0.02% by mass or greater and even more preferably 0.04% by mass or greater as phosphorus element based on the total amount of the composition. If the phosphorus compound metal salt content is below the aforementioned lower limit, the antiwear property-improving effect due to the addition will tend to be insufficient.

The second lubricating oil composition preferably further contains a ashless dispersant from the viewpoint of cleanability and sludge dispersibility. The ashless dispersant used may be any of the same ashless dispersants mentioned for the first embodiment. The ashless dispersant used for the second lubricating oil composition is preferably a bis-type polybutenylsuccinimide and/or a derivative thereof.

The weight-average molecular weight of the ashless dispersant used in the second lubricating oil composition is preferably 3000 or greater, more preferably 6500 or greater, even more preferably 7000 or greater and most preferably 8000 or greater. With a weight-average molecular weight of less than 3000, the molecular weight of the non-polar polybutenyl groups will be low and the sludge dispersibility will be poor, while the oxidation stability may be inferior due to a higher proportion of amine portions of the polar groups, which can act as active sites for oxidative degradation. From this viewpoint, the nitrogen content of the ashless dispersant is preferably not greater than 3% by mass, more preferably not greater than 2% by mass, even more preferably not greater than 1% by mass, yet more preferably 0.1% by mass or greater and most preferably 0.5% by mass or greater. On the other hand, from the viewpoint of preventing reduction of the low-temperature viscosity characteristic, the weight-average molecular weight is preferably not greater than 20,000 and most preferably not greater than 15,000. The weight-average molecular weight referred to here is the weight-average molecular weight based on polystyrene, as measured using a 150-CALC/GPC by Japan Waters Co., equipped with two GMHHR-M (7.8 mmID×30 cm) columns by Tosoh Corp. in series, with tetrahydrofuran as the solvent, a temperature of 23° C., a flow rate of 1 mL/min, a sample concentration of 1% by mass, a sample injection rate of 75 μL and a differential refractometer (RI) as the detector.

The ashless dispersant content of the second lubricating oil composition for an internal combustion engine according to the invention is preferably 0.005% by mass or greater, more preferably 0.01% by mass or greater and even more preferably 0.05% by mass or greater, and preferably not greater than 0.3% by mass, more preferably not greater than 0.2% by mass and even more preferably not greater than 0.015% by mass, as nitrogen element based on the total amount of the composition. If the ashless dispersant content is not above the aforementioned lower limit a sufficient effect on cleanability will not be exhibited, while if the content exceeds the aforementioned upper limit, the low-temperature viscosity characteristic and demulsifying property will be undesirably impaired. When using an imide-based succinate ashless dispersant with a weight-average molecular weight of 6500 or greater, the content is preferably 0.005-0.05% by mass and more preferably 0.01-0.04% by mass as nitrogen element based on the total amount of the composition, from the viewpoint of exhibiting sufficient sludge dispersibility and achieving an excellent low-temperature viscosity characteristic.

When a boron compound-modified ashless dispersant is used, the content is preferably 0.005% by mass or greater, more preferably 0.01% by mass or greater and even more preferably 0.02% by mass or greater, and preferably not greater than 0.2% by mass and more preferably not greater than 0.1% by mass, as boron element based on the total amount of the composition. If the boron compound-modified ashless dispersant content is not above the aforementioned lower limit a sufficient effect on cleanability will not be exhibited, while if the content exceeds the aforementioned upper limit the low-temperature viscosity characteristic and demulsifying property will both be undesirably impaired.

The second lubricating oil composition preferably contains an ashless friction modifier to allow further improvement in the frictional properties. Specific examples, preferred examples and preferred ranges for the content of ashless friction modifiers are the same as for the first embodiment, and will not be repeated here.

The second lubricating oil composition preferably further contains a metal-based detergent from the viewpoint of cleanability. Specific examples and preferred examples for metal-based detergents are the same as for the first embodiment, and will not be repeated here.

The metal-based detergent content of the second lubricating oil composition may be as desired, but it is preferably 0.1-10% by mass, more preferably 0.5-8% by mass and most preferably 1-5% by mass based on the total amount of the composition. A content of greater than 10% by mass will produce no effect commensurate with the increased addition, and is therefore undesirable.

The second lubricating oil composition preferably contains a viscosity index improver to allow further improvement in the viscosity-temperature characteristic. Viscosity index improvers include non-dispersed or dispersed polymethacrylates, dispersed ethylene-α-olefin copolymers and their hydrides, polyisobutylene and its hydride, styrene-diene hydrogenated copolymers, styrene-maleic anhydride ester copolymers and polyalkylstyrenes, among which non-dispersed viscosity index improvers and/or dispersed viscosity index improvers with weight-average molecular weights of not greater than 50,000, preferably not greater than 40,000 and most preferably 10,000-35,000 are preferred. Of the viscosity index improvers mentioned above, polymethacrylate-based viscosity index improvers are preferred from the viewpoint of a superior low-temperature flow property.

The viscosity index improver content of the second lubricating oil composition is preferably 0.1-15% by mass and more preferably 0.5-5% by mass based on the total amount of the composition. If the viscosity index improver content is less than 0.1% by mass, the improving effect on the viscosity-temperature characteristic by its addition will tend to be insufficient, while if it exceeds 10% by mass it will tend to be difficult to maintain the initial extreme-pressure property for long periods.

If necessary in order to improve performance, other additives in addition to those mentioned above may be added to the second lubricating oil composition, and such additives may include corrosion inhibitors, rust-preventive agents, demulsifiers, metal deactivating agents, pour point depressants, rubber swelling agents, antifoaming agents, coloring agents and the like, either alone or in combinations of two or more.

The examples of corrosion inhibitors, rust-preventive agents, demulsifiers, metal deactivating agents and antifoaming agents are the same as for the corrosion inhibitors, rust-preventive agents, demulsifiers, metal deactivating agents and antifoaming agents used in the first lubricating oil composition, and will not be repeated here.

Any publicly known pour point depressants may be selected as pour point depressants depending on the properties of the lubricating base oil, but preferred are polymethacrylates with weight-average molecular weights of 1-300,000 and preferably 5-200,000.

As antifoaming agents there may be used any compounds commonly employed as antifoaming agents for lubricating oils, and examples include silicones such as dimethylsilicone and fluorosilicone. Any one or more selected from these compounds may be added in any desired amount.

As coloring agents there may be used any normally employed compounds and in any desired amounts, although the contents will usually be 0.001-1.0% by mass based on the total amount of the composition.

When such additives are added to a lubricating oil composition of the invention, the contents will normally be selected in ranges of 0.005-5% by mass for corrosion inhibitors, rust-preventive agents and demulsifiers, 0.005-1% by mass for metal deactivating agents, 0.05-1% by mass for pour point depressants, 0.0005-1% by mass for antifoaming agents and 0.001-1.0% by mass for coloring agents, based on the total amount of the composition.

The second lubricating oil composition may include additives containing sulfur as a constituent element, as explained above, but the total sulfur content of the lubricating oil composition (the total of sulfur from the lubricating base oil and additives) is preferably 0.05-0.3% by mass, more preferably 0.1-0.2% by mass and most preferably 0.12-0.18% by mass, from the viewpoint of solubility of the additives and of exhausting the base number resulting from production of sulfur oxides under high-temperature oxidizing conditions.

The kinematic viscosity at 100° C. of the second lubricating oil composition will normally be 4-24 $mm^2/s$, but from the viewpoint of maintaining the oil film thickness which prevents seizing and wear and the viewpoint of inhibiting increase in stirring resistance, it is preferably 5-18 $mm^2/s$, more preferably 6-15 $mm^2/s$ and even more preferably 7-12 $mm^2/s$.

The second lubricating oil composition having the construction described above has excellent heat and oxidation stability, as well as superiority in terms of viscosity-temperature characteristic, frictional properties and low volatility, and exhibits an adequate long drain property and energy savings when used as a lubricating oil for an internal combustion engine, such as a gasoline engine, diesel engine, oxygen-containing compound-containing fuel engine or gas engine for two-wheel vehicles, four-wheel vehicles, electric power generation, ships and the like.

[Third Embodiment: Third Lubricating Oil Composition]

The third lubricating oil composition comprises a lubricating base oil having a urea adduct value of not greater than 4% by mass and a viscosity index of 100 or higher, and a poly (meth)acrylate having a weight-average molecular weight of 200,000-400,000.

From the viewpoint of improving the low-temperature viscosity characteristic without impairing the viscosity-temperature characteristic, the urea adduct value of the lubricating base oil in the third lubricating oil composition (hereinafter referred to as "lubricating base oil of the third embodiment, or simply "lubricating base oil") must be not greater than 4% by mass as mentioned above, but it is preferably not greater than 3.5% by mass, more preferably not greater than 3% by mass and even more preferably not greater than 2.5% by mass. The urea adduct value of the lubricating base oil may even be 0% by mass.

From the viewpoint of improving the viscosity-temperature characteristic, the viscosity index of the lubricating base oil must be 100 or higher as mentioned above, but it is preferably 110 or higher, more preferably 120 or higher, even more preferably 130 or higher and most preferably 140 or higher.

The feed stock oil used for production of the lubricating base oil may include normal paraffins or normal paraffin-containing wax. The feed stock oil may be a mineral oil or a synthetic oil, or a mixture of two or more thereof. The normal paraffin content of the feed stock oil is preferably 50% by mass or greater, more preferably 70% by mass or greater, even more preferably 80% by mass or greater, yet more preferably 90% by mass or greater, even yet more preferably 95% by mass or greater and most preferably 97% by mass or greater, based on the total amount of the feed stock oil.

The feed stock oil used for the invention preferably is a wax-containing starting material that boils in the range of lubricating oils according to ASTM D86 or ASTM D2887. The wax content of the feed stock oil is preferably between 50% by mass and 100% by mass based on the total amount of the feed stock oil. The wax content of the starting material can be measured by a method of analysis such as nuclear magnetic resonance spectroscopy (ASTM D5292), correlative ring analysis (n-d-M) (ASTM D3238) or the solvent method (ASTM D3235).

The specific examples and preferred examples of the wax-containing starting material are the same as for the wax-containing starting material for the first embodiment, and will not be restated here.

The lubricating base oil of the third embodiment may be obtained through a step of hydrocracking/hydroisomerization of the feed stock oil so as to obtain a treated product having a urea adduct value of not greater than 4% by mass and a viscosity index of 100 or higher. The hydrocracking/hydroisomerization step is not particularly restricted so long as it satisfies the aforementioned conditions for the urea adduct value and viscosity index of the treated product. A preferred hydrocracking/hydroisomerization step for the third embodiment comprises:

a first step in which a normal paraffin-containing feed stock oil is subjected to hydrotreatment using a hydrocracking catalyst, a second step in which the treated product from the first step is subjected to hydrodewaxing using a hydrodewaxing catalyst, and a third step in which the treated product from the second step is subjected to hydrorefining using a hydrorefining catalyst.

This hydrocracking/hydroisomerization step is the same as the hydrocracking/hydroisomerization step for the first embodiment, except for differences in the conditions to be satisfied by the desired lubricating base oil component, and its explanation will not be repeated here.

The lubricating base oil of the third embodiment is not restricted in terms of its other properties so long as the urea adduct value and viscosity index satisfy their respective conditions, but the lubricating base oil of the invention preferably also satisfies the conditions specified below.

The preferred range for the saturated component content in the lubricating base oil of the third embodiment is the same as the preferred range for the saturated component contents in the first and second lubricating base oil components of the second embodiment, and it will not be explained again here.

When the bottom fraction obtained from a fuel oil hydrocracking apparatus is used as the starting material for the lubricating base oil of the third embodiment, the obtained base oil will have a saturated component content of 90% by mass or greater, a proportion of cyclic saturated components in the saturated components of 30-50% by mass, a proportion of acyclic saturated components in the saturated components of 50-70% by mass, a proportion of isoparaffins in the lubricating base oil of 40-70% by mass and a viscosity index of 100-135 and preferably 120-130, but if the urea adduct value satisfies the conditions specified above it will be possible to drastically improve the effect of the invention and the low-temperature viscosity characteristic while also achieving both anti-wear and low-friction properties against soot contamination, and especially to improve the low-temperature viscosity characteristic. When a slack wax or Fischer-Tropsch wax having a high wax content (for example, a normal paraffin content of 50% by mass or greater) is used as the starting material for the lubricating base oil of the third embodiment, the obtained base oil will have a saturated component content of 90% by mass or greater, a proportion of cyclic saturated components in the saturated components of 0.1-40% by mass, a proportion of acyclic saturated components in the saturated components of 60-99.9% by mass, a proportion of isoparaffins in the lubricating base oil of 60-99.9% by mass and a viscosity index of 100-170 and preferably 135-160, but if the urea adduct value satisfies the conditions specified above it will be possible to obtain a lubricating oil composition with very excellent properties in terms of improving the low-temperature viscosity characteristic while also achieving both anti-wear and low-friction properties against soot contamination, and especially improving the high viscosity index and low-temperature viscosity characteristic.

The preferred ranges for % $C_p$, % $C_N$, % $C_A$ and the % $C_P$/% $C_N$ ratio of the lubricating base oil of the third embodiment are the same as the preferred ranges for % $C_p$, % $C_N$, % $C_A$ and the % $C_P$/% $C_N$ ratio of the first lubricating base oil of the first embodiment, and therefore will not be repeated here.

Also, the aromatic content, iodine value, sulfur content and nitrogen content of the lubricating base oil of the third embodiment have the same preferred ranges as the aromatic content, iodine value, sulfur content and nitrogen content of the first and second lubricating base oil components of the second embodiment, and will likewise not be repeated here.

The kinematic viscosity at 100° C. of the lubricating base oil of the third embodiment is preferably 1.5-20 $mm^2/s$ and more preferably 2.0-11 $mm^2/s$. A kinematic viscosity at 100° C. of lower than 1.5 $mm^2/s$ for the lubricating base oil is not preferred from the standpoint of evaporation loss. If it is attempted to obtain a lubricating base oil having a kinematic viscosity at 100° C. of greater than 20 $mm^2/s$, the yield will be reduced and it will be difficult to increase the cracking severity even when using a heavy wax as the starting material.

According to the third embodiment, a lubricating base oil having a kinematic viscosity at 100° C. in one of the following ranges is preferably used after fractionation by distillation or the like.

(I) A lubricating base oil with a kinematic viscosity at 100° C. of at least 1.5 $mm^2/s$ and less than 3.5 $mm^2/s$, and more preferably 2.0-3.0 $mm^2/s$.

(II) A lubricating base oil with a kinematic viscosity at 100° C. of at least 3.0 $mm^2/s$ and less than 4.5 $mm^2/s$, and more preferably 3.5-4.1 $mm^2/s$.

(III) A lubricating base oil with a kinematic viscosity at 100° C. of 4.5-20 $mm^2/s$, more preferably 4.8-11 $mm^2/s$ and most preferably 5.5-8.0 $mm^2/s$.

The kinematic viscosity at 40° C. of the lubricating base oil of the third embodiment is preferably 6.0-80 $mm^2/s$ and more preferably 8.0-50 $mm^2/s$. According to the invention, a lube-oil distillate having a kinematic viscosity at 40° C. in one of the following ranges is preferably used after fractionation by distillation or the like.

(IV) A lubricating base oil with a kinematic viscosity at 40° C. of at least 6.0 $mm^2/s$ and less than 12 $mm^2/s$, and more preferably 8.0-12 $mm^2/s$.

(V) A lubricating base oil with a kinematic viscosity at 40° C. of at least 12 $mm^2/s$ and less than 28 $mm^2/s$, and more preferably 13-19 $mm^2/s$.

(VI) A lubricating base oil with a kinematic viscosity at 40° C. of 28-50 $mm^2/s$, more preferably 29-45 $mm^2/s$ and most preferably 30-40 $mm^2/s$.

The lubricating base oils (I) and (IV), having a urea adduct value and viscosity index satisfying the respective conditions specified above, can achieve high levels of both viscosity-temperature characteristic and low-temperature viscosity characteristic compared to conventional lubricating base oils of the same viscosity grade, and in particular they have an excellent low-temperature viscosity characteristic, and the viscous resistance or stirring resistance can be notably reduced. Moreover, by including a pour point depressant it is possible to lower the BF viscosity at −40° C. to below 2000 mPa·s. The BF viscosity at −40° C. is the viscosity measured according to JPI-5S-26-99.

The lubricating base oils (II) and (V) having urea adduct values and viscosity indexes satisfying the respective conditions specified above can achieve high levels of both the viscosity-temperature characteristic and low-temperature viscosity characteristic compared to conventional lubricating base oils of the same viscosity grade, and in particular they have an excellent low-temperature viscosity characteristic, and superior lubricity and low volatility. For example, with lubricating base oils (II) and (V) it is possible to lower the CCS viscosity at −35° C. to not greater than 3000 mPa·s and preferably not greater than 2000 mPa·s. Moreover, by including a pour point depressant it is possible to lower the MRV viscosity at −40° C. to not greater than 10,000 mPa·s and preferably not greater than 8000 mPa·s.

The lubricating base oils (III) and (VI), having urea adduct values and viscosity indexes satisfying the respective conditions specified above, can achieve high levels of both the viscosity-temperature characteristic and low-temperature viscosity characteristic compared to conventional lubricating base oils of the same viscosity grade, and in particular they have an excellent low-temperature viscosity characteristic, and superior heat and oxidation stability, lubricity and low volatility.

The pour point of the lubricating base oil of the third embodiment will depend on the viscosity grade of the lubricating base oil, and for example, the pour point for the lubricating base oils (I) and (IV) is preferably not higher than −10° C., more preferably not higher than −12.5° C. and even more preferably not higher than −15° C. The pour point for the lubricating base oils (II) and (V) is preferably not higher than −10° C., more preferably not higher than −15° C. and even more preferably not higher than −17.5° C. The pour point for the lubricating base oils (III) and (VI) is preferably not higher than −10° C., more preferably not higher than −12.5° C. and even more preferably not higher than −15° C. If the pour point exceeds the upper limit specified above, the low-temperature flow properties of lubricating oils employing the lubricating base oils will tend to be reduced. The pour point for the purpose of the invention is the pour point measured according to JIS K 2269-1987.

The CCS viscosity at −35° C. of the lubricating base oil of the third embodiment will depend on the viscosity grade of the lubricating base oil, but the CCS viscosity at −35° C. for the lubricating base oils (I) and (IV) mentioned above, for example, is preferably not greater than 1000 mPa·s. Also, the CCS viscosity at −35° C. of the lubricating base oils (II) and (V) is preferably not greater than 3000 mPa·s, more preferably not greater than 2400 mPa·s, even more preferably not greater than 2000 mPa·s, yet more preferably not greater than 1800 mPa·s, even yet more preferably not greater than 1600 mPa·s, and most preferably not greater than 1500 mPa·s. The CCS viscosity at −35° C. for the lubricating base oils (III) and (VI) is preferably not greater than 15,000 mPa·s and more preferably not greater than 10,000 mPa·s. If the CCS viscosity at −35° C. exceeds the upper limit specified above, the low-temperature flow properties of lubricating oils employing the lubricating base oils will tend to be reduced.

The BF viscosity at −40° C. of the lubricating base oil of the third embodiment will depend on the viscosity grade of the lubricating base oil, but the −40° C. BF viscosities of the lubricating base oils (I) and (IV), for example, are preferably not greater than 10,000 mPa·s, more preferably not greater than 8000 mPa·s, and even more preferably not greater than 6000 mPa·s. The −40° C. BF viscosities of the lubricating base oils (II) and (V) are preferably not greater than 1,500,000 mPa·s and more preferably not greater than 1,000,000 mPa·s. If the BF viscosity at −40° C. exceeds the upper limit specified above, the low-temperature flow properties of lubricating oils employing the lubricating base oils will tend to be reduced.

The density at 15° C. ($\rho_{15}$) (g/cm$^3$) of the lubricating base oil of the third embodiment will also depend on the viscosity grade of the lubricating base oil, but it is preferably not greater than the value of ρ as represented by the following formula (ii), i.e., $\rho_{15} \leq \rho$.

$$\rho = 0.0025 \times kv100 + 0.816 \quad \text{(ii)}$$

[In this equation, kv100 represents the kinematic viscosity at 100° C. (mm$^2$/s) of the lubricating base oil.]

If ρ15>ρ, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

For example, the value of $\rho_{15}$ for lubricating base oils (I) and (IV) is preferably not greater than 0.825 g/cm$^3$ and more preferably not greater than 0.820 g/cm$^3$. The value of $\rho_{15}$ for lubricating base oils (II) and (V) is preferably not greater than 0.835 g/cm$^3$ and more preferably not greater than 0.830 g/cm$^3$. The value of $\rho_{15}$ for lubricating base oils (III) and (VI) is preferably not greater than 0.840 g/cm$^3$ and more preferably not greater than 0.835 g/cm$^3$.

The density at 15° C. for the purpose of the invention is the density measured at 15° C. according to JIS K 2249-1995.

The aniline point (AP (° C.)) of the lubricating base oil of the third embodiment will also depend on the viscosity grade of the lubricating base oil, but it is preferably greater than or equal to the value of A as represented by formula (i) explained for the second embodiment, i.e., AP≥A.

The AP for the lubricating base oils (I) and (IV) is preferably 108° C. or higher and more preferably 110° C. or higher. The AP for the lubricating base oils (II) and (V) is preferably 113° C. or higher and more preferably 119° C. or higher. Also, the AP for the lubricating base oils (III) and (VI) is preferably 125° C. or higher and more preferably 128° C. or higher.

The distillation properties of the lubricating base oil of the third embodiment are preferably an initial boiling point (IBP) of 290-440° C. and a final boiling point (FBP) of 430-580° C. in gas chromatography distillation, and rectification of one or more fractions selected from among fractions in this distillation range can yield lubricating base oils (I)-(III) and (IV)-(VI) having the aforementioned preferred viscosity ranges.

For the distillation properties of the lubricating base oils (I) and (IV), for example, the initial boiling point (IBP) is preferably 260-340° C., more preferably 270-330° C. and even more preferably 280-320° C. The 10% distillation temperature (T10) is preferably 310-390° C., more preferably 320-380° C. and even more preferably 330-370° C. The 50% running point (T50) is preferably 340-440° C., more preferably 360-430° C. and even more preferably 370-420° C. The 90% running point (T90) is preferably 405-465° C., more preferably 415-455° C. and even more preferably 425-445° C. The final boiling point (FBP) is preferably 430-490° C., more preferably 440-480° C. and even more preferably 450-490° C. T90-T10 is preferably 60-140° C., more preferably 70-130° C. and even more preferably 80-120° C. FBP-IBP is preferably 140-200° C., more preferably 150-190° C. and even more preferably 160-180° C. T10-IBP is preferably 40-100° C., more preferably 50-90° C. and even more preferably 60-80° C. FBP-T90 is preferably 5-60° C., more preferably 10-55° C. and even more preferably 15-50° C.

For the distillation properties of the lubricating base oils (II) and (V), the initial boiling point (IBP) is preferably 310-400° C., more preferably 320-390° C. and even more preferably 330-380° C. The 10% distillation temperature (T10) is preferably 350-430° C., more preferably 360-420° C. and even more preferably 370-410° C. The 50% running point (T50) is preferably 390-470° C., more preferably 400-460° C. and even more preferably 410-450° C. The 90% running point (T90) is preferably 420-490° C., more preferably 430-480° C. and even more preferably 440-470° C. The final boiling point (FBP) is preferably 450-530° C., more preferably 460-520° C. and even more preferably 470-510° C. T90-T10 is preferably 40-100° C., more preferably 45-90° C. and even more preferably 50-80° C. FBP-IBP is preferably 80-170° C., more preferably 100-160° C. and even more preferably 120-150° C. T10-IBP is preferably 5-60° C., more preferably 10-55° C. and even more preferably 15-50° C. FBP-T90 is preferably 5-60° C., more preferably 10-55° C. and even more preferably 15-50° C.

For the distillation properties of the lubricating base oils (III) and (VI), the initial boiling point (IBP) is preferably 440-480° C., more preferably 430-470° C. and even more preferably 420-460° C. The 10% distillation temperature (T10) is preferably 450-510° C., more preferably 460-500° C. and even more preferably 460-480° C. The 50% running point (T50) is preferably 470-540° C., more preferably 480-530° C. and even more preferably 490-520° C. The 90% running point (T90) is preferably 470-560° C., more preferably 480-550° C. and even more preferably 490-540° C. The final boiling point (FBP) is preferably 505-565° C., more preferably 515-555° C. and even more preferably 525-565° C. T90-T10 is preferably 35-80° C., more preferably 45-70° C. and even more preferably 55-80° C. FBP-IBP is preferably 50-130° C., more preferably 60-120° C. and even more preferably 70-110° C. T10-IBP is preferably 5-65° C., more preferably 10-55° C. and even more preferably 10-45° C. FBP-T90 is preferably 5-60° C., more preferably 5-50° C. and even more preferably 5-40° C.

By setting IBP, T10, T50, T90, FBP, T90-T10, FBP-IBP, T10-IBP and FBP-T90 within the preferred ranges specified above for lubricating base oils (I)-(VI), it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The lubricating base oil in the third lubricating oil composition may be composed entirely of the lubricating base oil of the third embodiment (that is, a lubricating base oil component having a urea adduct value of not greater than 4% by mass and a viscosity index of 100 or higher), but it may further comprise a mineral base oil or synthetic base oil other than the lubricating base oil, or a desired mixture of two or more lubricating base oils selected from among the foregoing. However, when the lubricating base oil of the third embodiment is used together with another lubricating base oil component, the proportion of the other lubricating base oil component is preferably no more than 90% by mass based on the total amount of the lubricating base oil.

That is, when a mixed base oil comprising the lubricating base oil of the third embodiment and another lubricating base oil is used, the content ratio of the lubricating base oil of the third embodiment is preferably 10-100% by mass, more preferably 30% by mass or greater, even more preferably 50% by mass or greater, yet more preferably 70% by mass or greater and most preferably 80% by mass or greater, based on the total amount of the mixed base oil. If the content ratio is less than 10% by mass, it may not be possible to obtain the necessary low-temperature viscosity and fuel efficiency performance.

There are no particular restrictions on the other lubricating base oil, and examples of mineral base oils include solvent refined mineral oils, hydrocracked mineral oils, hydrorefined mineral oils and solvent dewaxed base oils having 100° C. kinematic viscosities of 1-100 $mm^2/s$.

As synthetic base oils there may be used the same synthetic base oils mentioned as examples for the first embodiment.

The third lubricating oil composition also comprises a poly(meth)acrylate with a weight-average molecular weight of 200,000-400,000 (hereinafter referred to as "poly(meth) acrylate of the third embodiment").

The weight-average molecular weight ($M_W$) of the poly (meth)acrylate of the third embodiment must be 200,000-400,000, and it is preferably 225,000-375,000 and even more preferably 275,000-325,000. If the weight-average molecular weight is less than 200,000, the effect of improving the viscosity index will be minimal, not only resulting in inferior fuel efficiency and low-temperature viscosity characteristics but also potentially increasing cost, while if the weight-average molecular weight is greater than 400,000 the shear stability, solubility in the base oil and storage stability may be impaired.

The PSSI (Permanent Shear Stability Index) of the poly (meth)acrylate of the third embodiment is preferably not greater than 80, more preferably 5-60, even more preferably 20-55, yet more preferably 30-50 and most preferably 35-45. If the PSSI exceeds 80, the shear stability may be impaired. If the PSSI is less than 5, not only will the viscosity index-improving effect will be low and the fuel efficiency and low-temperature viscosity characteristic inferior, but cost may also increase.

The ratio of the weight-average molecular weight and number-average molecular weight ($M_W/M_n$) of the poly (meth)acrylate of the third embodiment is preferably 0.5-5.0, more preferably 1.0-3.5, even more preferably 1.5-3 and most preferably 1.7-2.5. If the ratio of the weight-average molecular weight and number-average molecular weight is less than 0.5 or greater than 5.0, not only will the solubility in the base oil and the storage stability be impaired, but potentially the viscosity-temperature characteristic will be reduced and the fuel efficiency lowered.

The ratio of the weight-average molecular weight and PSSI ($M_W$/PSSI) of the poly(meth)acrylate of the third embodiment is preferably not greater than $2.5\times10^4$, more preferably less than $1\times10^4$, even more preferably not greater than $0.9\times10^4$ and preferably at least $0.5\times10^4$. If $M_W$/PSSI is less than $1\times10^4$ it will be possible to further increase the baking resistance and antiwear property.

The poly(meth)acrylate of the third embodiment preferably comprises one or more (meth)acrylate structural units represented by the following formula (9) as a structural unit. Such a poly(meth)acrylate may be non-dispersed or dispersed, but is more preferably dispersed.

[Chemical Formula 9]

(9)

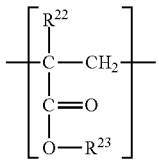

[In formula (9), $R^{22}$ represents hydrogen or methyl and $R^{23}$ represents a C1-50 straight-chain or branched hydrocarbon group.]

$R^{23}$ in the structural unit represented by formula (9) is a C1-50 straight-chain or branched hydrocarbon group, as mentioned above, and it is preferably a C1-30 straight-chain or branched hydrocarbon, more preferably a C1-20 straight-chain or branched hydrocarbon and even more preferably a C1-15 straight-chain hydrocarbon group.

The poly(meth)acrylate of the third embodiment may be obtained by copolymerization of any (meth)acrylate monomer or any olefin or the like, so long as it has a (meth)acrylate structural unit represented by formula (9).

Any monomer may be polymerized to obtain the poly (meth)acrylate of the third embodiment, but such a monomer is preferably one represented by the following formula (10) (hereunder, "monomer (M-3-1)"), for example. The (co) polymer with monomer (M-3-1) is a "non-dispersed" poly (meth)acrylate.

[Chemical Formula 10]

(10)

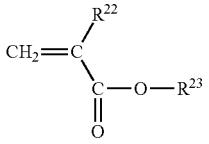

[In formula (10), $R^{22}$ represents hydrogen or methyl and $R^{23}$ represents a C1-50 straight-chain or branched hydrocarbon group.]

Preferred examples for monomer (M-3-1) include alkyl (meth)acrylates having C1-30 straight-chain or branched alkyl groups, preferably C1-20 straight-chain alkyl groups, and specifically methyl(meth)acrylate, ethyl(meth)acrylate, propyl(meth)acrylate, butyl(meth)acrylate, pentyl(meth) acrylate, hexyl(meth)acrylate, heptyl(meth)acrylate, octyl (meth)acrylate, nonyl(meth)acrylate, decyl(meth)acrylate, undecyl(meth)acrylate, dodecyl(meth)acrylate, tridecyl (meth)acrylate, tetradecyl(meth)acrylate, pentadecyl(meth) acrylate, hexadecyl(meth)acrylate, heptadecyl(meth)acrylate, octadecyl(meth)acrylate and the like (where the alkyl groups are preferably straight-chain alkyl groups), more preferably monomers comprising methyl methacrylate, dodecyl methacrylate, tridecyl methacrylate, tetradecyl methacrylate and pentadecyl methacrylate, and most preferably monomers having methyl methacrylate, n-dodecyl methacrylate, n-tridecyl methacrylate, n-tetradecyl methacrylate or n-pentadecyl methacrylate as the main structural unit.

As other monomers to be polymerized to obtain the poly (meth)acrylate of the third embodiment, there are preferred one or more selected from among monomers represented by the following formula (11) (hereunder, "monomer (M-3-2)") and monomers represented by the following formula (12) (hereunder, "monomer (M-3-3)"). The (co)polymer with monomer (M-3-2) and/or a monomer comprising (M-3-3) is a "dispersed" poly(meth)acrylate. The dispersed poly(meth) acrylate preferably comprises monomer (M-3-1) as a constituent monomer.

[Chemical Formula 11]

(11)

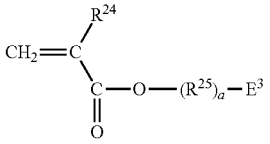

[In general formula (11), $R^{24}$ represents hydrogen or methyl, $R^{25}$ represents a C1-18 alkylene group, $E^3$ represents an amine residue or heterocyclic residue containing 1-2 nitrogen atoms and 0-2 oxygen atoms, and a is 0 or 1.]

Specific examples of C1-18 alkylene groups represented by $R^{25}$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene (which alkylene groups may be straight-chain or branched).

Specific examples of groups represented by $E^3$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

[Chemical Formula 12]

(12)

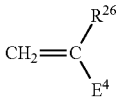

[In general formula (12), $R^{26}$ represents hydrogen or methyl and $E^4$ represents an amine residue or heterocyclic residue containing 1-2 nitrogen atoms and 0-2 oxygen atoms.]

Specific examples of groups represented by $E^4$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

Specific preferred examples for monomers (M-3-2) and (M-3-3) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures of the foregoing.

Any production process may be employed for the poly (meth)acrylate of the third embodiment, and for example, it can be easily obtained by radical solution polymerization of a mixture of monomers (M-3-1)-(M-3-3) in the presence of a polymerization initiator such as benzoyl peroxide.

The poly(meth)acrylate of the third embodiment is most preferably a dispersed polymethacrylate obtained by copolymerization of a monomer having methyl methacrylate, n-dodecyl methacrylate, n-tridecyl methacrylate, n-tetradecyl methacrylate or n-pentadecyl methacrylate as the main structural unit, and one or more monomers selected from among monomers (M-3-2) and (M-3-3).

The content of the poly(meth)acrylate of the third embodiment is preferably 0.1-50% by mass, more preferably 0.5-40% by mass, even more preferably 1-30% by mass and most preferably 5-20% by mass, based on the total amount of the composition. If the poly(meth)acrylate content is less than 0.1% by mass, the viscosity index improving effect or product viscosity reducing effect will be minimal, potentially preventing improvement in fuel efficiency. A content of greater than 50% by mass will drastically increase production cost while requiring reduced base oil viscosity, and can thus risk lowering the lubricating performance under harsh lubrication conditions (high-temperature, high-shear conditions), as well as causing problems such as wear, seizing and fatigue fracture.

The third lubricating oil composition may further contain, in addition to the poly(meth)acrylate of the third embodiment, also common non-dispersed or dispersed poly(meth) acrylates, non-dispersed or dispersed ethylene-α-olefin copolymers or their hydrides, polyisobutylene or its hydride, styrene-diene hydrogenated copolymers, styrene-maleic anhydride ester copolymers and polyalkylstyrenes.

The third lubricating oil composition may further contain any additives commonly used in lubricating oils, for the purpose of enhancing performance. Examples of such additives include additives such as friction modifiers, metal-based detergents, ashless dispersants, antioxidants, anti-wear agents (or extreme-pressure agents), corrosion inhibitors, rust-preventive agents, pour point depressants, demulsifiers, metal deactivating agents and antifoaming agents. Specific examples of these additives are the same as for the first embodiment and therefore will not be repeated here.

When such additives are added to the third lubricating oil composition, their contents are 0.01-10% by mass based on the total amount of the composition.

The kinematic viscosity at 100° C. of the third lubricating oil composition is preferably 4-12 $mm^2/s$, more preferably 4.5-10 $mm^2/s$, even more preferably 5-9 $mm^2/s$ and most preferably 6-8 $mm^2/s$. If the kinematic viscosity at 100° C. is less than 4 $mm^2/s$, insufficient lubricity may result, and if it is greater than 12 $mm^2/s$ it may not be possible to obtain the necessary low-temperature viscosity and sufficient fuel efficiency performance.

The viscosity index of the third lubricating oil composition is preferably 140-300, more preferably 190-300, even more preferably 200-300, yet more preferably 210-300, even yet more preferably 220-300, especially preferably 230-300 and most preferably 240-300. If the viscosity index of the lubricating oil composition of the invention is less than 140 it may be difficult to maintain the HTHS viscosity while improving fuel efficiency, and it may also be difficult to lower the −35° C. low-temperature viscosity. In addition, if the viscosity index of the lubricating oil composition of the invention is greater than 300, the low-temperature flow property may be poor and problems may occur due to solubility of the additives or lack of compatibility with the sealant material.

The third lubricating oil composition preferably satisfies the following conditions, in addition to satisfying the aforementioned conditions for the kinematic viscosity at 100° C. and viscosity index.

The kinematic viscosity at 40° C. of the third lubricating oil composition is preferably 4-50 $mm^2/s$, more preferably 10-40 $mm^2/s$, even more preferably 20-35 $mm^2/s$ and most preferably 27-32 $mm^2/s$. If the kinematic viscosity at 40° C. is less than 4 $mm^2/s$, insufficient lubricity may result, and if it is greater than 50 $mm^2/s$ it may not be possible to obtain the necessary low-temperature viscosity and sufficient fuel efficiency performance.

The HTHS viscosity at 150° C. of the third lubricating oil composition is preferably not greater than 3.5 mPa·s, more preferably not greater than 3.0 mPa·s, even more preferably not greater than 2.8 mPa·s and most preferably not greater than 2.7 mPa·s. It is also preferably 2.0 mPa·s or greater, preferably 2.3 mPa·s or greater, more preferably 2.4 mPa·s or greater, even more preferably 2.5 mPa·s or greater and most preferably 2.6 mPa·s or greater. The HTHS viscosity at 150° C. referred to here is the high-temperature high-shear viscosity at 150° C., specified by ASTM ASTM D4683. If the HTHS viscosity at 150° C. is less than 2.0 mPa·s, the evaporation property may be high and insufficient lubricity may result, and if it is greater than 3.5 mPa·s it may not be possible to obtain the necessary low-temperature viscosity and sufficient fuel efficiency performance.

The third lubricating oil composition, having the construction described above, has excellent fuel efficiency and low evaporation and low-temperature viscosity characteristics, and can exhibit both fuel efficiency and low-temperature viscosity at below −35° C. while maintaining its HTHS viscosity at 150° C., even without using a synthetic oil such as a poly-α-olefinic base oil or esteric base oil, or a low-viscosity mineral base oil, and can notably improve the baking resistance and antiwear property. For example, when a SAE0W-20 engine oil is to be produced, the third lubricating oil composition can provide a CCS viscosity at −35° C. of not higher than 3500 mPa·s. The MRV viscosity at −40° C. of the third lubricating oil composition is preferably not greater than 7000 mPa·s. The viscosity grade of the SAE0W-20 engine oil is a kinematic viscosity at 100° C. of 5.6 $mm^2/s$ or higher and less than 9.3 $mm^2/s$, a HTHS viscosity at 150° C. of 2.6 mPa·s or higher, a CCS viscosity at −35° C. of not higher than 6200 mPa·s and a MRV viscosity at −40° C. of not higher than 60,000 mPa·s, but as mentioned above, it can be produced with a considerable margin for low-temperature viscosity, and a lubricating oil composition with especially excellent baking resistance and antiwear property can be obtained.

EXAMPLES

The present invention will now be explained in greater detail based on examples and comparative examples, with the understanding that these examples are in no way limitative on the invention.

Examples 1-1 to 1-4, Comparative Examples 1-1 to 1-3

<Crude Wax>

The fraction separated by vacuum distillation in a process for refining of a solvent refined base oil was subjected to solvent extraction with furfural and then hydrotreatment, which was followed by solvent dewaxing with a methyl ethyl ketone-toluene mixed solvent. The properties of the wax portion removed during solvent dewaxing and obtained as slack wax (hereunder, "WAX1") are shown in Table 1.

TABLE 1

| Name of crude wax | WAX1 |
|---|---|
| Kinematic viscosity at 100° C. ($mm^2/s$) | 6.3 |
| Melting point (° C.) | 53 |
| Oil content (% by mass) | 19.9 |
| Sulfur content (ppm by mass) | 1900 |

The properties of the wax portion obtained by further deoiling of WAX1 (hereunder, "WAX2") are shown in Table 2.

TABLE 2

| Name of crude wax | WAX2 |
|---|---|
| Kinematic viscosity at 100° C. ($mm^2/s$) | 6.8 |
| Melting point (° C.) | 58 |
| Oil content (% by mass) | 6.3 |
| Sulfur content (ppm by mass) | 900 |

An FT wax having a paraffin content of 95% by mass and a carbon number distribution from 20 to 80 (hereunder, "WAX3") was used, and the properties of WAX3 are shown in Table 3.

TABLE 3

| Name of crude wax | WAX3 |
|---|---|
| Kinematic viscosity at 100° C. ($mm^2/s$) | 5.8 |
| Melting point (° C.) | 70 |
| Oil content (% by mass) | <1 |
| Sulfur content (ppm by mass) | <0.2 |

[Production of Lubricating Base Oils]

WAX1, WAX2 and WAX3 were used as feed stock oils for hydrotreatment with a hydrotreatment catalyst. The reaction temperature and liquid space velocity were modified for a feed stock oil cracking severity of at least 5% by mass and a sulfur content of not greater than 10 ppm by mass in the oil to be treated. Here, a "feed stock oil cracking severity of at least 5% by mass" means that the proportion of the fraction lighter than the initial boiling point of the feed stock oil in the oil to be treated is at least 5% by mass with respect to the total feed stock oil amount, and this is confirmed by gas chromatography distillation.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the lubricating base oils 1-1 to 1-4 were obtained by distillation, having the compositions and properties shown in Tables 4 and 5. Lubricating base oils 1-5 and 1-6 having the compositions and properties shown in Table 5 were also obtained as hydrocracked base oils obtained using WVGO as the feed stock oil. In Tables 4 and 5, the row headed "Proportion of normal paraffin-derived components in urea adduct" means the values determined by gas chromatography of the urea adduct obtained during measurement of the urea adduct value (same hereunder).

A polymethacrylate-based pour point depressant (weight-average molecular weight: approximately 60,000) commonly used in automobile lubricating oils was added to the lubricating base oils listed in Tables 4 and 5. The pour point depressant was added in three different amounts of 0.3% by mass, 0.5% by mass and 1.0% by mass, based on the total amount of the composition. The MRV viscosity at −40° C. of each of the obtained lubricating oil compositions was then measured, and the obtained results are shown in Tables 4 and 5.

TABLE 4

| | | Base oil 1-1 | Base oil 1-2 | Base oil 1-3 |
|---|---|---|---|---|
| Feed stock oil | | WAX1 | WAX2 | WAX3 |
| Urea adduct value, % by mass | | 3.75 | 2.33 | 1.18 |
| Proportion of normal paraffin-derived components in urea adduct, % by mass | | 2.8 | 2.5 | 2.1 |
| Base oil composition (based on total base oil) | Saturated components, % by mass | 99.4 | 99.6 | 99.7 |
| | Aromatic components, % by mass | 0.4 | 0.3 | 0.2 |
| | Polar compound components, % by mass | 0.2 | 0.1 | 0.1 |
| Saturated components content (based on total saturated components) | Cyclic saturated components, % by mass | 11.3 | 10.5 | 9.8 |
| | Acyclic saturated components, % by mass | 88.7 | 89.5 | 90.2 |
| Acyclic saturated components content (based on total acyclic saturated components) | Normal paraffins, % by mass | 0 | 0 | 0 |
| | Isoparaffins, % by mass | 100 | 100 | 100 |
| Sulfur content, ppm by mass | | <1 | <10 | <10 |
| Nitrogen content, ppm by mass | | <3 | <3 | <3 |
| Kinematic viscosity (40° C.), $mm^2/s$ | | 15.78 | 15.88 | 15.92 |
| Kinematic viscosity (100° C.), $mm^2/s$ | | 3.85 | 3.87 | 3.89 |
| Viscosity index | | 140 | 142 | 142 |
| Density (15° C.), $g/cm^3$ | | 0.8190 | 0.8188 | 0.8181 |
| Pour point, ° C. | | −22.5 | −22.5 | −25 |
| Freezing point, ° C. | | −24 | −25 | −26 |
| Iodine value | | 0.06 | 0.03 | 0.04 |
| Aniline point, ° C. | | 117.9 | 119.1 | 119.2 |
| Distillation properties, ° C. | IBP, ° C. | 364 | 364 | 363 |
| | T10, ° C. | 400 | 401 | 403 |
| | T50, ° C. | 437 | 438 | 436 |
| | T90, ° C. | 468 | 465 | 460 |
| | FBP, ° C. | 492 | 490 | 487 |
| CCS viscosity (−35° C.), mPa · s | | 1,550 | 1,510 | 1,470 |
| MRV viscosity (−40° C.), mPa · s | 0.3% by mass Pour point depressant | 7,300 | 5,600 | 5,200 |
| | 0.5% by mass Pour point depressant | 6,900 | 5,350 | 5,000 |
| | 1.0% by mass Pour point depressant | 7,200 | 5,700 | 5,600 |

TABLE 5

| | | Base oil 1-4 | Base oil 1-5 | Base oil 1-6 |
|---|---|---|---|---|
| Feed stock oil | | WAX2 | WVGO | WVGO |
| Urea adduct value, % by mass | | 3.33 | 5.8 | 5.3 |
| Proportion of normal paraffin-derived components in urea adduct, % by mass | | 2.5 | 4.85 | 1.8 |
| Base oil composition (based on total base oil) | Saturated components, % by mass | 99.4 | 99.6 | 99.9 |
| | Aromatic components, % by mass | 0.5 | 0.3 | 0.1 |
| | Polar compound components, % by mass | 0.2 | 0.1 | 0 |
| Saturated components content (based on total saturated components) | Cyclic saturated components, % by mass | 12.5 | 49.9 | 45.6 |
| | Acyclic saturated components, % by mass | 87.5 | 50.1 | 54.4 |
| Acyclic saturated components contemt (based on total acyclic saturated components) | Normal paraffins, % by mass | 0 | 0.2 | 0.2 |
| | Isoparaffins, % by mass | 100 | 99.8 | 99.8 |
| Sulfur content, ppm by mass | | <10 | <1 | <1 |
| Nitrogen content, ppm by mass | | <3 | <1 | <3 |
| Kinematic viscosity (40° C.), $mm^2/s$ | | 9.88 | 13.48 | 19.91 |
| Kinematic viscosity (100° C.), $mm^2/s$ | | 2.79 | 3.272 | 4.302 |
| Viscosity index | | 130 | 111 | 125 |
| Density (15° C.), $g/cm^3$ | | 0.8092 | 0.8319 | 0.8351 |
| Pour point, ° C. | | −35 | −22.5 | −17.5 |
| Freezing point, ° C. | | −37 | −25 | −20 |
| Iodine value | | 0.08 | 0.18 | 0.05 |
| Aniline point, ° C. | | 113.1 | 108.9 | 116.0 |
| Distillation properties, ° C. | IBP, ° C. | 311 | 243 | 325 |
| | T10, ° C. | 350 | 312 | 383 |
| | T50, ° C. | 382 | 377 | 420 |
| | T90, ° C. | 405 | 418 | 457 |
| | FBP, ° C. | 423 | 493 | 495 |

TABLE 5-continued

| | | Base oil 1-4 | Base oil 1-5 | Base oil 1-6 |
|---|---|---|---|---|
| CCS viscosity (−35° C.), mPa · s | | 1,610 | 770 | 3,000 |
| MRV viscosity (−40° C.), mPa · s | 0.3% by mass Pour point depressant | <5,000 | — | 13,200 |
| | 0.5% by mass Pour point depressant | <5,000 | — | 14,300 |
| | 1.0% by mass Pour point depressant | <5,000 | — | 14,000 |

<Preparation of Lubricating Oil Compositions>

For Examples 1-1 to 1-4 and Comparative Examples 1-1 to 1-3 there were prepared lubricating oil compositions having the compositions shown in Tables 6 and 7, using base oils 1-1 to 1-5 mentioned above and the following additives. The conditions for preparation of each lubricating oil composition were for a HTHS viscosity at 150° C. in the range of 2.55-2.65. The properties of the obtained lubricating oil compositions are shown in Tables 6 and 7.

(Additives)

PK: Additive package (containing metal-based detergent (Ca salicylate, Ca: 2000 ppm), ashless dispersant (borated polybutenylsucciniimide), antioxidants (phenol-based, amine-based), anti-wear agent (zinc alkylphosphate, P: 800 ppm), ester-based ashless friction modifier, urea-based ashless friction modifier, pour point depressant, antifoaming agent and other components).

MoDTC: Molybdenum dithiocarbamate.

VM-1: Dispersed polymethacrylate-based additive with PSSI=45, $M_W$=400,000, $M_W/M_n$=5.5, $M_W$/PSSI=0.88×$10^4$ (copolymer obtained by polymerizing a mixture of dimethylaminoethyl methacrylate and alkyl methacrylates (alkyl groups: methyl, C12-15 straight-chain alkyl groups) as the main structural unit).

VM-2: Dispersed polymethacrylate-based additive with PSSI=40, $M_W$=300,000, $M_W$/PSSI=0.75×$10^4$ (copolymer obtained by polymerizing a mixture of dimethylaminoethyl methacrylate and alkyl methacrylates (alkyl groups: methyl, C12-15 straight-chain alkyl groups) as the main structural unit).

VM-3: Non-dispersed polymethacrylate-based additive with PSSI=20, $M_W$=400,000, $M_W$/PSSI=2×$10^4$ (copolymer obtained by polymerizing 90% by mole of a mixture of alkyl methacrylates (alkyl groups: methyl, C12-15 straight-chain alkyl groups, C16-20 straight-chain alkyl groups) and 10% by mole of alkyl methacrylates having C22 branched alkyl groups, as the main structural unit).

[Evaluation of Lubricating Oil Composition]

Each of the lubricating oil compositions of Examples 1-1 to 1-4 and Comparative Examples 1-1 to 1-3 were measured for kinematic viscosity at 40° C. or 100° C., viscosity index, NOACK evaporation (1 h, 250° C.), HTHS viscosity at 150° C. or 100° C., CCS viscosity at −35° C. and MRV viscosity at −40° C. The physical property values were measured by the following evaluation methods. The obtained results are shown in Tables 5 and 6.

(1) Kinematic viscosity: ASTM D-445

(2) HTHS viscosity: ASTM D4683

(3) NOACK evaporation: ASTM D 5800

(4) CCS viscosity: ASTM D5293

(5) MRV viscosity: ASTM D3829

TABLE 6

| | | | Example 1-1 | Example 1-2 | Example 1-3 | Example 1-4 |
|---|---|---|---|---|---|---|
| Base oil | Base oil 1-1 | % by mass | — | — | 72 | — |
| | Base oil 1-2 | % by mass | 72 | 72 | — | — |
| | Base oil 1-3 | % by mass | — | — | — | 72 |
| | Base oil 1-4 | % by mass | 28 | 28 | 28 | 28 |
| | Base oil 1-5 | % by mass | — | — | — | — |
| | Base oil 1-6 | % by mass | — | — | — | — |
| Mixed base oil properties | Kinematic viscosity (40° C.) | $mm^2/s$ | 13.22 | 13.22 | 13.74 | 13.82 |
| | Kinematic viscosity (100° C.) | $mm^2/s$ | 3.412 | 3.412 | 3.500 | 3.530 |
| | Viscosity index | | 138 | 138 | 138 | 140 |
| | NOACK evaporation (1 h, 250° C.) | % by mass | 22.41 | 22.41 | 22.50 | 21.60 |
| | IBP | ° C. | 319.5 | 319.5 | 318.2 | 320.5 |
| | T10 | ° C. | 376.0 | 376.0 | 375.5 | 377.1 |
| | T50 | ° C. | 422.3 | 422.3 | 421.9 | 422.8 |
| | T90 | ° C. | 454.0 | 454.0 | 453.8 | 454.1 |
| | FBP | ° C. | 480.4 | 480.4 | 480.1 | 480.6 |
| | T90 − T10 | ° C. | 78 | 78 | 78.3 | 77 |
| Lubricating oil composition | Base oil | % by mass | remainder | remainder | remainder | remainder |
| | PK | % by mass | 10 | 10 | 10 | 10 |
| | MoDTC | % by mass | 0.69 | 0.69 | 0.69 | 0.69 |
| | VM-1 | % by mass | — | — | — | — |
| | VM-2 | % by mass | — | 7.21 | — | — |
| | VM-3 | % by mass | 12.85 | — | 12.85 | 12.85 |
| Lubricating oil composition properties | Kinematic viscosity (40° C.) | $mm^2/s$ | 26.69 | 34.21 | 27.08 | 27.11 |
| | Kinematic viscosity (100° C.) | $mm^2/s$ | 7.49 | 9.08 | 7.52 | 7.56 |
| | Viscosity index | | 272 | 264 | 269 | 271 |
| | NOACK evaporation | % by mass | 18 | 19 | 18 | 18 |

TABLE 6-continued

| | | | Example 1-1 | Example 1-2 | Example 1-3 | Example 1-4 |
|---|---|---|---|---|---|---|
| | (1 h, 250° C.) | | | | | |
| | HTHS viscosity (100° C.) | mPa · s | 4.39 | 4.98 | 4.41 | 4.38 |
| | HTHS viscosity (150° C.) | mPa · s | 2.60 | 2.60 | 2.60 | 2.60 |
| | HTHS (100° C.)/ HTHS (150° C.) | | 1.69 | 1.92 | 1.70 | 1.68 |
| | CCS viscosity (−35° C.) | mPa · s | 2100 | 2300 | 2200 | 2000 |
| | MRV viscosity (−40° C.) | mPa · s | 4300 | 5700 | 4500 | 4100 |

TABLE 7

| | | | Comp. Ex. 1-1 | Comp. Ex. 1-2 | Comp. Ex. 1-3 |
|---|---|---|---|---|---|
| Base oil | Base oil 1-1 | % by mass | — | — | — |
| | Base oil 1-2 | % by mass | 100 | — | — |
| | Base oil 1-3 | % by mass | — | — | — |
| | Base oil 1-4 | % by mass | — | — | — |
| | Base oil 1-5 | % by mass | — | 12 | 12 |
| | Base oil 1-6 | % by mass | — | 88 | 88 |
| Mixed base oil properties | Kinematic viscosity (40° C.) | $mm^2/s$ | 15.80 | 16.68 | 16.68 |
| | Kinematic viscosity (100° C.) | $mm^2/s$ | 3.867 | 3.822 | 3.822 |
| | Viscosity index | | 143 | 122 | 122 |
| | NOACK evaporation (1 h, 250° C.) | % by mass | 14.80 | 22.54 | 22.54 |
| | IBP | ° C. | 364 | 250 | 250 |
| | T10 | ° C. | 401 | 360 | 360 |
| | T50 | ° C. | 438 | 410 | 410 |
| | T90 | ° C. | 465 | 455 | 455 |
| | FBP | ° C. | 490 | 498 | 498 |
| | T90 − T10 | ° C. | 64 | 95 | 95 |
| Lubricating oil composition | Base oil | % by mass | remainder | remainder | remainder |
| | PK | % by mass | 10 | 10 | 10 |
| | MoDTC | % by mass | 0.69 | 0.69 | 0.69 |
| | VM-1 | % by mass | — | — | 5.067 |
| | VM-2 | % by mass | — | — | — |
| | VM-3 | % by mass | 11.78 | 10.00 | — |
| Lubricating oil composition properties | Kinematic viscosity (40° C.) | $mm^2/s$ | 28.84 | 31.12 | 39.17 |
| | Kinematic viscosity (100° C.) | $mm^2/s$ | 7.48 | 7.52 | 8.645 |
| | Viscosity index | | 234 | 224 | 208 |
| | NOACK evaporation (1 h, 250° C.) | % by mass | 12 | 18 | 18 |
| | HTHS viscosity (100° C.) | mPa · s | 4.52 | 4.72 | 5.34 |
| | HTHS viscosity (150° C.) | mPa · s | 2.60 | 2.59 | 2.60 |
| | HTHS (100° C.)/HTHS (150° C.) | | 1.74 | 1.82 | 2.05 |
| | CCS viscosity (−35° C.) | mPa · s | 2700 | 5000 | 6000 |
| | MRV viscosity (−40° C.) | mPa · s | 8700 | 20600 | 23000 |

As shown in Tables 6 and 7, the lubricating oil compositions of Examples 1-1 to 1-4 and Comparative Examples 1-1 to 1-3 had approximately equivalent HTHS viscosities at 150° C., but the lubricating oil compositions of Examples 1-1 to 1-4 had lower kinematic viscosities at 40° C., kinematic viscosities at 100° C., HTHS viscosities at 100° C. and CCS viscosities, and thus more satisfactory low-temperature viscosities and viscosity-temperature characteristics, than the lubricating oil compositions of Comparative Examples 1-1 to 1-3. These results demonstrate that the first lubricating oil composition is a lubricating oil composition that has excellent fuel efficiency and low-temperature viscosity, and can exhibit both fuel efficiency and low-temperature viscosity of not higher than −35° C. while maintaining high-temperature high-shear viscosity at 150° C., even without using a synthetic oil such as a poly-α-olefinic base oil or esteric base oil, or a low-viscosity mineral base oil, and in particular it can reduce the kinematic viscosity at 40° C. and 100° C., increase the viscosity index and notably improve the CCS viscosity at −35° C. of lubricating oils.

Examples 2-1 to 2-7, Comparative Examples 2-1 to 2-5

<Production of Lubricating Base Oils>

WAX1, WAX2 and WAX3 mentioned above were used as feed stock oils for hydrotreatment with a hydrotreatment catalyst. The reaction temperature and liquid space velocity were modified for a feed stock oil cracking severity of at least 5% by mass and a sulfur content of not greater than 10 ppm by mass in the oil to be treated. Here, a "feed stock oil cracking severity of at least 5% by mass" means that the proportion of the fraction lighter than the initial boiling point of the feed stock oil in the oil to be treated is at least 5% by mass with respect to the total feed stock oil amount, and this is confirmed by gas chromatography distillation.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the light and heavy portions were separated by distillation to obtain lubricating base oils 2-1-1 to 2-1-3, 2-2-1 and 2-2-2 having the composition and properties shown in Tables 8 and 9. In Tables 8 and 9, the row headed "Proportion of normal paraffin-derived components in urea adduct" means the values obtained by gas chromatography of the urea adduct obtained during measurement of the urea adduct value (same hereunder).

Also, base oil 2-3 and base oil 2-4 were prepared having the compositions and properties shown in Table 10, as conventional lubricating base oils.

A polymethacrylate-based pour point depressant (weight-average molecular weight: approximately 60,000) commonly used in automobile lubricating oils was added to the lubricating base oils listed in Tables 8 and 10. The pour point depressant was added in three different amounts of 0.3% by mass, 0.5% by mass and 1.0% by mass, based on the total amount of the composition. The MRV viscosity at −40° C. of each of the obtained lubricating oil compositions was then measured, and the obtained results are shown in Tables 8 and 10. These results demonstrated that the lubricating base oil of the invention exhibits excellent low-temperature characteristics and viscosity-temperature characteristics, while also having especially excellent MRV viscosity at −40° C. when a pour point depressant is added.

TABLE 8

| | | Base oil 2-1-1 | Base oil 2-1-2 | Base oil 2-1-3 |
|---|---|---|---|---|
| Feed stock oil | | WAX1 | WAX2 | WAX3 |
| Urea adduct value, % by mass | | 1.25 | 3.8 | 1.18 |
| Proportion of normal paraffin-derived components in urea adduct, % by mass | | 2.4 | 2.5 | 2.5 |
| Base oil composition (based on total base oil) | Saturated components, % by mass | 99.8 | 99.6 | 99.6 |
| | Aromatic components, % by mass | 0.1 | 0.3 | 0.2 |
| | Polar compound components, % by mass | 0.1 | 0.1 | 0.2 |
| Saturated components content (based on total saturated components) | Cyclic saturated components, % by mass | 11.5 | 10.3 | 10.2 |
| | Acyclic saturated components, % by mass | 88.5 | 89.7 | 89.8 |
| Acyclic saturated components content (based on total acyclic saturated components) | Normal paraffins, % by mass | 0 | 0 | 0 |
| | Isoparaffins, % by mass | 100 | 100 | 100 |
| Sulfur content, ppm by mass | | <1 | <10 | <10 |
| Nitrogen content, ppm by mass | | <3 | <3 | <3 |
| Kinematic viscosity (40° C.), $mm^2/s$ | | 15.80 | 16.25 | 15.92 |
| Kinematic viscosity (100° C.), $mm^2/s$ | | 3.854 | 3.92 | 3.900 |
| Viscosity index | | 141 | 142 | 142 |
| Density (15° C.), $g/cm^3$ | | 0.8195 | 0.8188 | 0.8170 |
| Pour point, ° C. | | −22.5 | −22.5 | −22.5 |
| Freezing point, ° C. | | −26 | −25 | −24 |
| Iodine value | | 0.06 | 0.05 | 0.04 |
| Aniline point, ° C. | | 118.5 | 119.2 | 119.0 |
| Distillation properties, ° C. | IBP, ° C. | 362 | 368 | 361 |
| | T10, ° C. | 401 | 402 | 399 |
| | T50, ° C. | 437 | 438 | 435 |
| | T90, ° C. | 464 | 467 | 461 |
| | FBP, ° C. | 489 | 491 | 490 |
| CCS viscosity (−35° C.), mPa · s | | 1,450 | 1,510 | 1,480 |
| BF viscosity (−40° C.), mPa · s | | — | >1,000,000 | 882,000 |
| MRV viscosity (−40° C.), mPa · s | 0.3% by mass Pour point depressant | 5,700 | 7,500 | 6,200 |
| | 0.5% by mass Pour point depressant | 5,750 | 7,100 | 6,000 |
| | 1.0% by mass Pour point depressant | 6,000 | 7,900 | 6,700 |

TABLE 9

| | | Base oil 2-2-1 | Base oil 2-2-2 |
|---|---|---|---|
| Feed stock oil | | WAX1 | WAX3 |
| Urea adduct value, % by mass | | 0.55 | 0.45 |
| Proportion of normal paraffin-derived components in urea adduct, % by mass | | 0.5 | 0.3 |
| Base oil composition (based on total base oil) | Saturated components, % by mass | 99.5 | 99.6 |
| | Aromatic components, % by mass | 0.2 | 0.2 |
| | Polar compound components, % by mass | 0.3 | 0.2 |

TABLE 9-continued

| | | Base oil 2-2-1 | Base oil 2-2-2 |
|---|---|---|---|
| Saturated components content (based on total saturated components) | Cyclic saturated components, % by mass | 20.0 | 16.8 |
| | Acyclic saturated components, % by mass | 80.0 | 83.2 |
| Acyclic saturated components content (based on total acyclic saturated components) | Normal paraffins, % by mass | 0 | 0 |
| | Isoparaffins, % by mass | 100 | 100 |
| Sulfur content, ppm by mass | | <1 | <1 |
| Nitrogen content, ppm by mass | | <3 | <3 |
| Kinematic viscosity (40° C.), $mm^2/s$ | | 30.83 | 32.2 |
| Kinematic viscosity (100° C.), $mm^2/s$ | | 6.072 | 6.60 |
| Viscosity index | | 148 | 161 |
| Density (15° C.), $g/cm^3$ | | 0.8260 | 0.8254 |
| Pour point, ° C. | | −20 | −12.5 |
| Freezing point, ° C. | | −21 | −14 |
| Iodine value | | 0.02 | 0.02 |
| Aniline point, ° C. | | 128.5 | 131.2 |
| Distillation properties, ° C. | IBP, ° C. | 418.5 | 433.1 |
| | T10, ° C. | 462.8 | 467.2 |
| | T50, ° C. | 495.2 | 493.3 |
| | T90, ° C. | 520.8 | 519.4 |
| | FBP, ° C. | 545.5 | 543.9 |
| CCS viscosity (−35° C.), mPa · s | | 5,200 | 3,600 |
| BF viscosity (−40° C.), mPa · s | | >1,000,000 | >1,000,000 |
| MRV viscosity (−40° C.), mPa · s | 0.3% by mass Pour point depressant | — | — |
| | 0.5% by mass Pour point depressant | — | — |
| | 1.0% by mass Pour point depressant | — | — |

TABLE 10

| | | Base oil 2-3 | Base oil 2-4 |
|---|---|---|---|
| Feed stock oil | | — | — |
| Urea adduct value, % by mass | | 6.12 | 7.55 |
| Proportion of normal paraffin-derived components in urea adduct, % by mass | | 2.33 | 2.25 |
| Base oil composition (based on total base oil) | Saturated components, % by mass | 99.5 | 99.9 |
| | Aromatic components, % by mass | 0.4 | 0.1 |
| | Polar compound components, % by mass | 0.1 | 0 |
| Saturated components content (based on total saturated components) | Cyclic saturated components, % by mass | 46.5 | 45.1 |
| | Acyclic saturated components, % by mass | 53.5 | 54.9 |
| Acyclic saturated components content (based on total acyclic saturated components) | Normal paraffins, % by mass | 0.1 | 0.1 |
| | Isoparaffins, % by mass | 53.1 | 54.7 |
| Sulfur content, ppm by mass | | <1 | <1 |
| Nitrogen content, ppm by mass | | <3 | <3 |
| Kinematic viscosity (40° C.), $mm^2/s$ | | 34.63 | 19.50 |
| Kinematic viscosity (100° C.), $mm^2/s$ | | 6.303 | 4.282 |
| Viscosity index | | 134 | 127 |
| Density (15° C.), $g/cm^3$ | | 0.8403 | 0.8350 |
| Pour point, ° C. | | −12.5 | −17.5 |
| Freezing point, ° C. | | −13 | −20 |
| Iodine value | | 0.02 | 0.05 |
| Aniline point, ° C. | | 125.1 | 116.0 |
| Distillation properties, ° C. | IBP, ° C. | 312 | 310 |
| | T10, ° C. | 425 | 390 |
| | T50, ° C. | 473 | 430 |
| | T90, ° C. | 529 | 461 |
| | FBP, ° C. | 585 | 510 |

TABLE 10-continued

| | | Base oil 2-3 | Base oil 2-4 |
|---|---|---|---|
| CCS viscosity (−35° C.), mPa · s | | 19,200 | 6,800 |
| BF viscosity (−40° C.), mPa · s | | — | — |
| MRV viscosity (−40° C.), mPa · s | 0.3% by mass Pour point depressant | — | 40,200 |
| | 0.5% by mass Pour point depressant | — | 38,000 |
| | 1.0% by mass Pour point depressant | — | 43,000 |

<Preparation of Lubricating Oil Compositions>

For each of Examples 2-1 to 2-7, one of base oils 2-1-1 to 2-1-3 was blended with one of base oils 2-2-1 to 2-2-2 for the compositions shown in Tables 11 and 12, and the following additives were added to the mixed base oils to prepare SAE0W-30 grade lubricating oil compositions having the compositions shown in Tables 11 and 12. For each of Comparative Examples 2-1 to 2-5, base oil 2-1-1 or 2-2-1 was blended with base oil 2-3 or 2-4 for the compositions shown in Table 13, and the following additives were added to the mixed base oils to prepare lubricating oil compositions having the compositions shown in Table 13. The properties of the obtained lubricating oil compositions are shown in Tables 11 to 13.

(Ashless Antioxidants Containing No Sulfur as a Constituent Element)

A1: Alkyldiphenylamine

A2: Octyl-3-(3,5-di-tert-butyl-4-hydroxyphenyl)propionate (Ashless Antioxidants Containing Sulfur as a Constituent Element and Organic Molybdenum Compound)

B1: Ashless dithiocarbamate (sulfur content: 29.4% by mass)

B2: Molybdenum ditridecylamine complex (molybdenum content: 10.0% by mass)

(Anti-wear Agents)

C1: Dioctylzinc phosphate (phosphorus content: 8.8% by mass)

C2: Zinc dialkyldithiophosphate (phosphorus content: 7.2% by mass, alkyl group: mixture of secondary butyl group or secondary hexyl group)

(Ashless Dispersant)

D1: Polybutenylsucciniimide (bis type, weight-average molecular weight: 8,500, nitrogen content: 0.65% by mass)

(Ashless Friction Modifier)

E1: Glycerin fatty acid ester (trade name: MO50 by Kao Corp.)

(Other Additives)

F1: Package containing metal-based detergent, viscosity index improver, pour point depressant and antifoaming agent.

<Frictional Property Evaluation Test I>

The lubricating oil compositions of Examples 1-7 and Comparative Examples 1-5 were measured for frictional coefficient between a steel ball and disk, using a reciprocating friction tester. The test conditions were a load of 50N, a temperature of 80° C., a stroke of 1 mm, a test time of 30 minutes and a frequency of 50 Hz, and the data were recorded in a computer per second. The frictional coefficient was calculated by dividing the friction force obtained during the test time, by the load. The results are shown in Tables 7 to 9.

[Frictional Property Evaluation Test II]

The lubricating oil compositions of Examples 1-7 and Comparative Examples 1-5 were measured for frictional coefficient at room temperature, under conditions with a slip factor of 50% and a contact pressure of 0.50 GPa. The results are shown in Tables 7 to 9. The tester used was a Mini Traction Machine by PCS Instruments.

TABLE 11

| | | Example 2-1 | Example 2-2 | Example 2-3 | Example 2-4 |
|---|---|---|---|---|---|
| Lubricating base oil (% by mass) | Base oil 2-1-1 | 70 | 70 | 70 | — |
| | Base oil 2-1-2 | — | — | — | 70 |
| | Base oil 2-1-3 | — | — | — | — |
| | Base oil 2-2-1 | 30 | — | 30 | 30 |
| | Base oil 2-2-2 | — | 30 | — | — |
| Physical properties of mixed base oil | Kinematic viscosity (40° C.), $mm^2/s$ | 19.86 | 19.28 | 19.86 | 19.17 |
| | Kinematic viscosity (100° C.), $mm^2/s$ | 4.520 | 4.402 | 4.520 | 4.419 |
| | Viscosity index | 147 | 143 | 147 | 147 |
| | Distillation properties | | | | |
| | IBP, ° C. | 374.3 | 374.5 | 374.3 | 374.3 |
| | T5, ° C. | 395.6 | 396.4 | 395.6 | 395.4 |
| | T10, ° C. | 405.7 | 405.8 | 405.7 | 405.2 |
| | T50, ° C. | 443.3 | 443.4 | 443.3 | 443.1 |
| | T90, ° C. | 496.6 | 486.0 | 496.6 | 496.2 |
| | FBP, ° C. | 562.2 | 532.4 | 562.2 | 561.8 |
| Lubricating oil composition (% by mass) | Base oil | remainder | remainder | remainder | remainder |
| | A1 | 1.0 | 1.0 | 1.0 | 1.0 |
| | B1 | — | — | 0.3 | — |
| | B2 (as Mo) | 0.01 | 0.01 | — | 0.01 |
| | C1 | 1.0 | — | — | — |
| | C2 | | 1.0 | 1.0 | 1.0 |

TABLE 11-continued

| | | Example 2-1 | Example 2-2 | Example 2-3 | Example 2-4 |
|---|---|---|---|---|---|
| | D1 | 4.0 | 4.0 | 4.0 | 4.0 |
| | E1 | 4.0 | 4.0 | 4.0 | 4.0 |
| | F1 | 8.0 | 8.0 | 8.0 | 8.0 |
| Physical properties of lubricating oil composition | Sulfur content, % by mass | 0.01 | 0.14 | 0.91 | 0.14 |
| | Phosphorus content, % by mass | 0.08 | 0.07 | 0.07 | 0.07 |
| | Kinematic viscosity (100° C.), $mm^2/s$ | 10.23 | 10.99 | 10.28 | 10.18 |
| | Acid number, mgKOH/g | 2.4 | 2.4 | 2.3 | 2.4 |
| | Base number, moKOH/g | 5.9 | 5.9 | 5.8 | 5.9 |
| | CCS viscosity (−35° C.), mPa · s | 5,350 | 5,500 | 5,400 | 5,800 |
| | MRV viscosity (−40° C.), mPa · s | 17,000 | 17,800 | 16,800 | 18,300 |
| | Frictional properties I | 0.085 | 0.078 | 0.082 | 0.080 |
| | Frictional properties II | 0.025 | 0.022 | 0.025 | 0.020 |

TABLE 12

| | | Example 2-5 | Example 2-6 | Example 2-7 |
|---|---|---|---|---|
| Lubricating base oil (% by mass) | Base oil 2-1-1 | — | — | — |
| | Base oil 2-1-2 | 70 | 70 | — |
| | Base oil 2-1-3 | — | — | 70 |
| | Base oil 2-2-1 | — | — | — |
| | Base oil 2-2-2 | 30 | 30 | 30 |
| Physical properties of mixed base oil | Kinematic viscosity (40° C.), $mm^2/s$ | 19.26 | 19.26 | 16.68 |
| | Kinematic viscosity (100° C.), $mm^2/s$ | 4.485 | 4.485 | 4.53 |
| | Viscosity index | 152 | 152 | 150 |
| | Distillation properties | | | |
| | IBP, ° C. | 374.5 | 374.5 | 374.5 |
| | T5, ° C. | 396.3 | 396.3 | 396.2 |
| | T10,° C. | 406.0 | 406.0 | 406.1 |
| | T50, ° C. | 443.5 | 443.5 | 443.3 |
| | T90, ° C. | 485.8 | 485.8 | 485.2 |
| | FBP, ° C. | 533.8 | 533.8 | 534.2 |
| Lubricating oil composition (% by mass) | Base oil | remainder | remainder | remainder |
| | A1 | 1.0 | 1.0 | 1.0 |
| | B1 | — | 0.3 | — |
| | B2 (as Mo) | 0.01 | — | 0.01 |
| | C1 | 1.0 | 1.0 | — |
| | C2 | — | — | 1.0 |
| | D1 | 4.0 | 4.0 | 4.0 |
| | E1 | 4.0 | 4.0 | 4.0 |
| | F1 | 8.0 | 8.0 | 8.0 |
| Physical properties of lubricating oil composition | Sulfur content, % by mass | 0.01 | 0.87 | 0.14 |
| | Phosphorus content, % by mass | 0.08 | 0.08 | 0.07 |
| | Kinematic viscosity (100° C.), $mm^2/s$ | 10.59 | 10.20 | 10.14 |
| | Acid number, mgKOH/g | 2.4 | 2.3 | 2.3 |
| | Base number, moKOH/g | 5.9 | 5.8 | 5.8 |
| | CCS viscosity (−35° C.), mPa · s | 6,500 | 6,700 | 7,300 |
| | MRV viscosity (−40° C.), mPa · s | 20,300 | 20,900 | 22,000 |
| | Frictional properties I | 0.072 | 0.077 | 0.74 |
| | Frictional properties II | 0.018 | 0.019 | 0.19 |

TABLE 13

| | | Comp. Ex. 2-1 | Comp. Ex. 2-2 | Comp. Ex. 2-3 | Comp. Ex. 2-4 | Comp. Ex. 2-5 |
|---|---|---|---|---|---|---|
| Lubricating base oil (% by mass) | Base oil 2-1-1 | 70 | 70 | — | — | — |
| | Base oil 2-2-1 | — | — | 30 | 30 | — |
| | Base oil 2-3 | 30 | 30 | — | — | 30 |
| | Base oil 2-4 | — | — | 70 | 70 | 70 |
| Physical properties of mixed base oil | Kinematic viscosity (40° C.), $mm^2/s$ | 19.89 | 19.89 | 21.48 | 21.48 | 22.25 |
| | Kinematic viscosity (100° C.), $mm^2/s$ | 4.457 | 4.457 | 4.587 | 4.587 | 4.638 |
| | Viscosity index | 140 | 140 | 132 | 132 | 127 |
| | Distillation properties | | | | | |
| | IBP, ° C. | 372.9 | 372.9 | 323.6 | 323.6 | 322.2 |
| | T5, ° C. | 396.9 | 396.9 | 377.1 | 377.1 | 375.2 |
| | T10, ° C. | 406.8 | 406.8 | 391.2 | 391.2 | 389.5 |

TABLE 13-continued

| | | Comp. Ex. 2-1 | Comp. Ex. 2-2 | Comp. Ex. 2-3 | Comp. Ex. 2-4 | Comp. Ex. 2-5 |
|---|---|---|---|---|---|---|
| | T50, ° C. | 441.3 | 441.3 | 445.0 | 445.0 | 441.7 |
| | T90, ° C. | 483.8 | 483.8 | 498.6 | 498.6 | 496.3 |
| | FBP, ° C. | 533.2 | 533.2 | 558.9 | 558.9 | 552.1 |
| Lubricating oil composition (% by mass) | Base oil | remainder | remainder | remainder | remainder | remainder |
| | A1 | 1.0 | 1.0 | 1.0 | 1.0 | 1.0 |
| | B1 | — | 0.3 | — | 0.3 | — |
| | B2 (as Mo) | 0.01 | — | 0.01 | — | 0.01 |
| | C1 | 1.0 | — | — | 1.0 | 1.0 |
| | C2 | — | 1.0 | 1.0 | — | — |
| | D1 | 4.0 | 4.0 | 4.0 | 4.0 | 4.0 |
| | E1 | 4.0 | 4.0 | 4.0 | 4.0 | 4.0 |
| | F1 | 8.0 | 8.0 | 8.0 | 8.0 | 8.0 |
| Physical properties of lubricating oil composition | Sulfur content, % by mass | 0.02 | 0.91 | 0.14 | 0.80 | 0.14 |
| | Phosphorus content, % by mass | 0.08 | 0.07 | 0.07 | 0.08 | 0.08 |
| | Kinematic viscosity (100° C.), $mm^2/s$ | 10.2 | 10.2 | 10.4 | 10.4 | 10.1 |
| | Acid number, mgKOH/g | 2.0 | 2.0 | 2.0 | 2.0 | 2.0 |
| | Base number, moKOH/g | 7.2 | 7.2 | 7.2 | 7.2 | 7.2 |
| | CCS viscosity (−35° C.), mPa · s | 5,900 | 6,000 | 6,300 | 6,200 | 7,800 |
| | MRV viscosity (−40° C.), mPa · s | 14,000 | 14,200 | 16,500 | 15,900 | 24,700 |
| | Frictional properties I | 0.098 | 0.097 | 0.095 | 0.093 | 0.108 |
| | Frictional properties II | 0.036 | 0.036 | 0.034 | 0.034 | 0.042 |

Examples 3-1 to 3-3, Comparative Examples 3-1 to 3-10

<Production of Base Oil 3-1>

WAX1 was used as the feed stock oil for hydrotreatment with a hydrotreatment catalyst. The reaction temperature and liquid space velocity were modified for a feed stock oil cracking severity of at least 5% by mass and a sulfur content of not greater than 10 ppm by mass in the oil to be treated. Here, a "feed stock oil cracking severity of at least 5% by mass" means that the proportion of the fraction lighter than the initial boiling point of the feed stock oil in the oil to be treated is at least 5% by mass with respect to the total feed stock oil amount, and this is confirmed by gas chromatography distillation.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the light and heavy portions were separated by distillation to obtain a lubricating base oil (base oil 3-1) having the composition and properties shown in Table 14. In Table 14, the row headed "Proportion of normal paraffin-derived components in urea adduct" contains the values obtained by gas chromatography of the urea adduct obtained during measurement of the urea adduct value (same hereunder).

<Production of Base Oil 3-2>

Hydrotreatment, hydrodewaxing, hydrorefining and distillation were carried out in the same manner as for base oil 3-1, except for using WAX3 instead of WAX1, to obtain a lubricating base oil (base oil 3-2) having the composition and properties listed in Table 14.

<Production of Base Oil 3-3>

Hydrotreatment, hydrodewaxing, hydrorefining and distillation were carried out in the same manner as for base oil 3-1, except for using WAX2 instead of WAX1, to obtain a lubricating base oil (base oil 3-3) having the composition and properties listed in Table 14.

<Production of Base Oil 3-4>

A lubricating base oil having the composition and properties shown in Table 15 was produced in the same manner as base oil 3-2, except that the hydrodewaxing temperature was changed to 300° C. or higher and below 315° C.

<Base oil 3-5>

Also, a lubricating base oil was prepared having the composition and properties shown in Table 15, as a conventional lubricating base oil.

TABLE 14

| | | Example base oil | | |
|---|---|---|---|---|
| | | Base oil 3-1 | Base oil 3-2 | Base oil 3-3 |
| Feed stock oil | | WAX1 | WAX3 | WAX2 |
| Urea adduct value, % by mass | | 1.55 | 1.28 | 3.88 |
| Proportion of normal paraffin-derived components in urea adduct, % by mass | | 2.2 | 2.1 | 2.9 |
| Base oil composition (based on total base oil) | Saturated components, % by mass | 99.7 | 99.8 | 99.8 |
| | Aromatic content, % by mass | 0.1 | 0.1 | 0.2 |
| | Polar compound components, % by mass | 0.2 | 0.1 | 0.0 |
| Saturated components content (based on total saturated components) | Cyclic saturated components, % by mass | 11.3 | 10.9 | 9.2 |
| | Acyclic saturated components, % by mass | 88.7 | 89.1 | 90.8 |

TABLE 14-continued

| | | Example base oil | | |
|---|---|---|---|---|
| | | Base oil 3-1 | Base oil 3-2 | Base oil 3-3 |
| Acyclic saturated components content (based on total acyclic saturated components) | Normal paraffins, % by mass | 0 | 0 | 0 |
| | Isoparaffins, % by mass | 100 | 100 | 100 |
| Sulfur content, ppm by mass | | <1 | <10 | <10 |
| Nitrogen content, ppm by mass | | <3 | <3 | <3 |
| Kinematic viscosity (40° C.), $mm^2/s$ | | 15.92 | 15.53 | 16.60 |
| Kinematic viscosity (100° C.), $mm^2/s$ | | 3.855 | 3.851 | 3.949 |
| Viscosity index | | 141 | 143 | 145 |
| Density (15° C.), $g/cm^3$ | | 0.8190 | 0.8185 | 0.8183 |
| Pour point, ° C. | | −25 | −25 | −17.5 |
| Freezing point, ° C. | | −26 | −27 | −19 |
| Iodine value | | 0.08 | 0.02 | 0.04 |
| Aniline point, ° C. | | 119.2 | 119.5 | 119.9 |
| Distillation properties, ° C. | IBP, ° C. | 363 | 365 | 368 |
| | T10, ° C. | 402 | 400 | 404 |
| | T50, ° C. | 440 | 442 | 445 |
| | T90, ° C. | 468 | 460 | 472 |
| | FBP, ° C. | 488 | 489 | 491 |
| CCS viscosity (−35° C.), mPa · s | | 1,550 | 1,450 | 1,820 |
| MRV viscosity (−40° C.), mPa · s | 0.3% by mass Pour point depressant | 6,100 | 5,200 | 7,300 |
| | 0.5% by mass Pour point depressant | 6,600 | 5,000 | 7,100 |
| | 1.0% by mass Pour point depressant | 7,000 | 5,700 | 8,500 |

TABLE 15

| | | Comparative example base oil | |
|---|---|---|---|
| | | Base oil 3-4 | Base oil 3-5 |
| Feed stock oil | | WAX3 | — |
| Urea adduct value, % by mass | | 4.38 | 5.22 |
| Proportion of normal paraffin-derived components in urea adduct, % by mass | | 2.6 | 1.2 |
| Base oil composition (based on total base oil) | Saturated components, % by mass | 99.1 | 99.9 |
| | Aromatic components, % by mass | 0.6 | 0.1 |
| | Polar compound components, % by mass | 0.3 | 0 |
| Saturated components content (based on total saturated components) | Cyclic saturated components, % by mass | 12.5 | 45.2 |
| | Acyclic saturated components, % by mass | 87.5 | 54.8 |
| Acyclic saturated components content (based on total acyclic saturated components) | Normal paraffins, % by mass | 0.3 | 0.2 |
| | Isoparaffins, % by mass | 99.7 | 99.8 |
| Sulfur content, ppm by mass | | <1 | <1 |
| Nitrogen content, ppm by mass | | <3 | <3 |
| Kinematic viscosity (40° C.), $mm^2/s$ | | 16.12 | 19.95 |
| Kinematic viscosity (100° C.), $mm^2/s$ | | 3.923 | 4.302 |
| Viscosity index | | 141 | 125 |
| Density (15° C.), $g/cm^3$ | | 0.8172 | 0.8353 |
| Pour point, ° C. | | −22.5 | −17.5 |
| Freezing point, ° C. | | −24 | −19 |
| Iodine value | | 0.09 | 0.08 |
| Aniline point, ° C. | | 119.9 | 118.0 |
| n-d-M Ring analysis | % $C_P$ | unmeasured | 78.0 |
| | % $C_N$ | unmeasured | 20.5 |
| | % $C_A$ | unmeasured | 1.5 |
| Distillation properties, ° C. | IBP, ° C. | 360.2 | 318 |
| | T10, ° C. | 393.8 | 394 |
| | T50, ° C. | 443.8 | 428 |
| | T90, ° C. | 465.8 | 460 |
| | FBP, ° C. | 485.9 | 508 |

TABLE 15-continued

| | | Comparative example base oil | |
|---|---|---|---|
| | | Base oil 3-4 | Base oil 3-5 |
| CCS viscosity (−35° C.), mPa · s | | 3,900 | 3,200 |
| MRV viscosity (−40° C.), mPa · s | 0.3% by mass Pour point depressant | 14,900 | 12,500 |
| | 0.5% by mass Pour point depressant | 14,100 | 13,300 |
| | 1.0% by mass Pour point depressant | 14,600 | 13,700 |

<Preparation of Lubricating Oil Compositions>

For Examples 3-1 to 3-3 and Comparative Examples 3-1 to 3-10 there were prepared lubricating oil compositions (0W-20 oils) having the compositions shown in Tables 16 and 17, using the respective lubricating base oils listed in Tables 14 and 15 and the following additives.

(Additives)

A 1: Alkyldiphenylamine

B1: Zinc dialkyldithiophosphate (phosphorus content: 7.2% by mass, alkyl group: mixture of secondary butyl group or secondary hexyl group)

C1: Ca sulfonate

D1: Polybutenylsucciniimide (bis type, weight-average molecular weight: 8,500, nitrogen content: 0.65% by mass)

E1: Polymethacrylate-based viscosity index improver (dispersed polymethacrylate having a polymethacrylate with weight-average molecular weight MW: 300,000, PSSI=40 and comprising alkyl methacrylate mixture (alkyl groups: C1 and C12-15 straight-chain alkyl groups) and dimethylaminoethyl methacrylate as main structural units).

F1: Polymethacrylate-based viscosity index improver (dispersed polymethacrylate having a polymethacrylate with weight-average molecular weight MW: 100,000, PSSI=5 and comprising alkyl methacrylate mixture (alkyl groups: C1 and C12-15 straight-chain alkyl groups) and dimethylaminoethyl methacrylate as main structural units).

F2: Polymethacrylate-based viscosity index improver (dispersed polymethacrylate having a polymethacrylate with weight-average molecular weight MW: 500,000, PSSI=30 (alkyl methacrylate mixture (alkyl groups: C1 and C12-15 straight-chain alkyl groups)) and dimethylaminoethyl methacrylate as main structural units).

F3: Ethylene-propylene copolymer (weight-average molecular weight: 175,000, Hitec-5751® by Afton).

F4: Styrene-propylene copolymer (molecular weight: 150,000, styrene/hydrogenated isoprene linear diblock copolymer, Infineum SV151®).

The properties of the lubricating oil compositions of Examples 3-1 to 3-3 and Comparative Examples 3-1 to 3-10 are shown in Tables 16 and 17. The row headed "Baking load" in Tables 16 and 17 is the baking load measured using a Falex P/V tester, applying a load with a ratchet after running-in for 5 minutes at 500 lbf. Also, the row headed "Abrasion wear" in Tables 16 and 17 is the total amount of wear of the pin and block, measured in a friction test using a Falex P/V tester, before and after operation for 30 minutes at 1000 lbf.

TABLE 16

| | | Example 3-1 | Example 3-2 | Example 3-3 | Comp. Ex. 3-1 | Comp. Ex. 3-2 | Comp. Ex. 3-3 | Comp. Ex. 3-4 |
|---|---|---|---|---|---|---|---|---|
| Lubricating base oil | Base oil 3-1 | 100 | — | — | 100 | 100 | 100 | 100 |
| | Base oil 3-2 | — | 100 | — | — | — | — | — |
| | Base oil 3-3 | — | — | 100 | — | — | — | — |
| Lubricating oil composition | Base oil | remainder | remainder | remainder | remainder | remainder | remainder | remainder |
| | A1 | 1.0 | 1.0 | 1.0 | 1.0 | 1.0 | 1.0 | 1.0 |
| | B1 | 0.6 | 0.6 | 0.6 | 0.6 | 0.6 | 0.6 | 0.6 |
| | C1 | 2 | 2 | 2 | 2 | 2 | 2 | 2 |
| | D1 | 6 | 6 | 6 | 6 | 6 | 6 | 6 |
| | E1 | 8 | 8 | 8 | — | — | — | — |
| | F1 | — | — | — | 8 | — | — | — |
| | F2 | — | — | — | — | 8 | — | — |
| | F3 | — | — | — | — | — | 8 | — |
| | F4 | — | — | — | — | — | — | 8 |
| HTHS viscosity (150° C.), mPa · s | | 2.6 | 2.6 | 2.6 | 2.6 | 2.6 | 2.6 | 2.6 |
| Viscosity index | | 235 | 238 | 243 | 228 | 232 | 234 | 237 |
| Acid number, mgKOH/g | | 2.18 | 2.09 | 2.11 | 2.12 | 2.26 | 2.17 | 2.21 |
| Base number, moKOH/g | | 4.31 | 4.55 | 4.42 | 4.28 | 4.26 | 4.33 | 4.42 |
| CCS viscosity, mPa · s (−35° C.) | | 2,950 | 2,880 | 3,150 | 2,680 | 2,730 | 3,150 | 3,080 |
| MRV viscosity, mPa · s (−40° C.) | | 5,900 | 5,800 | 6,200 | 6,100 | 6,400 | 5,620 | 5,810 |
| Baking load, lbf | | 1850 | 1820 | 1880 | 1320 | 1290 | 1350 | 1310 |
| Abrasion wear, mg | | 2.8 | 3.1 | 2.9 | 13.2 | 12.8 | 18.5 | 20.2 |

TABLE 17

| | | Comp. Ex. 3-5 | Comp. Ex. 3-6 | Comp. Ex. 3-7 | Comp. Ex. 3-8 | Comp. Ex. 3-9 | Comp. Ex. 3-10 |
|---|---|---|---|---|---|---|---|
| Lubricating base oil composition (% by mass) | Base oil 3-1 | — | — | — | — | — | — |
| | Base oil 3-2 | — | — | — | — | — | — |
| | Base oil 3-3 | — | — | — | — | — | — |
| | Base oil 3-4 | 100 | 100 | 100 | 100 | 100 | — |
| | Base oil 3-5 | — | — | — | — | — | 100 |
| Lubricating oil composition (% by mass) | Base oil | remainder | remainder | remainder | remainder | remainder | remainder |
| | A1 | 1.0 | 1.0 | 1.0 | 1.0 | 1.0 | 1.0 |
| | B1 | 0.6 | 0.6 | 0.6 | 0.6 | 0.6 | 0.6 |
| | C1 | 2 | 2 | 2 | 2 | 2 | 2 |
| | D1 | 6 | 6 | 6 | 6 | 6 | 6 |
| | E1 | 8 | — | — | — | — | 8 |
| | F1 | — | 8 | — | — | — | — |
| | F2 | — | — | 8 | — | — | — |
| | F3 | — | — | — | 8 | — | — |
| | F4 | — | — | — | — | 8 | — |
| HTHS viscosity (150° C.), mPa · s | | 2.6 | 2.6 | 2.6 | 2.6 | 2.6 | 2.6 |
| Viscosity index | | 232 | 235 | 229 | 232 | 202 | 205 |
| Acid number, mgKOH/g | | 1.98 | 2.19 | 2.25 | 2.33 | 2.08 | 1.95 |
| Base number, moKOH/g | | 4.29 | 4.18 | 4.37 | 4.22 | 4.29 | 4.17 |
| CCS viscosity, mPa · s (−35° C.) | | 3,300 | 3,150 | 2,970 | 3,010 | 3,320 | 3,280 |
| MRV viscosity, mPa · s (−40° C.) | | 5,900 | 6,100 | 5,700 | 5,900 | 13,500 | 14,300 |
| Baking load, lbf | | 1,150 | 1,080 | 1,210 | 1,190 | 1,280 | 1,310 |
| Abrasion wear, mg | | 15.2 | 14.8 | 16.8 | 17.2 | 12.8 | 10.9 |

The invention claimed is:

1. A lubricating oil composition comprising:

a lubricating base oil comprising a first lubricating base oil component having a urea adduct value of not greater than 4% by mass, a kinematic viscosity at 40° C. of 14-25 $mm^2/s$ and a viscosity index of 120 or higher, and a second lubricating base oil component having a kinematic viscosity at 40° C. of less than 14 $mm^2/s$, wherein the content of the first lubricating base oil component is 10-99% by mass and the content of the second lubricating base oil component is 1-50% by mass, based on the total amount of the lubricating base oil; and a viscosity index improver, the lubricating oil composition having a kinematic viscosity at 100° C. of 4-12 $mm^2/s$ and a viscosity index of 200-350.

2. The lubricating oil composition according to claim 1, wherein the viscosity index improver is a poly(meth)acrylate-based viscosity index improver.

3. The lubricating oil composition according to claim 2, wherein the PSSI of the poly(meth)acrylate-based viscosity index improver is not greater than 40, and the ratio of the weight-average molecular weight and the PSSI of the poly (meth)acrylate-based viscosity index improver is at least $1\times10^4$.

4. The lubricating oil composition according to claim 1, wherein a ratio of a HTHS viscosity at 100° C. with respect to a HTHS viscosity at 150° C. satisfies the condition represented by the following inequality (A):

$$HTHS(100°\ C.)/HTHS(150°\ C.)\leq 2.04 \quad (A)$$

wherein HTHS (100° C.) represents the HTHS viscosity at 100° C. and HTHS (150° C.) represents the HTHS viscosity at 150° C.

5. The method for producing a lubricating oil composition comprising:

blending a first lubricating base oil component having a urea adduct value of not greater than 4% by mass, a kinematic viscosity at 40° C. of 14-25 $mm^2/s$ and a viscosity index of 120 or higher, a second lubricating base oil component having a kinematic viscosity at 40° C. of less than 14 $mm^2/s$, and a viscosity index improver, to obtain a lubricating base oil wherein the content of the first lubricating base oil component is 10-99% by mass and the content of the second lubricating base oil component is 1-50% by mass, based on the total amount of the lubricating base oil; and adding a viscosity index improver to the lubricating base oil, to obtain a lubricating oil composition having a kinematic viscosity at 100° C. of 4-12 $mm^2/s$ and a viscosity index of 200-350.

6. The lubricating oil composition for an internal combustion engine comprising:

a lubricating base oil, having a viscosity index of 100 or higher, an initial boiling point of not higher than 400° C., a 90% distillation temperature of 470° C. or higher and a difference between the 90% distillation temperature and the 10% distillation temperature of at least a 70° C., an ashless antioxidant containing no sulfur as a constituent element; and at least one selected from among ashless antioxidants containing sulfur as a constituent element and organic molybdenum compounds, wherein the lubricating base oil comprises a first lubricating base oil component having a urea adduct value of not greater than 4% by mass, a viscosity index of 100 or higher and a kinematic viscosity at 100° C. of at least 3.5 $mm^2/s$ and less than 4.5 $mm^2/s$, and a second lubricating base oil component having a urea adduct value of not greater than 4% by mass, a viscosity index of 120 or higher and a kinematic viscosity at 100° C. of 4.5-20 $mm^2/s$.

7. The lubricating oil composition for an internal combustion engine according to claim 6, wherein the first lubricating base oil component is a lubricating base oil component obtained by hydrocracking/hydroisomerization of a feed stock oil containing normal paraffins so as to obtain a treated product having a urea adduct value of not greater than 4% by mass, a viscosity index of 100 or higher and a kinematic viscosity at 100° C. of at least 3.5 $mm^2/s$ and less than 4.5 $mm^2/s$, and the second lubricating base oil component is a lubricating base oil component obtained by hydrocracking/hydroisomerization of a feed stock oil containing normal paraffins so as to obtain a treated product having a urea adduct value of not greater than 4% by mass, a viscosity index of 120 or higher and a kinematic viscosity at 100° C. of 4.5-20 $mm^2/s$.

8. The lubricating oil composition for an internal combustion engine according to claim 6, wherein the low-temperature viscosity grade is SAE0W or 5W and the high-temperature viscosity grade is SAE30 or greater.

9. The lubricating oil composition for an internal combustion engine according to claim 6, wherein the CCS viscosity at −35° C. is not greater than 6,000 mPa·s.

10. The lubricating oil composition for an internal combustion engine according to claim 6, wherein the MRV viscosity at −40° C. is not greater than 20,000 mPa·s.

11. A method for producing a lubricating oil composition for an internal combustion engine comprising:

blending a first lubricating base oil component having a urea adduct value of not greater than 4% by mass, a viscosity index of 100 or higher and a kinematic viscosity at 100° C. of at least 3.5 $mm^2/s$ and less than 4.5 $mm^2/s$, and a second lubricating base oil component having a urea adduct value of not greater than 4% by mass, a viscosity index of 120 or greater and a kinematic viscosity at 100° C. of 4.5-20 $mm^2/s$, to obtain a lubricating base oil having a viscosity index of 100 or higher, an initial boiling point of not higher than 400° C., a 90% distillation temperature of 470° C. or higher and a difference between the 90% distillation temperature and a 10% distillation temperature of at least 70° C., and adding an ashless antioxidant containing no sulfur as a constituent element, and at least one selected from among ashless antioxidants containing sulfur as a constituent element and organic molybdenum compounds to the lubricating base oil.

* * * * *